US009460601B2

(12) United States Patent
Mimar

(10) Patent No.: US 9,460,601 B2
(45) Date of Patent: Oct. 4, 2016

(54) DRIVER DISTRACTION AND DROWSINESS WARNING AND SLEEPINESS REDUCTION FOR ACCIDENT AVOIDANCE

(71) Applicant: Tibet Mimar, Sunnyvale, CA (US)

(72) Inventor: Tibet Mimar, Sunnyvale, CA (US)

( * ) Notice: Subject to any disclaimer, the term of this patent is extended or adjusted under 35 U.S.C. 154(b) by 213 days.

(21) Appl. No.: 14/147,580

(22) Filed: Jan. 5, 2014

(65) Prior Publication Data

US 2014/0139655 A1 May 22, 2014

Related U.S. Application Data

(63) Continuation-in-part of application No. 13/986,206, filed on Apr. 13, 2013, now abandoned, and a continuation-in-part of application No. 13/986,211, filed on Apr. 13, 2013, now abandoned, said application No. 13/986,206 is a continuation-in-part of application No. 12/586,374, filed on Sep. 20, 2009, now Pat. No. 8,547,435.

(51) Int. Cl.
*G08B 21/06* (2006.01)
*G08B 21/04* (2006.01)

(52) U.S. Cl.
CPC ..... *G08B 21/06* (2013.01); *G08B 21/0476* (2013.01)

(58) Field of Classification Search
CPC ..... G08B 21/0476; G08B 21/06; G09K 9/00845; G06Q 30/0283; G06Q 40/08; H04N 7/188
USPC ..... 340/575; 348/148, 77
See application file for complete search history.

(56) References Cited

U.S. PATENT DOCUMENTS

| | | | | |
|---|---|---|---|---|
| 5,642,093 | A | 6/1997 | Kinoshita et al. | |
| 6,049,747 | A | 4/2000 | Nakajima et al. | |
| 6,154,559 | A | 11/2000 | Beardsley | |
| 6,333,759 | B1 | 12/2001 | Mazzilli | |
| 8,144,002 | B2 | 3/2012 | Kiuchi | |
| 8,547,435 | B2 | 10/2013 | Mimar | |
| 2003/0156192 | A1 | 8/2003 | Cho | |
| 2006/0087582 | A1 | 4/2006 | Scharenbroch et al. | |
| 2006/0209187 | A1 | 9/2006 | Farneman | |
| 2006/0255956 | A1* | 11/2006 | Arakawa | B60K 28/066 340/576 |
| 2006/0287779 | A1 | 12/2006 | Smith et al. | |
| 2007/0014431 | A1* | 1/2007 | Hammoud | G06K 9/00604 382/103 |
| 2007/0109111 | A1 | 5/2007 | Breed et al. | |
| 2007/0159344 | A1 | 7/2007 | Kisacanin | |
| 2008/0143504 | A1 | 6/2008 | Martin Alvarez | |
| 2010/0214087 | A1* | 8/2010 | Nakagoshi | A61B 5/18 340/436 |
| 2010/0214105 | A1 | 8/2010 | Manotas, Jr. | |
| 2010/0219955 | A1 | 9/2010 | Demirdjian et al. | |
| 2010/0238034 | A1 | 9/2010 | Gunaratne | |
| 2010/0322507 | A1 | 12/2010 | Gunaratne | |
| 2011/0163863 | A1 | 7/2011 | Chatmon | |
| 2012/0212353 | A1* | 8/2012 | Fung | B60K 28/06 340/905 |

(Continued)

*Primary Examiner* — Behrooz Senfi

(57) ABSTRACT

The present invention relates to a vehicle telematics device for driver monitoring for accident avoidance for drowsiness and distraction conditions. The distraction and drowsiness is detected by facial processing of driver's face and pose tracking as a function of speed and maximum allowed travel distance, and issuing a driver alert when a drowsiness or distraction condition is detected. The mitigation includes audible alert, as well as other methods such as dim blue night to perk up the driver. Adaptation center of driver's gaze direction and allowed maximum time for a given driver and camera angle offset as well as temporary offset for cornering for shift of vanishing point and other conditions is also performed.

20 Claims, 49 Drawing Sheets

(56) References Cited

U.S. PATENT DOCUMENTS

2013/0009761 A1* 1/2013 Horseman ..... B60W 40/08
340/425.5
2013/0010096 A1* 1/2013 S. ..... A61B 3/113
348/78
2013/0021463 A1 1/2013 Hatakeyama
2013/0044000 A1 2/2013 Nakai et al.
2013/0076885 A1 3/2013 Kobetski et al.
2014/0139341 A1* 5/2014 Green ..... B60K 28/06
340/576
2014/0276090 A1* 9/2014 Breed ..... A61B 5/18
600/473

* cited by examiner

Prior Art FIG. 1

| Pin Number | Usage |
|---|---|
| 1 | Ground |
| 2 | Always_On_12V |
| 3 | Ground |
| 4 | Switched_12V |
| 5 | External_Trigger |
| 6 | Ground_Loop |

Table: Power Connector Pin Definitions

FRONT VIEW – PCB & ENCLOSURE

Driver Gaze direction as a function of speed

[Adapted from Roger et al. 2005]

| Speed (MPH) | LUT Content = Max_Distraction_Time_Allowed (Seconds) |
|---|---|
| 0 to S1 | Not Used |
| S1 + 1 | Max_Distraction_Time_Allowed = (Distraction_Travel_Distance/1.46667) / Speed<br><br>Distraction_Travel_Distance = 150 feet |
| ... | |
| 20 | 5.11 |
| ... | |
| 40 | 2.55 |
| ... | |
| 65 | 1.57 |
| ... | |
| 85 | 1.20 |
| ... | |
| 120 | 0.85 |

FIG. 26

| Speed (MPH) | LUT Content = Max_Distraction_Time_Allowed (Seconds) |
|---|---|
| 0 to S1 | Not Used |
| S1 + 1 | (Distraction_Travel_Distance/1.46667) / Speed<br>Distraction_Travel_Distance = 250 feet |
| ... | |
| 20 | 8.52 |
| ... | |
| 40 | 4.26 |
| ... | |
| 65 | 2.62 |
| ... | |
| 85 | 2.00 |
| ... | |
| 120 | 1.42 |

FIG. 29

| Speed (MPH) | LUT Content = Max_Drowsiness_Time_Allowed (Seconds) |
|---|---|
| 0 to $SPEED_{LOW}$ | Not Used: Disabled |
| $SPEED_{LOW}$ + 1 | Max_Drowsiness_Time_Allowed = (Drowsiness_Travel_Distance/1.46667) / Speed<br><br>Drowsiness_Travel_Distance = 100 feet |
| ... | |
| 30 | 2.2 |
| ... | |
| 40 | 1.7 |
| ... | |
| 50 | 1.36 |
| ... | |
| 60 | 1.13 |
| $SPEED_{HIGH}$ | 1.13 |
| ... | |
| 120 | 1.13 |
| EXAMPLE DROWSINESS TIME ALLOWED CALCULATION | |

FIG. 38

```
Yaw12 = Yaw11;
Yaw11 = Yaw10;
Yaw10 = Yaw9;
Yaw9 = Yaw8;
Yaw8 = Yaw7;
Yaw7 = Yaw6;
Yaw6 = Yaw5;
Yaw5 = Yaw4;
Yaw4 = Yaw3;
Yaw3 = Yaw2;
Yaw2 = Yaw1;
Yaw1 = inputSignal;

Gain = H0 + H1 + H2 + H3 + H4 + H5 + H6 + H7 + H8 + H9 + H10 + H11 +
H12;

Filtered_Yaw_Angle = (Yaw0 * H0 + Yaw1 * H1 + Yaw2 * H2 + Yaw3 *
H3 + Yaw4 * H4 + Yaw5 * H5 + Yaw6 * H6 + Yaw7 * H7 + Yaw8 * H8 +
Yaw9 * H9 + Yaw10 * H10 + Yaw11 * H11 + Yaw12 * H12) / Gain;

Convolution Kernel H = {1, 1, 1, 1, 1, 1, 1, 1, 1, 0, 0, 0}
```

FIG. 41

| | | Predicted | |
|---|---|---|---|
| | | Distraction | No Distraction |
| Actual | Distraction | Good | Missed Alarm |
| | No Distraction | False Alarm | Good |
| Confusion Matrix | | | |

FIG. 44

DRIVER DISTRACTION AND DROWSINESS WARNING AND SLEEPINESS REDUCTION FOR ACCIDENT AVOIDANCE

CROSS-REFERENCE TO RELATED APPLICATIONS

This application claims priority from and is a continuation-In-part of U.S. patent application Ser. Nos. 13/986,206 and 13/986, 211, both filed on Apr. 13, 2013, both of which claim priority from and are a continuation-in-part patent application of previously filed U.S. application Ser. No. 12/586,374, filed Sep. 20, 2009, now U.S. Pat. No. 8,547, 435, issued Oct. 1, 2013. This application also claims priority from and the benefit of U.S. Provisional Application Ser. No. 61/959,837, filed on Sep. 1, 2013, which is incorporated herein by reference. This application also claims priority from and the benefit of U.S. Provisional Application Ser. No. 61/959,828, filed on Sep. 1, 2013, which is incorporated herein by reference.

BACKGROUND OF THE INVENTION

Field of the Invention

The evidentiary recording of video is used in some commercial vehicles and police cruisers. These systems cost several thousand dollars and also are very bulky to be installed in regular cars, as shown in FIG. 1. Also, there are certain video recording systems for teenager driving supervision and teenager driver analytics that is triggered by certain threshold of acceleration and deceleration and records several second before and after each such trigger. In today's accidents, it is not clear who is at fault, because each party blames each other as the cause of accident, and police, unless accident happened to be actually observed by the police simply fills accident reports, where each party becomes responsible for their own damages. Driving at the legal limit causes tail gating, and other road rage, and later blaming the law-abiding drivers. Also, there is exposure to personal injury claims in the case of pedestrian's jay walking, bicycles going in the wrong direction, red light runners, etc. Witnesses are very hard to find in such cases.

A vehicle video security system would provide evidentiary data and put the responsibility on the wrongful party and help with the insurance claims. However, it is not possible to spend several thousand dollars for such security for regular daily use in cars by most people.

A compact and mobile security could also be worn by security and police officers for recording events just as in a police cruiser. A miniature security device can continuously record daily work of officers and be offloaded at the end of each day and be archived. Such a mobile security module must be as small as an iPod and be able to be clipped on the chest pocket where the camera module would be externally visible. Such a device could also be considered a very compact, portable and wearable personal video recorder that could be used to record sports and other activities just as a video camcorder but without having to carry-and-shoot by holding it, but instead attaching to clothing such as clipping.

Mobile Witness from Say Security USA consists of a central recording unit that weighs several pounds, requires external cameras, and records on hard disk. It uses MPEG-4 video compression standard, and not the advanced H.264 video compression. Some other systems use H.264 but record on hard disk drive and have external cameras, and is quite bulky and at cost points for only commercial vehicles.

Farneman (US2006/0209187) teaches a mobile video surveillance system with a wireless link and waterproof housing. The camera sends still images or movies to a computer network for viewing with a standard web browser. The camera unit may be attached to a power supply and a solar panel may be incorporated into at least one exterior surface. This application has no local storage, does not include video compression, and continuously streams video data.

Cho (US2003/0156192) teaches a mobile video security system for use at the airports, shopping malls and office buildings. This mobile video security system is wireless networked to central security monitoring system. All of security personnel carry a wireless hand held personal computer to communicate with central video security. Through the wireless network, all of security personnel are capable to receive video images and also communicate with each other. This application has no local storage, does not include video compression, and continuously streams video data.

Szolyga (U.S. Pat. No. 7,319,485, Jan. 15, 2008) teaches an apparatus and method for recording data in a circular fashion. The apparatus includes an input sensor for receiving data, a central processing unit coupled to the buffer and the input sensor. The circular buffer is divided into different sections that are sampled at different rates. Once data begins to be received by the circular buffer, data is stored in the first storing portion first. Once the first storage portion reaches a predetermined threshold (e.g. full storage capacity), data is moved from the first storage portion to the second portion. Because the data contents of the first storage portion are no longer at the predetermined threshold, incoming data can continue to be stored in the first storage portion. In the same fashion, once the second storage portion reaches a predetermined threshold, data is moved from the second storage portion to the third storage portion. Szolyga does not teach video compression, having multiple cameras multiplexed, removable storage media, video preprocessing for real-time lens correction and video performance improvement and also motion stabilization.

Mazzilli (U.S. Pat. No. 6,333,759, December 2055, 2001) teaches 360 degree automobile video camera system. The system consists of camera module with multiple cameras, a multiplexer unit mounted in the truck, and a Video Cassette Recorder (VCR) mounted in trunk. Such a system requires extensive wiring, records video without compression, and due to multiplexing of multiple video channels on a standard video, it reduces the available video quality of each channel.

Existing systems capture video data at low resolution (CIF or similar at 352×240) and at low frame rates (<30 fps), which results in poor video quality for evidentiary purposes. Also, existing systems do not have multiple cameras, video compression, and video storage not incorporated into a single compact module, where advanced H.264 video compression and motion stabilization is utilized for high video quality. Furthermore, existing systems are at high cost points in the range of $1,000-$5,000, which makes it not practically possible to be used in consumer systems and wide deployment of large number of units.

Also, the video quality of existing systems is very poor, in addition to not supporting High Definition (HD), because motion stabilization and video enhancement algorithms such as Motion-Adaptive spatial and temporal filter algorithms are not used. Furthermore, most of the existing systems are not connected to the internet with fast 3G, third generation of mobile telecommunications technology, or fourth generation 4G wireless networks, and also do not use adaptive streaming algorithms to match network conditions for live view of accident and other events by emergency services or for fleet management from any web enabled device.

Distraction Accident Avoidance

Accidents occur due to dozing off at the wheel or not observing the road ahead. About 1 Million distraction accidents occur annually in North America. Drivers in crashes: At least one driver was reported to have been distracted in 15% to 30% of crashes. The proportion of distracted drivers may be greater because investigating officers may not detect or record all distractions. In many crashes it is not known whether the distractions caused or contributed to the crash. Distraction occurs when a driver's attention is diverted away from driving by some other activity. Most distractions occur while looking at something other than the road.

Eye trackers have also been used as part of accident avoidance with limited success. The most widely used current designs are video-based eye trackers. A camera focuses on one or both eyes and records their movement as the viewer looks at some kind of stimulus. Most modern eye-trackers use the center of the pupil and infrared/near-infrared non-collimated light to create corneal reflections (CR). The vector between the pupil center and the corneal reflections can be used to compute the point of regard on surface or the gaze direction. A calibration procedure of the individual is usually needed before using the eye tracker that makes this not very convenient for vehicle distraction detection.

Two general types of eye tracking techniques are used: Bright Pupil and Dark Pupil. Their difference is based on the location of the illumination source with respect to the optics. If the illumination is coaxial with the optical path, then the eye acts as a retro reflector as the light reflects off the retina creating a bright pupil effect similar to red eye. If the illumination source is offset from the optical path, then the pupil appears dark because the retro reflection from the retina is directed away from the camera.

Bright Pupil tracking creates greater iris/pupil contrast allowing for more robust eye tracking with all iris pigmentation and greatly reduces interference caused by eyelashes and other obscuring features. It also allows for tracking in lighting conditions ranging from total darkness to very bright. But bright pupil techniques are not effective for tracking outdoors as extraneous IR sources interfere with monitoring which is usually the case due to sun and other lightening conditions in a vehicle that varies quite a bit.

Eye tracking setups vary greatly; some are head-mounted, some require the head to be stable (for example, with a chin rest), and some function remotely and automatically track the head during motion. Neither of these is convenient or possible for in-vehicle use. Most use a sampling rate of at least 30 Hz. Although 50/60 Hz is most common, today many video-based eye trackers run at 240, 350 or even 1000/1250 Hz, which is needed in order to capture the detail of the very rapid eye movement during reading, or during studies of neurology.

There is also a difference between eye tracking versus gaze tracking. Eye trackers necessarily measure the rotation of the eye with respect to the measuring system. If the measuring system is head mounted, then eye-in-head angles are measured. If the measuring system is table mounted, as with scleral search coils or table mounted camera ("remote") systems, then gaze angles are measured.

In many applications, the head position is fixed using a bite bar, a forehead support or something similar, so that eye position and gaze are the same. In other cases, the head is free to move, and head movement is measured with systems such as magnetic or video based head trackers. For head-mounted trackers, head position and direction are added to eye-in-head direction to determine gaze direction. For table-mounted systems, such as search coils, head direction is subtracted from gaze direction to determine eye-in-head position.

A great deal of research has gone into studies of the mechanisms and dynamics of eye rotation, but the goal of eye tracking is most often to estimate gaze direction. Users may be interested in what features of an image draw the eye, for example. It is important to realize that the eye tracker does not provide absolute gaze direction, but rather can only measure changes in gaze direction. In order to know precisely what a subject is looking at, some calibration procedure is required in which the subject looks at a point or series of points, while the eye tracker records the value that corresponds to each gaze position. Even those techniques that track features of the retina cannot provide exact gaze direction because there is no specific anatomical feature that marks the exact point where the visual axis meets the retina, if indeed there is such a single, stable point. An accurate and reliable calibration is essential for obtaining valid and repeatable eye movement data, and this can be a significant challenge for non-verbal subjects or those who have unstable gaze.

Each method of eye tracking has advantages and disadvantages, and the choice of an eye tracking system depends on considerations of cost and application. There are offline methods and online procedures for attention tracking. There is a trade-off between cost and sensitivity, with the most sensitive systems costing many tens of thousands of dollars and requiring considerable expertise to operate properly. Advances in computer and video technology have led to the development of relatively low cost systems that are useful for many applications and fairly easy to use. Interpretation of the results still requires some level of expertise, however, because a misaligned or poorly calibrated system can produce wildly erroneous data.

Eye tracking while driving a vehicle in a difficult situation differs between a novice driver and an experienced one. The study shows that the experienced driver checks the curve and further ahead while the novice driver needs to check the road and estimate his distance to the parked car he is about to pass, i.e., looks much closer areas on the front of a vehicle.

One difficulty in evaluating an eye tracking system is that the eye is never still, and it can be difficult to distinguish the tiny, but rapid and somewhat chaotic movement associated with fixation from noise sources in the eye tracking mechanism itself. One useful evaluation technique is to record from the two eyes simultaneously and compare the vertical rotation records. The two eyes of a normal subject are very tightly coordinated and vertical gaze directions typically agree to within +/−2 minutes of arc (Root Mean Square or RMS of vertical position difference) during steady fixation. A properly functioning and sensitive eye tracking system will show this level of agreement between the two eyes, and any differences much larger than this can usually be attributed to measurement error. However, this makes it difficult to do eye tracking reliable in a vehicle due to differing illumination conditions for both eyes.

Research is currently underway to integrate eye tracking cameras into automobiles. The goal of this endeavor is to provide the vehicle with the capacity to assess in real-time the visual behavior of the driver. The National Highway Traffic Safety Administration (NHTSA) estimates that distractions are the primary causal factor in one million police-reported accidents per year. Another NHTSA study suggests that 80% of collisions occur within three seconds of a distraction. By equipping automobiles with the ability to monitor distraction driving safety could be dramatically enhanced. Most of the current experimental systems in the lab use eye pupil location to determine the gaze direction.

Breed (US2007/0109111 A1 dated May 17, 2007, titled Accident Avoidance Systems and Methods) teaches accident avoidance systems and methods by use of positioning systems arranged in each vehicle determining absolute position of a first and second vehicle, and communicating the position of second vehicle to the first one. The reactive component is arranged to initiate an action or change its operation when a collision is predicted by the processor, e.g., sound or indicate an alarm. However, this assumes most vehicle are armed with such wireless communication systems, and that there is a common protocol that is established to such communication and what action each vehicle takes. Furthermore, this does not address hitting a tree or driving off the road due to a distraction.

Arai et al (U.S. Pat. No. 5,642,093, titled Warning System for Vehicle) discloses a warning system for a vehicle obtains image data by three-dimensionally recognizing a road extending ahead of the vehicle and traffic conditions, decides that driver's wakefulness is on a high level when there is any one of psychological stimuli to the driver or that driver's wakefulness is on a low level when there is not psychological stimulus to the driver, estimates the possibilities of collision and off-lane travel, and gives the driver a warning against collision or off-lane travel when there is the high possibility of collision or off-lane travel.

Ishikawa et al (U.S. Pat. No. 6,049,747, titled Driver Monitoring Device) discloses a driver monitoring system, a pattern projecting device consisting of two fiber gratings stacked orthogonally which receive light from a light source projects a pattern of bright spots on a face of a driver. An image pick-up device picks up the pattern of bright spots to provide an image of the face. A data processing device processes the image, samples the driver's face to acquire three-dimensional position data at sampling points and processing the data thus acquired to provide inclinations of the face of the driver in vertical, horizontal and oblique directions. A decision device decides whether or not the driver is in a dangerous state in accordance with the inclinations of the face obtained.

Beardsley (U.S. Pat. No. 6,154,559, titled System for Classifying an Individual's Gaze Direction) discusses a system is provided to classify the gaze direction of an individual. The system utilizes a qualitative approach in which frequently occurring head poses of the individual are automatically identified and labelled according to their association with the surrounding objects. In conjunction with processing of eye pose, this enables the classification of gaze direction. In one embodiment, each observed head pose of the individual is automatically associated with a bin in a "pose-space histogram". This histogram records the frequency of different head poses over an extended period of time. Given observations of a car driver, for example, the pose-space histogram develops peaks over time corresponding to the frequently viewed directions of toward the dashboard, toward the mirrors, toward the side window, and straight-ahead. Each peak is labelled using a qualitative description of the environment around the individual, such as the approximate relative directions of dashboard, mirrors, side window, and straight-ahead in the car example. The labeled histogram is then used to classify the head pose of the individual in all subsequent images. This head pose processing is augmented with eye pose processing, enabling the system to rapidly classify gaze direction without accurate a priori information about the calibration of the camera utilized to view the individual, without accurate a priori 3D measurements of the geometry of the environment around the individual, and without any need to compute accurate 3D metric measurements of the individual's location, head pose or eye direction at run-time. The acquired image is compared with the synthetic template using cross-correlation of the gradients of the image color, or "image color gradients". This generates a score for the similarity between the individual's head in the acquired image and the synthetic head in the template.

This is repeated for all the candidate templates, and the best score indicates the best-matching template. The histogram bin corresponding to this template is incremented. It will be appreciated that in the subject system, the updating of the histogram, which will subsequently provide information about frequently occurring head poses, has been achieved without making any 3D metric measurements such as distances or angles for the head location or head pose. This requires a lot of processing power. Also, eye balls are used which are not usually stable and jitters, and speed and cornering factors are not considered.

Kiuchi (U.S. Pat. No. 8,144,002, titled Alarm System for Alerting Driver to Presence of Objects) presents an alarm system that comprises an eye gaze direction detecting part, an obstacle detecting device and an alarm controlling part. The eye gaze direction detecting part determines a vehicle driver's field of view by analyzing facial images of a driver of the vehicle pictured by using a camera equipped in the vehicle. The obstacle detecting device detects the presence of an obstacle in the direction unobserved by the driver using a radar equipped in the vehicle, the direction of which radar is set up in the direction not attended by the driver on the basis of data detected by the eye gaze monitor. The alarm controlling part determines whether to make an alarm in case an obstacle is detected by the obstacle detecting device. The systems can detect the negligence of a vehicle driver in observing the front view targets and release an alarm to prevent the driver from any possible danger. This uses combination of obstacle detection and gaze direction.

Japanese Pat. No. JP32-32873 discloses a device which emits an invisible ray to the eyes of a driver and detects the direction of a driver's eye gaze based on the reflected light.

Japanese Pat. No. JP40-32994 discloses a method of detecting the direction a driver's eye gaze by respectively obtaining the center of the white portion and that of the black portion (pupil) of the driver's eyeball.

Japanese Patent Application Publication No. JP2002-331850 discloses a device which detects target awareness of a driver by determining the driver's intention of vehicle operation behavior by analyzing his vehicle operation pattern based on the parameters calculated by using Hidden Markov Model (HIM) for the frequency distribution driver's eye gaze herein the eye gaze direction of the driver is detected as a means to determine driver's vehicle operation direction.

Kisacanin (US2007/0159344, Dec. 23, 2005, titled Method of detecting vehicle-operator state) discloses a method of detecting the state of an operator of a vehicle utilizes a low-cost operator state detection system having no more than one camera located preferably in the vehicle and directed toward a driver. A processor of the detection system processes preferably three points of the facial feature of the driver to calculate head pose and thus determine driver state (i.e. distracted, drowsy, etc.). The head pose is generally a three dimensional vector that includes the two angular components of yaw and pitch, but preferably not roll. Preferably, an output signal of the processor is sent to a counter-measure system to alert the driver and/or accentuate vehicle safety response. However, Kisacanin uses location of two eyes and nose to determine the head pose, and when one of the eyes occluded the pose calculation will fail. It is also not clear how location of eyes and nose is reliably detected and how driver's face is recognized.

Japanese Patent Application Publication No. H11-304428 discloses a system to assist a vehicle driver for his operation by alarming a driver when he is not fully attending to his driving in observing his front view field based on the fact that his eye blinking is not detected or an image which shows that the driver's eyeball faces the front is not detected for a certain period of time.

Japanese Patent Application Publication No. H7-69139 discloses a device which determines the target awareness of a driver based on the distance between the two eyes of the driver calculated based on the images pictured from the side facing the driver.

Smith et al (US2006/0287779 A1, titled Method of Mitigating Driver Distraction) provides a driver alert for mitigating driver distraction is issued based on a proportion of off-road gaze time and the duration of a current off-road gaze. The driver alert is ordinarily issued when the proportion of off-road gaze exceeds a threshold, but is not issued if the driver's gaze has been off-road for at least a reference time. In vehicles equipped with forward-looking object detection, the driver alert is also issued if the closing speed of an in-path object exceeds a calibrated closing rate.

Alvarez et al (US2008/0143504 titled Device to Prevent Accidents in Case of Drowsiness or Distraction of the Driver of a Vehicle) provides a device for preventing accidents in the event of drowsiness overcoming the driver of a vehicle. The device comprises a series of sensors which are disposed on the vehicle steering wheel in order to detect the drivers grip on the wheel and the drivers pulse. The aforementioned sensors are connected to a control unit which is equipped with the necessary programming and/or circuitry to activate an audible indicator in the event of the steering wheel being released by both hands and/or a fall in the drivers pulse to below the threshold of consciousness. The device employs a shutdown switch.

Drowsiness Accident Avoidance

Accidents also occur due to dozing off at the wheel or not observing the road ahead. About 1.9 Million drowsiness accidents occur annually in North America. According to a poll, 60% of adult drivers—about 168 million people—say they have driven a vehicle while feeling drowsy in the past year, and more than one-third, (37% or 103 million people), have actually fallen asleep at the wheel. In fact, of those who have nodded off, 13% say they have done so at least once a month. Four percent—approximately eleven million drivers—admit they have had an accident or near accident because they dozed off or were too tired to drive.

Nakai et al (US2013/0044000, February 2013, titled Awakened-State Maintaining Apparatus And Awakened-State Maintaining Method) provided an awakened-state maintaining apparatus and awakened-state maintaining method for maintaining an awakened-state of the driver by displaying an image for stimulating the drivers visual sense in accordance with the traveling state of the vehicle and generating sound for stimulating the auditory sense or vibration for stimulating the tactual sense.

Hatakeyama (US2013/0021463, February 2013 titled Biological Body State Assessment Device) disclosed a biological body state assessment device capable of accurately assessing an absent minded state of a driver. The biological body state assessment device first acquires face image data of a face image capturing camera, detects an eye open time and a face direction left/right angle of a driver from face image data, calculates variation in the eye open time of the driver and variation in the face direction left/right angle of the driver, and performs threshold processing on the variation in the eye open time and the variation in the face direction left/right angle to detect the absent minded state of the driver. The biological body state assessment device assesses the possibility of the occurrence of drowsiness of the driver in the future using a line fitting method on the basis of an absent minded detection flag and the variation in the eye open time, and when it is assessed that there is the possibility of the occurrence of drowsiness, estimates an expected drowsiness occurrence time of the driver.

Chatman (US2011/0163863, July 2011, titled Driver's Alert System) disclosed a device to aid an operator of a vehicle includes a steering wheel of the vehicle operable to steer the vehicle, a touchscreen mounted on the steering wheel of the vehicle, a detection system to detect the contact of the operator with the touchscreen, and an alarm to be activated in the absence of the contact of the operator and when the vehicle is moving. The alarm may be is an audible alarm or/and the alarm may be a visual alarm. The steering wheel is mounted on a steering column, and the alarm is mounted on the steering column. The touchscreen may be positioned within a circular area, and the touchscreen may be continuous around the steering wheel.

Kobetski et al (US2013/0076885, September 2010, titled Eye Closure Detection Using Structured Illumination) disclosed a monitoring system that monitors and/or predicts drowsiness of a driver of a vehicle or a machine operator. A set of infrared or near infrared light sources is arranged such that an amount of the light emitted from the light source strikes an eye of the driver or operator. The light that impinges on the eye of the driver or operator forms a virtual image of the signal sources on the eye, including the sclera and/or cornea. An image sensor obtains consecutive images capturing the reflected light. Each image contains glints from at least a subset or from all of the light sources. A drowsiness index can be determined based on the extracted information of the glints of the sequence of images. The drowsiness index indicates a degree of drowsiness of the driver or operator.

Manotas (US20100214105, August 2010, titled Method of Detecting Drowsiness of a Vehicle Operator) disclosed a method of rectifying drowsiness of a vehicle driver includes capturing a sequence of images of the driver. It is determined, based in the images, whether a head of the driver is tilting away from a vertical orientation in a substantially lateral direction toward a shoulder of the driver. The driver is awakened with sensory stimuli only if it is determined that the head of the driver is tilting away from a vertical orientation in a substantially lateral direction toward a shoulder of the driver.

Scharenbroch et al (US2006/0087582, April 2006, titled Illumination and imaging system and method) disclosed a system and method that provided for actively illuminating and monitoring a subject, such as a driver of a vehicle. The system includes a video imaging camera orientated to generate images of the subject eye(s). The system also includes first and second light sources offset from each other and operable to illuminate the subject. The system further includes a controller for controlling illumination of the first and second light sources such that when the imaging camera detects sufficient glare, the controller controls the first and second light sources to minimize the glare. This is achieved by turning off the illuminating source causing the glare.

Gunaratne (US2010/0322507, Dec. 23, 2010, titled System and Method for Detecting Drowsy Facial Expressions of Vehicle Drives under Changing Illumination Conditions) disclosed a method of detecting drowsy facial expressions of vehicle drivers under changing illumination conditions. The method includes capturing an image of a person's face using an image sensor, detecting a face region of the image using a pattern classification algorithm, and performing, using an active appearance model algorithm, local pattern matching to identify a plurality of landmark points on the face region of the image. The facial expressions leading to hazardous driving situations, such as angry, panic expressions can be detected by this method and provide the driver with alertness of the hazards, if the facial expressions are included in the set of dictionary values. However, comparing a driver's facial landmarks to a dictionary of stored expression of a general human face does not produce reliable results. Also, Gunaratne does not teach how the level of eyes closed is determined, what happens if one of them is occluded, or how it can be used for drowsiness detection.

Similarly, Gunaratne (US2010/0238034), Sep. 23, 2010, titled System for Rapid Detection of Drowsiness in a Machine Operator) discloses a system for detection eye deformation parameters and/or mouth deformation parameters identify a yawn within the high priority sleepiness actions stored in the prioritized database, such a facial action can be used to compare with previous facial actions and generate an appropriate alarm for the driver and/or individuals within a motor vehicle, an operator of heavy equipment machinery and the like. This does not work reliably and Gunaratne does not provide if-and-how he determines the level of eyes closed, and how levels of eyes closed in detection of drowsiness condition of driver.

Demirdjian (US2010/0219955, Sep. 2, 2010, titled System, Apparatus and Associated Methodology for Interactively Monitoring and Reducing Driver Drowsiness) discloses a system, apparatus and associated methodology for interactively monitoring and reducing driver drowsiness use a plurality of drowsiness detection exercises to precisely detect driver drowsiness levels, and a plurality of drowsiness reduction exercises to reduce the detected drowsiness level. A plurality of sensors detect driver motion and position in order to measure driver performance of the drowsiness detection exercises and/or the drowsiness reduction exercises. The driver performance is used to compute a drowsiness level, which is then compared to a threshold. The system provides the driver with drowsiness reduction exercises at predetermined intervals when the drowsiness level is above the threshold. However, drowsiness is detected by having driver perform multiple exercises, which the driver may not be willing to do, especially if he or she is feeling drowsy.

Nakagoshi et al. (US2010/0214087, Aug. 26, 2010, titled Anti-Drowsiness Device and Anti-Drowsiness Method) discloses an anti-drowsing device that includes: an ECU that outputs a warning via a buzzer when a collision possibility between a preceding object and the vehicle is detected; a warning control ECU that establishes an early-warning mode in which a warning is output earlier from that used in a normal mode; and a driver monitor camera and a driver monitor ECU that monitors a drivers eyes. The warning control ECU establishes the early-warning mode when the eye-closing period of the driver becomes equal to or greater than a first threshold value, and thereafter maintains the early-warning mode until the eye-closing period of the driver falls below a second threshold value.

In Nakagoshi's disclosure the calculated eye-closing period "d" exceeds a predetermined threshold value "dm", the Warning control ECU changes the pre-crash determination threshold value "Th" from the default value "T0" to a value at which the PCS ECU is more likely to detect a collision possibility. More specifically, the Warning control ECU changes the pre-crash determination threshold value "Th" to a value "T1" (for example, T0+1.5 seconds), which is greater than the default value T0. The first threshold value "dm" may be an appropriate value in the range of 1 to 3 seconds, for example. Hence, eye closure is used as a pre-qualifier for frontal collision warning (Claims 13 and 4 and other disclosure). Eye closure detection is merely used to establish and activate an early warning system. For example, assume a driver is about the drive off the shoulder of road or run a red light in which case he will be hit from the side, because he is sleeping. In this case, since there is no imminent frontal collision, then no warning will be issued to wake up the driver.

Also, Nakagoshi integrates multiple eye-closure periods over a period of time to activate early warning, and this does not allow for direct mitigation of driver's drowsiness condition, as driver may already have an accident during such an integration period. Therefore, the index value P (Percentage Closed or PERCLOS) is a value obtained by dividing the summation of the eye-closing periods d within a period between the current time and 60 seconds before the current time, that is, the ratio of the eye-closing period per unit time.

Also, how both eyes are used, and what happens when one eye is not visible, i.e., occluded, is not addressed. Also, what happens when both eyes are not visible is not considered, for example, when drivers head falls forward where the camera cannot see either of the eyes.

Furthermore, according to Nakagoshi, the accuracy in the drowsiness level of D3 to D4 is 67.88%, even when the duration is set short (10 seconds). When the duration is set long (30 seconds, the accuracy is 74.8%. This means that for every hour, the chance of a false drowsiness detection is at least 25 percent, and such poor performance of drowsiness detection is the reason why it cannot be used directly by a direct warning instead of changing the warning level to be used by frontal collision warning in absence a frontal collision warning qualifier, because there would be several false sound or seat vibration warnings per day to a driver which is not acceptable and driver will have to somehow disable any such device since such a system calculates the level of eyes closed at least 10 times a second. This means every hour there will 36,000 at minimum determinations of level of the level of eyes closed. At the accuracy rate of about 75 percent, this means there will be 0.25*36,000, or 9,000 warning issues every hour.

SUMMARY OF THE INVENTION

The present invention provides a compact personal video telematics device for applications in mobile and vehicle safety for accident avoidance purposes, where driver is monitored and upon detection of a drowsiness or distraction condition as a function of speed and road, a driver warning is immediately issued to avoid an accident. In an embodiment for vehicle video recording, two or more camera sensors are used, where video preprocessing includes Image Signal Processing (ISP) for each camera sensor, video pre-processing comprised of motion adaptive spatial and temporal filtering, video motion stabilization, and Adaptive Constant Bit-Rate algorithm. Facial processing is used to monitor and detect driver distractions and drowsiness. The face gaze direction of driver is analyzed as a function of speed and cornering to monitor driver distraction and level of eyes closed and head angle is analyzed to monitor drowsiness, and when distraction or drowsiness is detected for a given speed, warning is provided to the driver immediately for accident avoidance. Such occurrences of warning are also stored along with audio-video for optional driver analytics. Blue light is used at night to perk up the driver when drowsiness condition is detected. The present invention provides a robust system for observing driver behavior that plays a key role as part of advanced driver assistance systems.

BRIEF DESCRIPTION OF DRAWINGS

The accompanying drawings, which are incorporated and form a part of this specification, illustrate prior art and embodiments of the invention, and together with the description, serve to explain the principles of the invention.

Prior art

FIG. 26 provides an example of Look-Up Table (LUT) contents for speed dependent distraction detection.

FIG. 29 provides another example of Look-Up Table (LUT) contents for speed dependent distraction detection.

FIG. 38 shows example of drowsiness-time-allowed calculation.

FIG. 41 shows example FIR filter used for filtering face gaze direction values.

FIG. 44 shows confusion matrix of performance.

DETAILED DESCRIPTION

Figure 5:
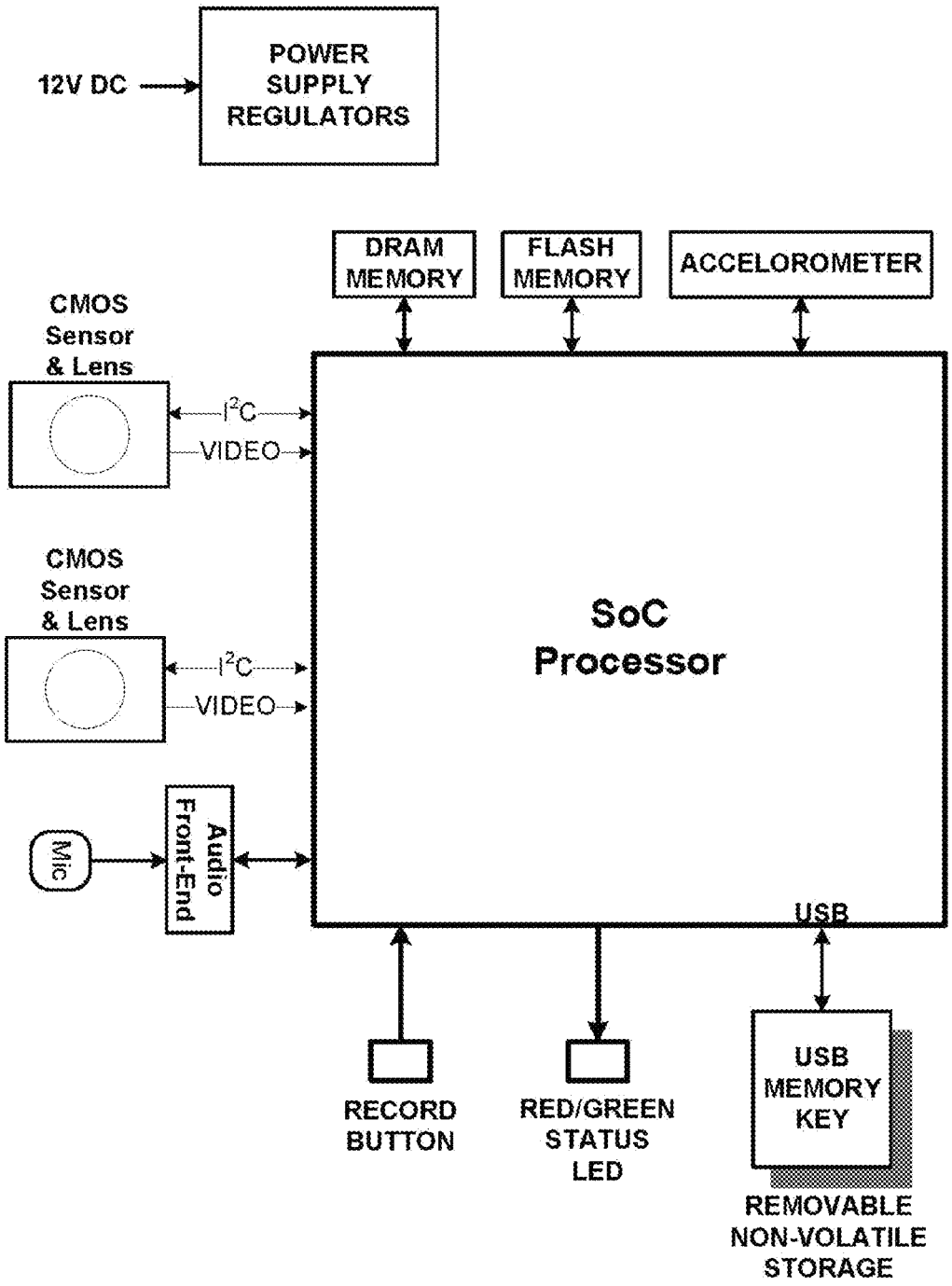
FIG. 5 shows block diagram of an embodiment of present invention with two camera modules and an accelerometer.

The present invention provides a compact cell-phone sized vehicle telematics device with one or more cameras embedded in the same package for evidentiary audio-video recording, facial processing, driver analytics, and internet connectivity that is embedded in the vehicle or its mirror, or as an aftermarket device attached to front-windshield. FIG. 5 shows two-camera embodiment of present invention mounted near the front mirror of a vehicle. The compact telematics module can be mounted on the windshield or partially behind the windshield mirror, with one camera facing forward and one camera facing backward, or be embedded in a vehicle, for example as part of the center rear-view mirror.

Figure 1:
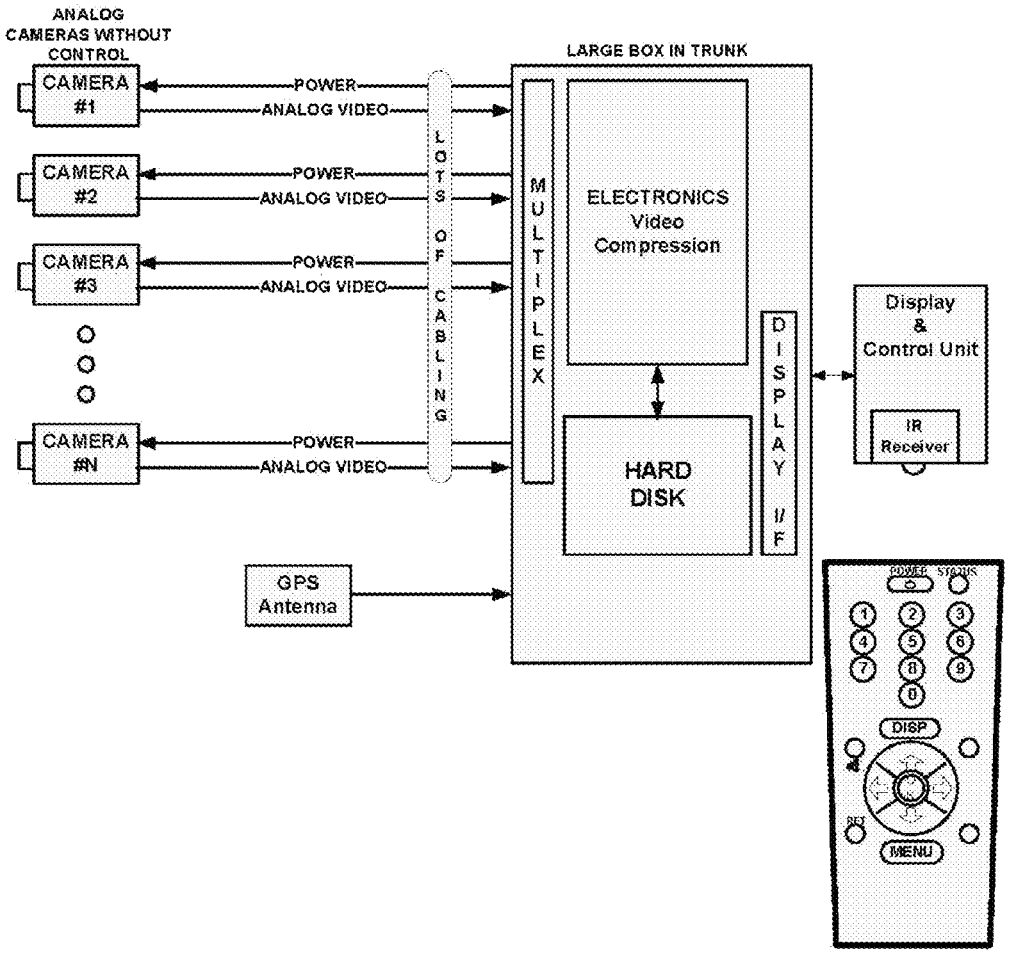
FIG. 1 shows a typical vehicle security system with multiple cameras.
Figure 2:
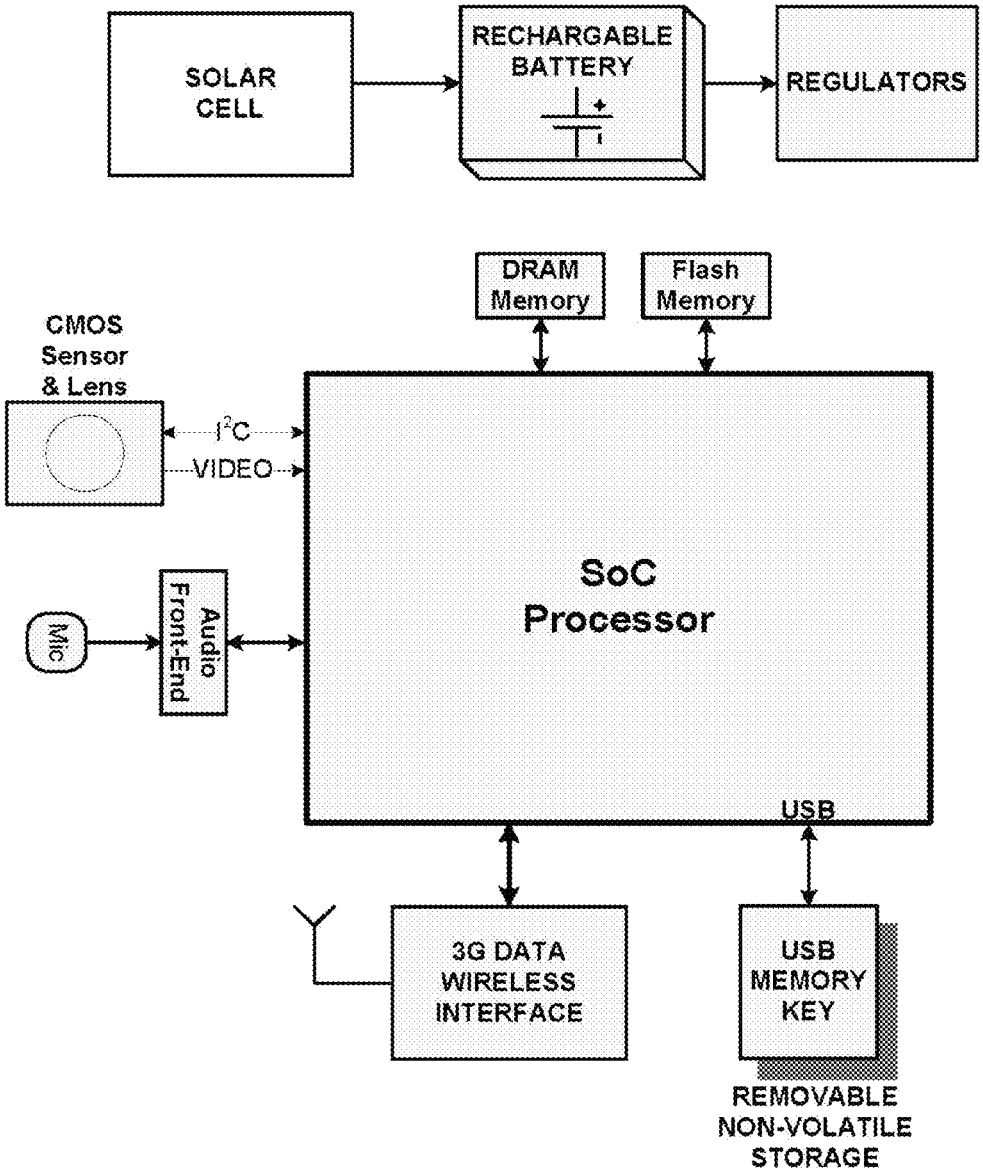
FIG. 2 shows block diagram of an embodiment of present invention using solar cell and only one camera.

FIG. 2 shows the block diagram of an embodiment of the present invention. The System-on-Chip (SoC) includes multiple processing units for all audio and video processing, audio and video compression, and file and buffer management. A removable USB memory key interface is provided for storage of plurality of compressed audio-video channels.

Another embodiment uses two CMOS image sensors, shown in FIG. 5, uses a SoC for simultaneous capture of two video channels at 30 frames-per-second at standard definition (640×480) resolution. Audio microphone and front-end is also in the same compact module, and SoC performs audio compression and multiplexes the audio and video data together.

Figure 3:
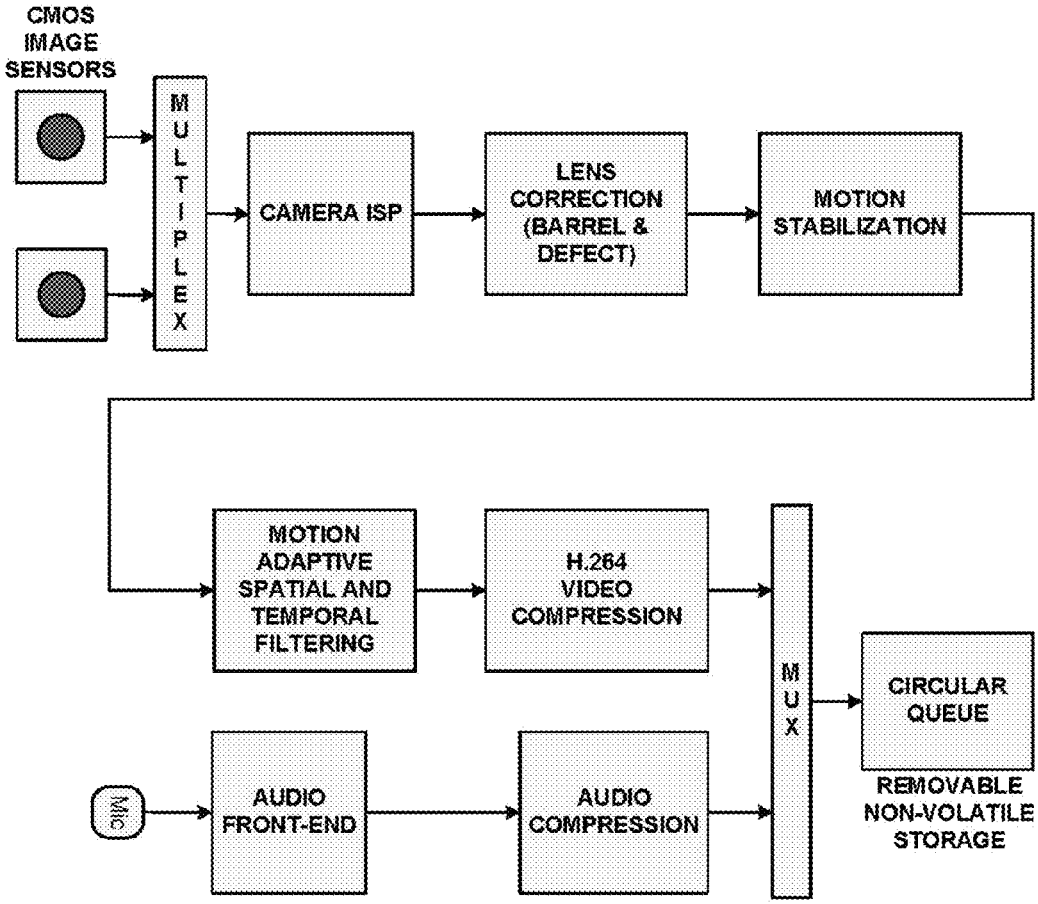
FIG. 3 shows block diagram of an embodiment using video pre-processing with two cameras.

FIG. 3 shows the data flow of an embodiment of the present invention for video pre-processing stages. Each CMOS image sensor output is processed by camera Image Signal Processing (ISP) for auto exposure, auto white balance, camera sensor Bayer conversion, lens defect compensation, etc. Motion stabilization removes the motion effects due to camera shake. H.264 is used as the video compression as part of SoC, where H.264 is an advanced video compression standard that provides high-video quality and at the same time reduction of compressed video by a factor of 3-4× over previous MPEG-2 and other standards, but it requires more processing power and resources to implement. The compressed audio and multiple channels of video are multiplexed together by a multiplexer as part of SoC, and stored in a circular queue. The circular queue is located on a removable non-volatile semiconductor storage such a micro SD card, or USB memory key. This allows storage of data on a USB memory key at high quality without requiring the use of hard disk storage. Hard disk storage used by existing systems increases cost and physical size. SoC also performs audio compression, and multiplexes the compressed audio and video together. The multiplex compressed audio-video is stored on part of USB memory key in a continuous loop as shown in FIG. 5. At a typical 500 Kbits/sec at the output of multiplexer for standard definition video at 30 frames-per-second, we have 5.5 Gigabytes of storage required per day of storage. Using a 16 Gigabyte USB memory key could store about three days of storage, and 64 Gigabyte USB memory key can store about 11 days of storage.

Figure 4:
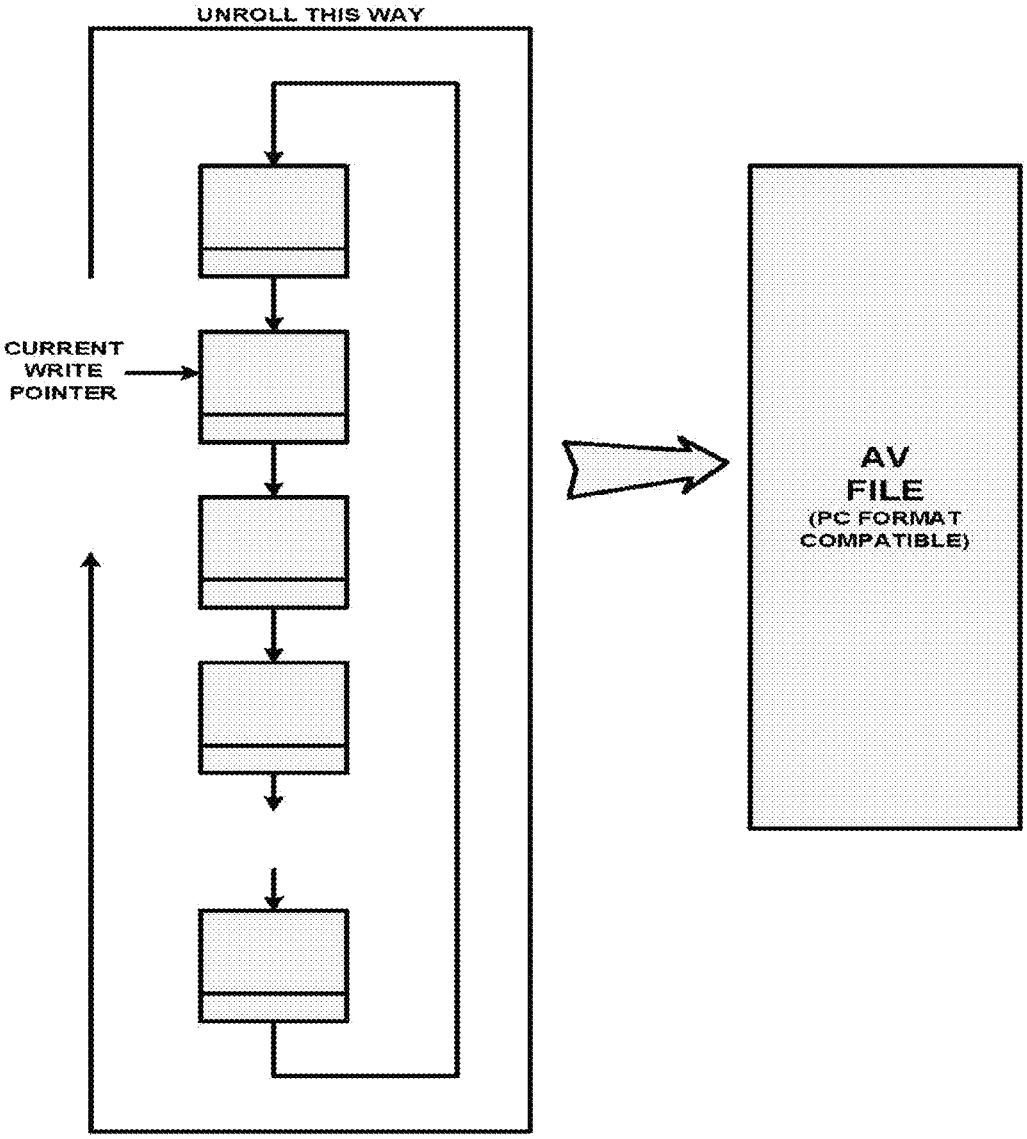
FIG. 4 shows the circular queue storage for continuous record loop of one or more channels of audio-video and metadata.

Since the compressed audio-video data is stored in a circular queue with a linked list pointed by a write pointer as shown in FIG. 4, the circular queue has to be unrolled and converted into a file format recognizable as one of commonly used PC audio-video file formats. This could be done, when recording is stopped by pressing the record key by doing post processing by the SoC prior to removal of USB key. Such a conversion could be done quickly and during this time status indicator LED could flash indicating wait is necessary before USB memory key removal. Alternatively, this step could be performed on a PC, but this would require installing a program for this function on the PC first. Alternatively, no unrolling is necessary and audio-video data for one or more channels are sent in proper time sequence as it is being sent over internet using wireless connectivity.

FIG. 2 embodiment of present invention uses a solar cell embedded on a surface of the compact audio-video recorder, a built-in rechargeable battery, and a 3G or 4G data wireless connection as the transfer interface. This embodiment requires no cabling. This embodiment is compact and provides mobile security, and could also be worn by security and police officers for recording events just as in a police cruiser.

Figure 6:
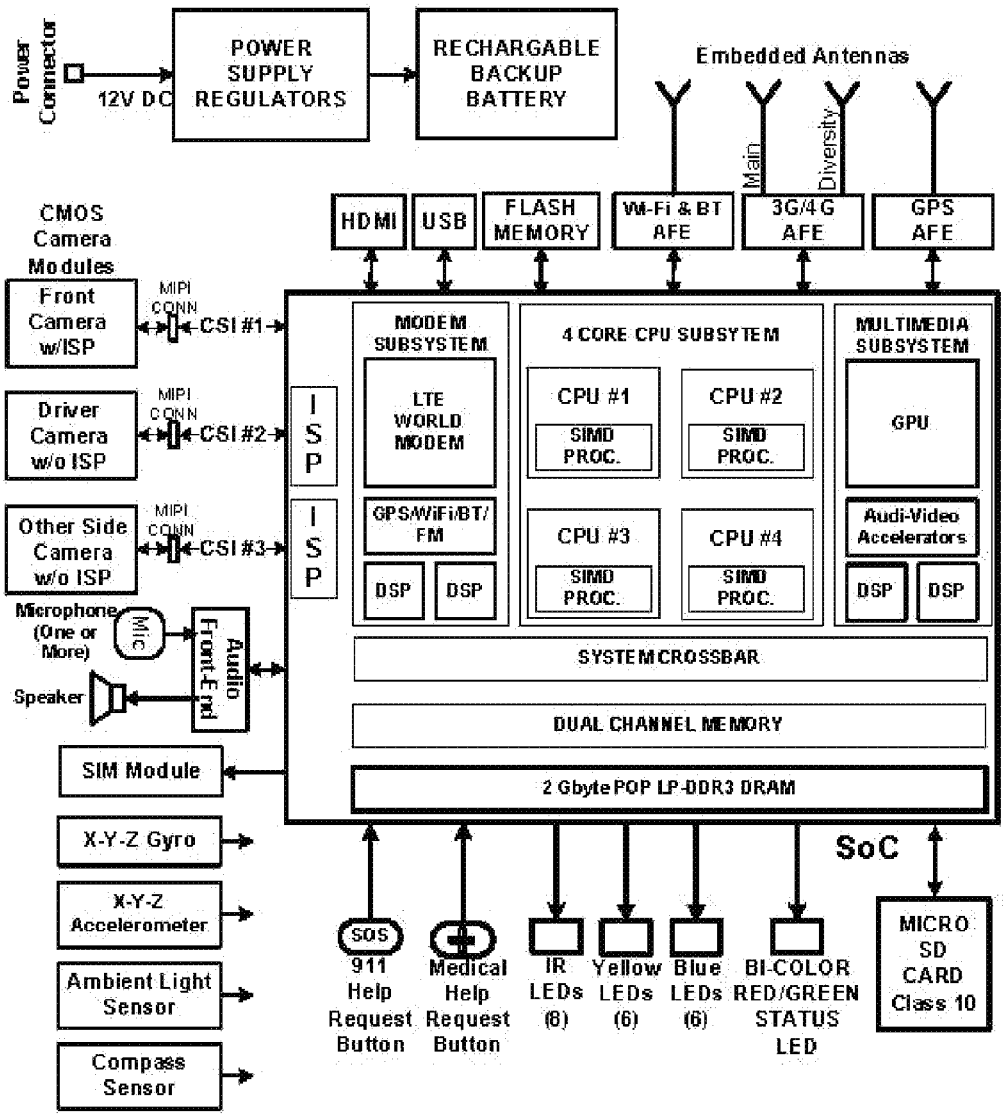
FIG. 6 shows block diagram of a preferred embodiment of the present invention with three camera modules and an X-Y-Z accelerometer, X-Y-Z gyro sensor, compass sensor, ambient light sensor and micro-SD card, 3G/4G wireless modem, GPS, Wi-Fi and Bluetooth interfaces built-in, etc.

FIG. 6 embodiment of present invention includes an accelerometer and GPS, using which SoC calculates the current speed and acceleration data and continuously stores it together with audio-video data for viewing at a later time. This embodiment has also various sensors including ambient light sensor, x-y-z accelerometer, x-y-z gyro, compass sensor, Wi-Fi, Bluetooth and 3G or 4G wireless modem for internet connectivity. This embodiment uses Mobile Industry Processor Interface (MIPI) CSI-2 or CSI-3 Camera Serial Interface standards for interfacing to image sensors. CSI-2 also supports fiber-optic connection which provides a reliable way to locate an image sensor away from the SoC.

Figure 7:
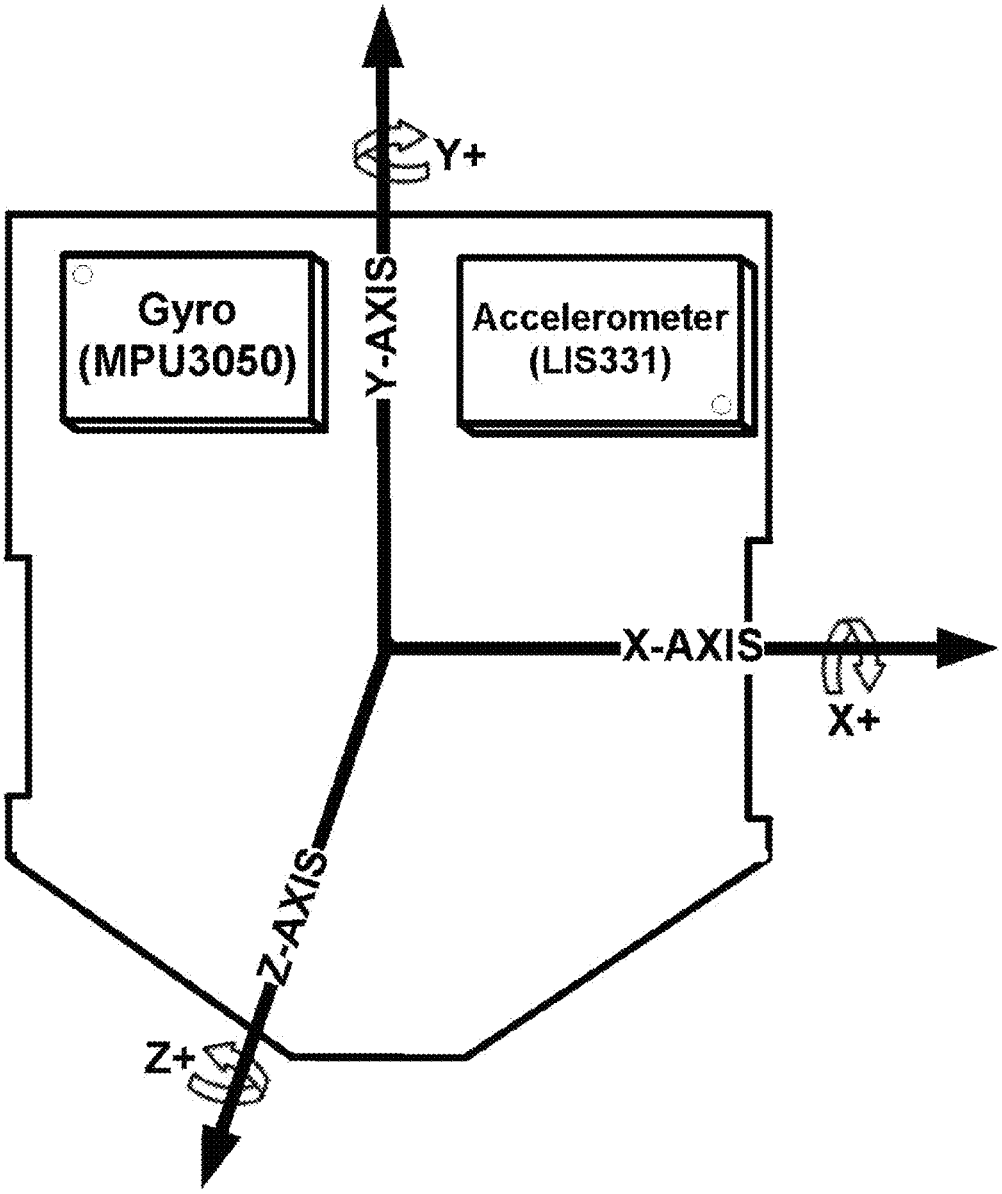
FIG. 7 shows alignment of multiple sensors for proper operation.

FIG. 7 shows the alignment of x-y-z axis of accelerometer and gyro sensors. The gyro sensor records the rotational forces, for example during cornering of a vehicle. The accelerometer also provides free-fall indication for accidents and tampering of unit.

Figure 8:
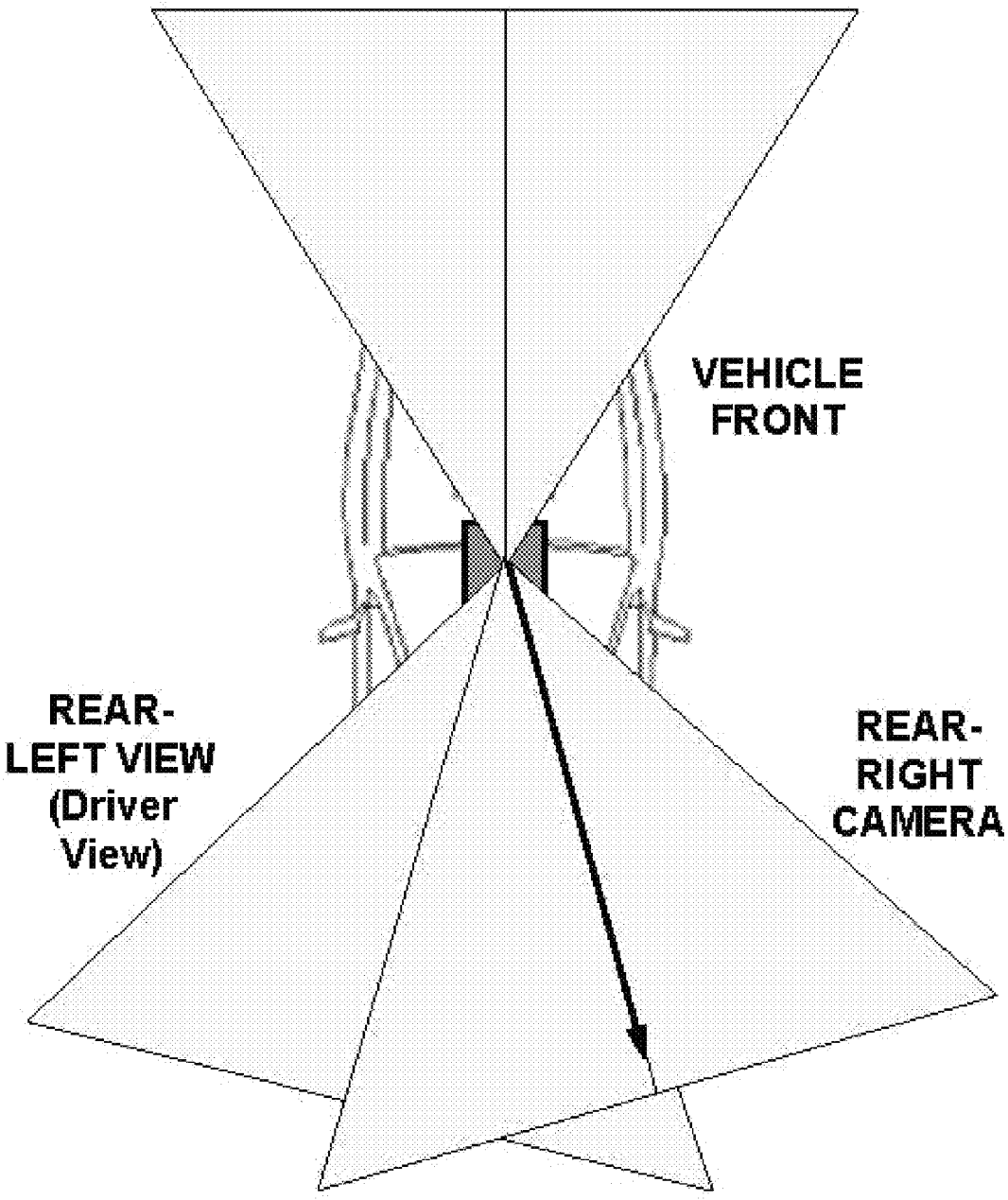
FIG. 8 shows the three camera fields-of-view from the windshield, where one camera module is forward looking, the second camera module looks at the driver's face and also back and left side, and the third camera module looks at the right and back side of the vehicle.

FIG. 8 show three camera module embodiment of the present invention, where one of the cameras cover the front view, and second camera module processes the face of the driver as well as the left and rear sides of the vehicle, and third camera covers the right side and back area of the vehicle.

Figure 16:
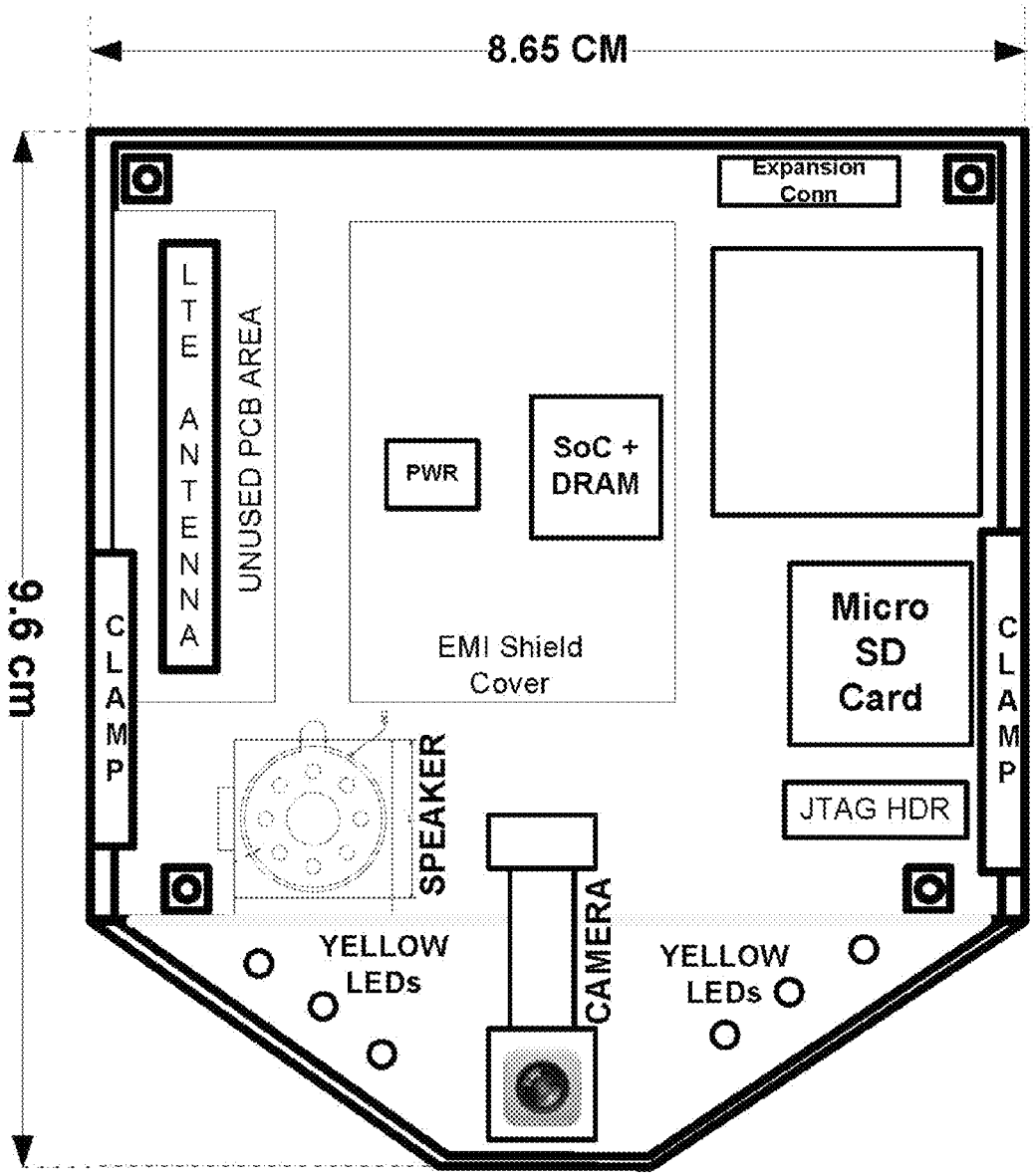
FIG. 16 shows an embodiment for enclosure and physical size of preferred embodiment for the front view (facing the road).
Figure 17:
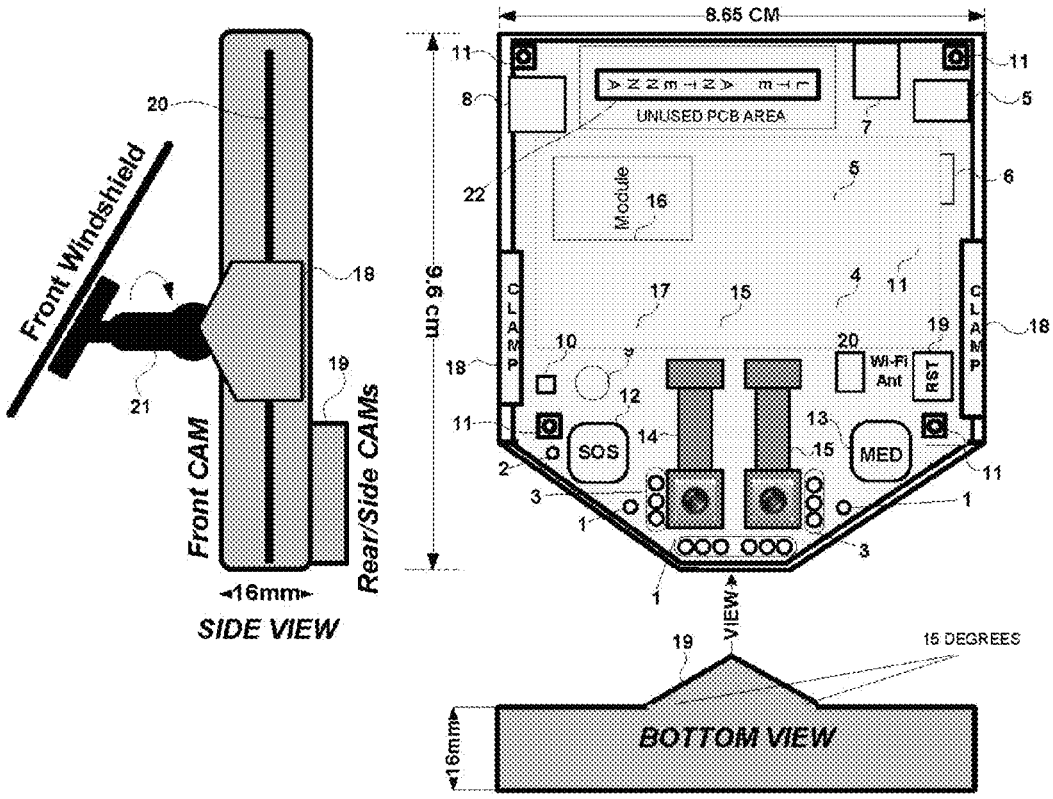
FIG. 17 shows the view of device from the inside cabin of vehicle and also the side view including windshield mounting.
Figure 18:
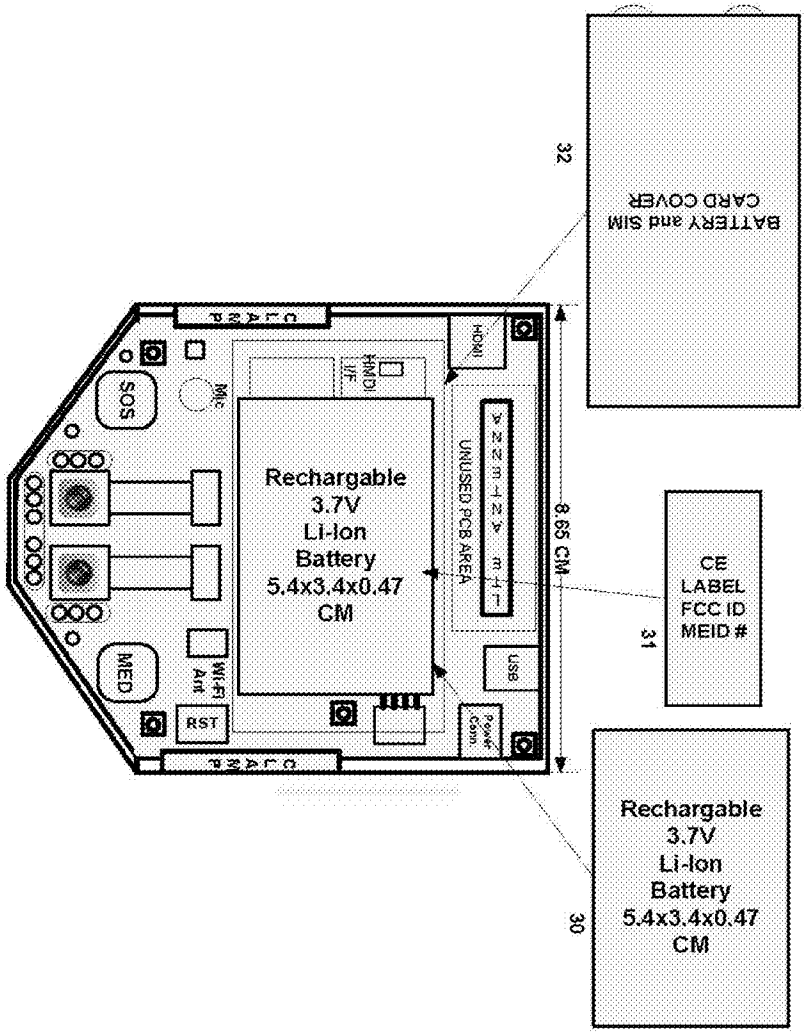
FIG. 18 shows the placement of battery inside stacked over electronic modules over the CE label tag.

FIG. 16-18 show an embodiment for enclosure and physical size of preferred embodiment, and also showing the windshield mount suction cup. FIG. 16 shows the front view facing the road ahead of the printed circuit board (PCB) and placement of key components. Yellow LEDs flash in case of an emergency to indicate emergency condition that can be observed by other vehicles. FIG. 17 shows the front view and suction cup mount of device. The blue light LEDs are used for reducing the sleepiness of driver using 460 nm blue light illuminating the driver's face with LEDs shown by reference 3. The infrared (IR) LEDs shown by reference 1 illuminate the driver's face with IR light at night for facial processing to detect distraction and drowsiness conditions. Whether right or left side is illuminated is determined by vehicle's physical location (right hand or left hand driving). Other references shown in the figure are side clamp areas 18 for mounting to wind shield, ambient light sensor 2, camera sensor flex cable connections 14 and 15, medical (MED) help request button 13, SOS police help request button 12, mounting holes 11, SIM card for wireless access 17, other electronics module 16, SoC module 15 with two AFE chips 4 and 5, battery connector 5, internal reset button 19, embedded Bluetooth and Wi-Fi antenna 20, power connector 5, USB connector for software load 7, embedded 3G/4G LTE antenna 22, windshield mount 21, HDMI connector 8, side view of main PCB 20, and microphone 9.

FIG. 18 shows battery compartment over the electronic modules, where CE compliance tag is placed, and battery compartment, which also includes the SIM card. The device is similar to a cell phone with regard to SIM card and replaceable battery. The primary difference is the presence of three HDR cameras that concurrently record, and near Infrared (IR) filter bandpass in the rear-facing camera modules for nighttime illumination by IR light.

Figure 11:
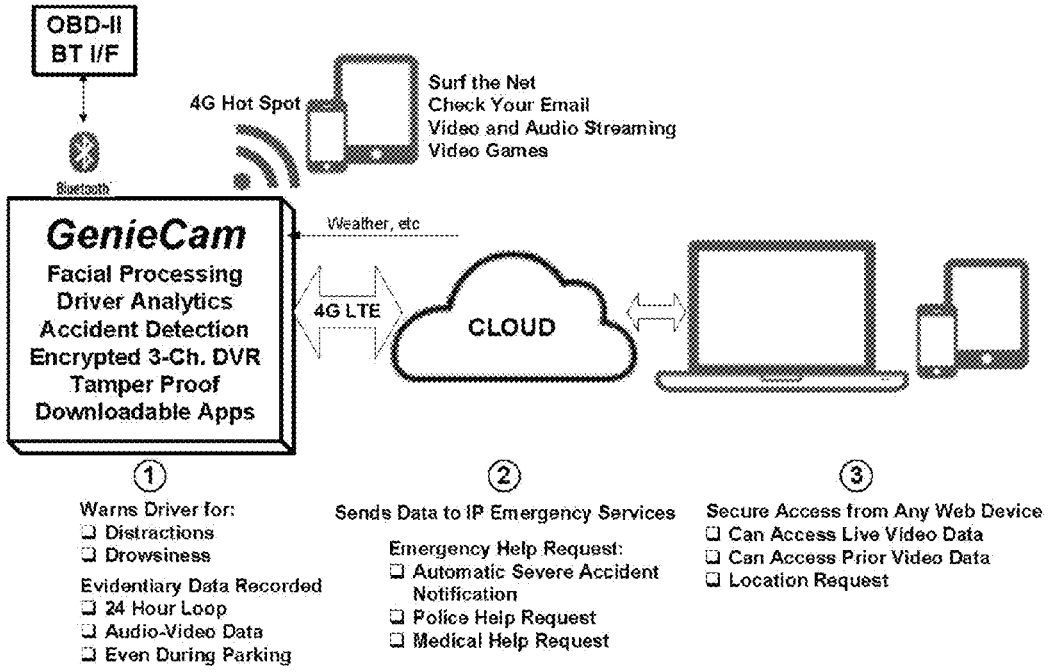
FIG. 11 shows block diagram of connection to the cloud and summary of technology and functionality.

FIG. 11 depicts interfacing to On-Board Diagnostic (OBD-2). All cars and light trucks built and sold in the United States after Jan. 1, 1996 were required to be OBD II equipped. In general, this means all 1996 model year cars and light trucks are compliant, even if built in late 1995. All gasoline vehicles manufactured in Europe were required to be OBD II compliant after Jan. 1, 2001. Diesel vehicles were not required to be OBD II compliant until Jan. 1, 2004. All vehicles manufactured in Australia and New Zealand was required to be OBD II compliant after Jan. 1, 2006. Some vehicles manufactured before this date are OBD II compliant, but this varies greatly between manufacturers and models. Most vehicle manufacturers have switched over to CAN bus protocols since 2006. The OBD-2 is used to communicate to the Engine Control Unit (ECU) and other functions of a vehicle via Bluetooth (BT) wireless interface. A BT adapter is connected to the ODB-2 connector, and communicates with the present system for information such as speed, engine idling, and for controlling and monitoring other vehicle functions and status. For example, engine idling times and over speeding occurrences are saved to monitor and report for fuel economy reasons to the fleet management. Using OBD-2 the present system can also limit the top speed of a vehicle, lower the cabin temperature, etc, for example, when driver drowsiness condition is detected.

The present system includes a 3G/4G LTE wireless modem, which is used to report driver analytics, and also to request emergency help. Normally, the present device works without a continuous connection to internet, and stores multi-channel video and optional audio and meta data including driver analytics onto the embedded micro SD card. In case of an emergency the present device connects to internet and sends emergency help request from emergency services via Internet Protocol (IP) based emergency services such as SMS 911 and N-G-911, and eCall in Europe, and conveying the location, severity level of accident, vehicle information, and link to short video clip showing time of accident that is uploaded to a cloud destination. Since the 3G/4G LTE modem is not normally used, it is provided as part of a Wi-Fi Hot Spot of vehicle infotainment for vehicle passengers whether it is a bus or a car.

Adaptive Constant Bit Rate (ACBR)

In video coding, a group of pictures, or GOP structure, specifies the order in which intra and inter-frames are arranged. The GOP is a group of successive pictures within a coded video stream. Each coded video stream consists of successive GOPs. From the pictures contained in it, the visible frames are generated. A GOP is typically 3-8 seconds long. Transmit channel characteristics could vary quite a bit, and there are several adaptive streaming methods, some based on a thin client. However, in this case, we assume the client software (destination of video is sent) is unchanged. The present method looks at the transmit buffer fullness for each GOP, and if the buffer fullness is going up then quantization is increased for the next GOP whereby lower bit rate is required. We can have 10 different levels of quantization, and as the transmit buffer fullness increases the quantization is increased by a notch to the next level, or vice versa if transmit buffer fullness is going down, and then quantization level is decreased by a notch to the next level. This way each GOP has a constant bit and bit rates are adjusted between each GOP for the next GOP, hence the term of Adaptive Constant Bit Rate (ACBR) we used herein.

Motion Adaptive Spatial Filter (MASF)

Figure 12:
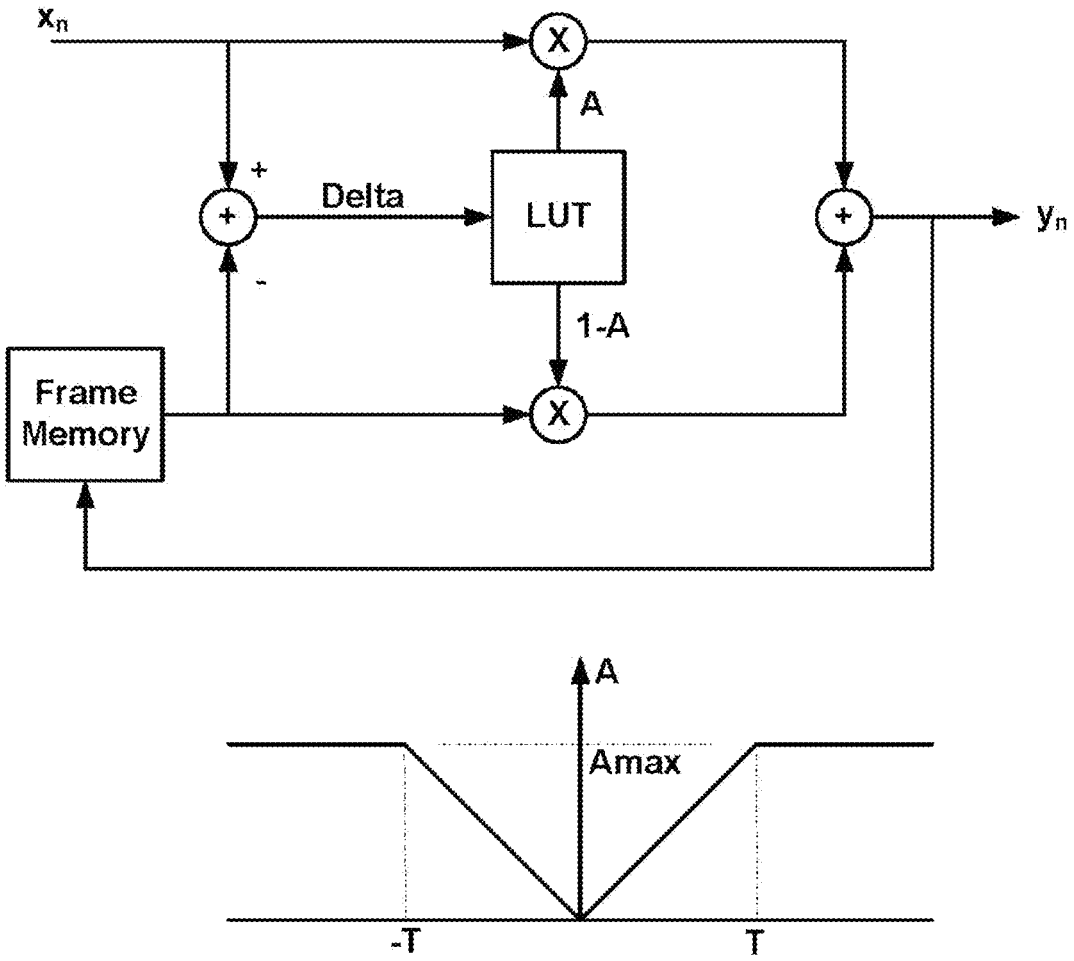
FIG. 12 shows a first embodiment of present invention using a Motion Adaptive Temporal Filter defined here.
Figure 13:
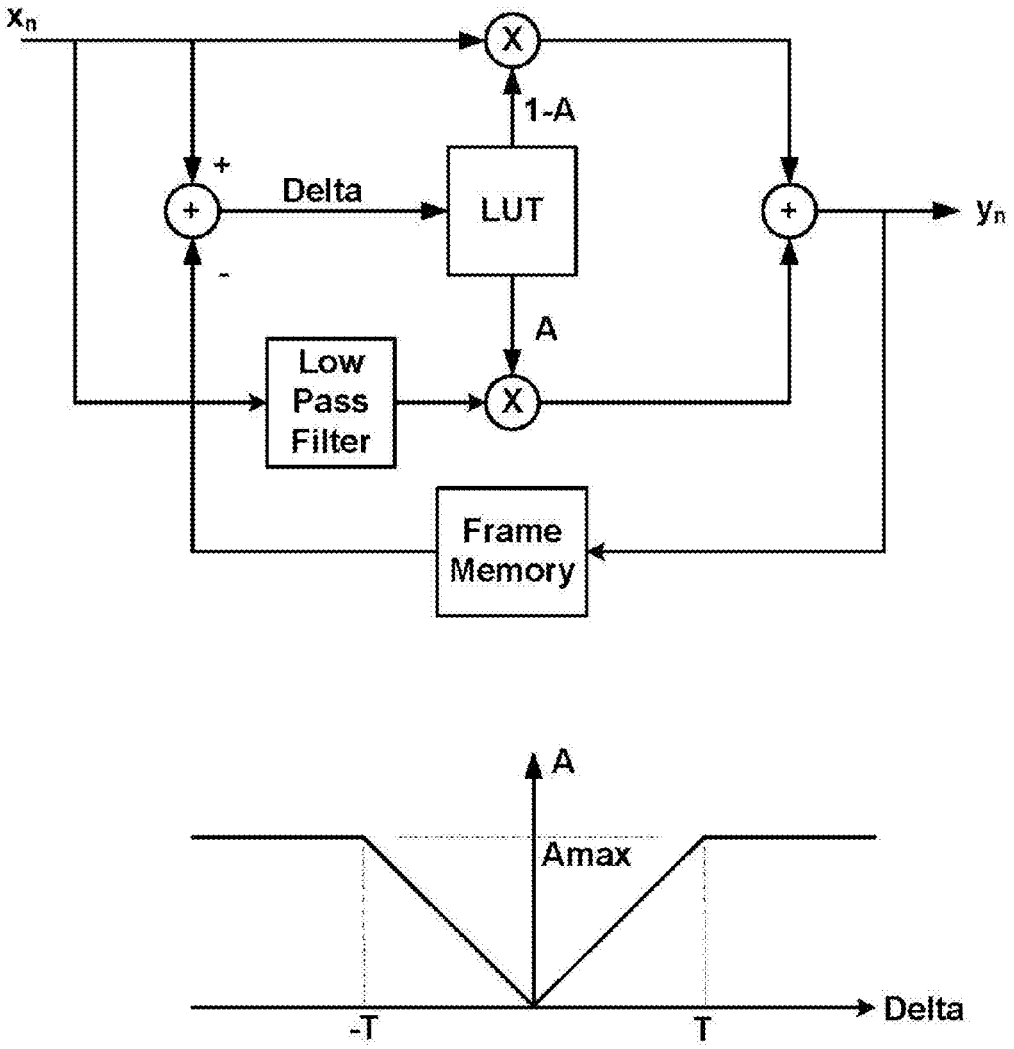
FIG. 13 shows embodiment of present invention using a Motion Adaptive Spatial Filter defined here.

Motion Adaptive Spatial Filter (MASF), as defined here, is used to pre-process the video before other pre-processing and video compression. MASF functional block diagram is shown in FIG. 13. The pre-calculated and stored Look-Up Table (LUT) contains a pair of values for each input value, designated as A and (1−A). MASF applies a low-pass two-dimensional filter when there is a lot of motion in the video. This provides smoother video and improved compression ratios for the video compression. First, the amount of motion is measured by subtracting the pixel value from the current pixel value, where both pixels are from the same pixel position in consecutive video frames. We assume the video is not interlaced here, as CMOS camera module provides progressive video. The difference between the two pixels provides an indication of amount of motion. If there is no motion, then A=0, which mean the output $y_n$ equals input $x_n$ as unchanged. If, on the other hand the difference delta is very large, than A equals to $A_{max}$, which means $y_n$ is the low-pass filtered pixel value. For anything in between, the LUT provides a smooth transition from no filtering to full filtering based on its contents as also shown in FIG. 12. The low pass filter is a two dimensional FIR (Finite Impulse Response) filter, with a kernel size of 3×3 or 5×5. The same MASF operation is applied to all color components of luma and chroma separately, as described above.

Hence, the equations for MASF are defined as follows for each color space component:

$$\text{Delta}=x_n-x_{n(t-1)} \qquad \text{Step 1:}$$

$$\text{Lookup value pair: } \{1-A,A\}=\text{LUT(Delta)} \qquad \text{Step 2:}$$

$$Y_n=(1-A)*x_n+A*\text{Low-Pass-Filter}(X_n)*A \qquad \text{Step 3:}$$

$x_{n(t-1)}$ represents the pixel value corresponding to the same pixel location X-Y in the video frame for the t−1, i.e., previous video frame. Low-Pass-Filter is a 3×3 or 5×5 two dimensional FIR filter. All kernel values can be the same for a simple moving average filter where each kernel value is 1/9 or 1/25 for 3×3 and 5×5 filter kernels, respectively.

Motion Adaptive Temporal Filter (MATF)

The following temporal filter is coupled to the output of MASF filter and functions to reduce the noise content of the input images and to smooth out moving parts of the images. This will remove majority of the temporal noise without having to use motion search at a fractional of processing power. This MATF filter will remove most of the visible temporal noise artifacts and at the same time provide better compression or better video quality at the same bit rate. It is essentially a non-linear, recursive filtering process which works very well that is modified to work in conjunction with a LUT adaptively, as shown in FIG. 12.

The pixels in the input frame and the previous delayed frame are weighted by A and (1−A), respectively, and combined to pixels in the output frame. The weighing parameter, A, can vary from 0 to 1 and is determined as function of frame-to-frame differenced. The weighting parameters are pre-stored in a Look-Up-Table (LUT) for both A and (1−A) as a function of delta, which represents the difference on a pixel-by-pixel basis. As a typical weighing function we could use the function plot shown in FIG. 12 showing the contents of LUT. Notice that there are threshold values, T and −T, for frame-to-frame differences, beyond which the mixing parameter A is constant.

The "notch" between −T and T represents the digital noise reduction part of the process in which the value A is reduced, i.e., the contribution of the input frame is reduced relative to the delayed frame. As a typical value for T, 16 could be used. As a typical value ranges for Amax, we could use {0.8, 0.9, and 1.0}.

The above represents:

$$Yn=LUT(\text{Delta})*Xn+(1-LUT(\text{Delta}))*Yn-1$$

This requires:
One-LUT operation (basically one indexed memory access);
Three subtraction/add operations (one for Delta);
Two-Multiply operations.

This could be further reduced by rewriting the above equation as:

$$Yn=LUT(\text{Delta})*(Xn-Yn-1)+Yn-1$$

This reduces the required operations to:
One-LUT operation (basically one indexed memory access);
Three subtraction/addition operations (one for Delta); and
One-multiply operation.

Figure 14:
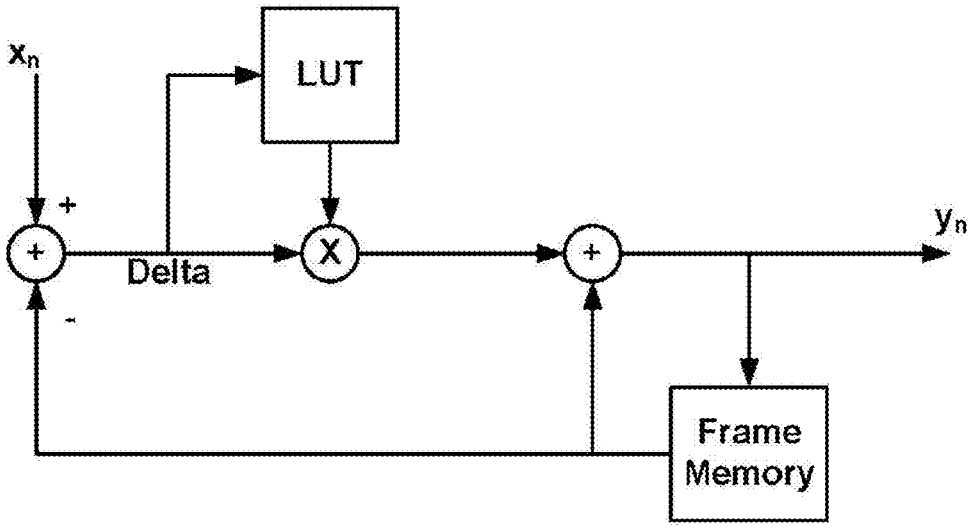
FIG. 14 shows a second embodiment of present invention using a reduced Motion Adaptive Temporal Filter defined here.

The flow diagram of this is shown in FIG. 14. For a 1920×1080P video at 30 fps, this translates to 2M*30*5 Operations, or 300 Million Operations (MOPS), a small percentage well within the operation capacity of most DSPs on a SoC today. As such it has significantly less complexity and MOPS requirement, but at a great video quality benefit.

Accidence Avoidance for Driver Distractions

In the embodiment shown on FIG. 6 and FIG. 8, the present invention uses one of the camera modules directed to view the driver's face as well as the left side and back of the car. Each camera module is high-definition with Auto Focus and also High Dynamic Range (HDR) to cover wide dynamic range that is present in a vehicle. HDR video capture function enables two different exposure conditions to be configured within a single screen when capturing video, and seamlessly performs appropriate image processing to generate optimal images with a wide dynamic range and brilliant colors, even when pictures are taken against bright light.

Figure 9:
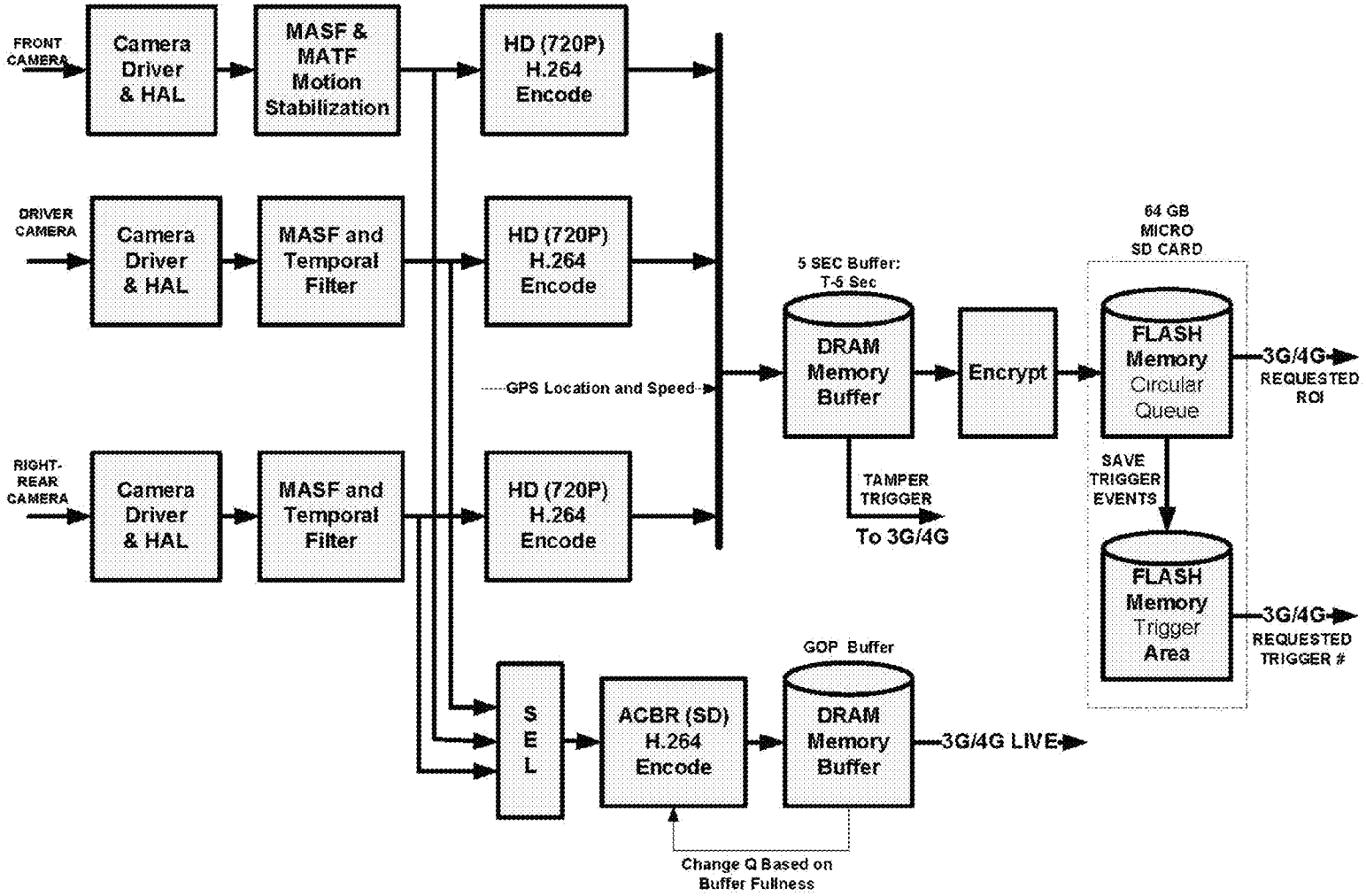
FIG. 9 shows the preferred embodiment of preprocessing and storage stages of video before the facial processing for three-channel video embodiment.
Figure 10:
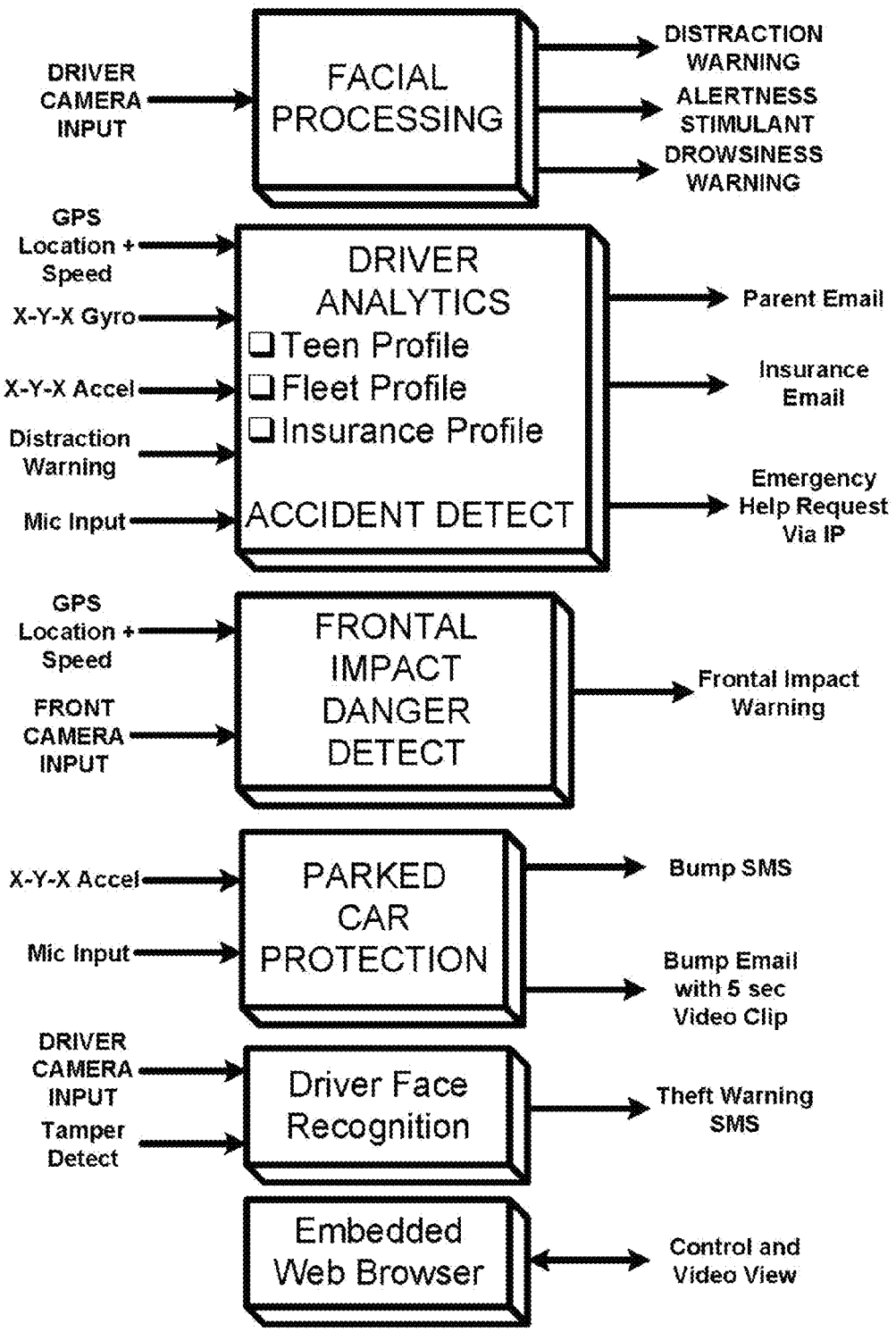
FIG. 10 shows block diagram of data processing for accident avoidance, driver analytics, and accident detection and other vehicle safety and accident avoidance features.

First, video from each camera input is preprocessed by Motion Adaptive Spatial and Temporal filters that are described above, as shown in FIG. 9. The camera facing the driver face is not subjected motion stabilization as the other two cameras. Next, facial processing is performed on the pre-processed video from the driver camera. Part of facial processing that is performed by the software running on SoC in FIG. 6 includes determining driver's gaze direction. The driver's gaze direction is defined to be the face direction and not eye pupil's direction as used herein.

Figure 22:
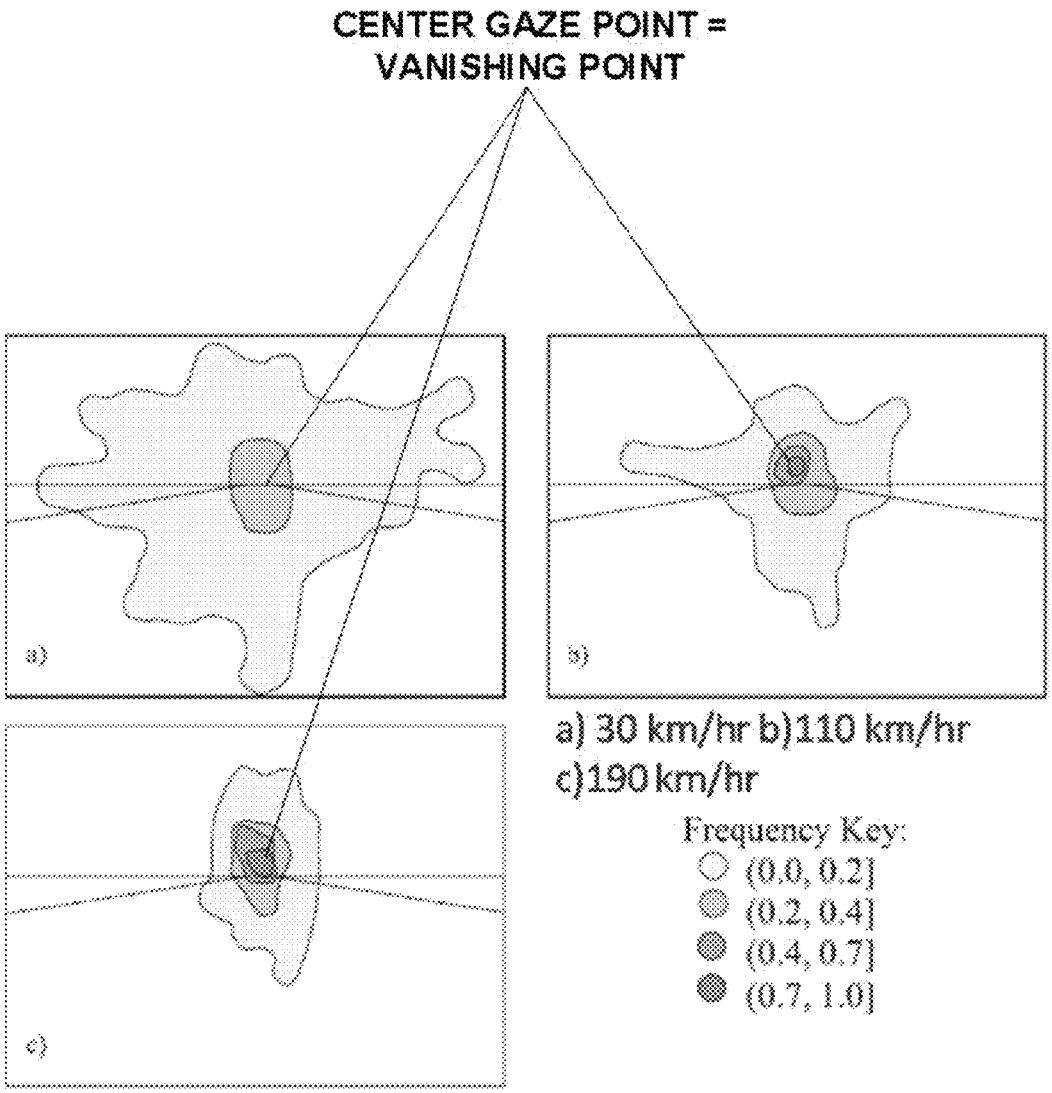
FIG. 22 shows the frequency of where driver is looking as a function of speed.

Research studies have revealed that driver's eye fixation patterns are more directed toward the far field (54%) on a straight road and 35% on a curved road. The "Far Field" is defined as the area around the vanishing point where the end of the road meets the horizon. In the most recent findings, Rogers et al. (2005) provided the first analysis of the relation between gaze, speed and expertise in straight road driving. They demonstrated that the gaze distribution becomes more constrained with an increase in driving speed while in all speed conditions, the peak of the distribution falls very close to the vanishing point, as shown in FIG. 22. The vanishing point constitutes the center point of driver's gaze direction (vanishing point gaze direction).

Based on psychological evidence, vanishing point is a salient feature during the most of the driving behavior tasks. The drivers prefer to look at the far field and close to the end of the road, where the road edges converge to anticipate the upcoming road trajectory and the car steering.

The studies for the present application found that if the gaze direction is based on both the face and the eyes, the gaze determination is not stable and is very jittery. In contrast, if the gaze direction is based on face direction, then the gaze direction is very stable. It is also important to note the human visual system uses eye pupils' movement for short duration to change the direction of viewing and face direction for tasks that require longer time of view. For example, a driver moves his eye pupils to glance at radio controls momentarily, but uses face movement to look at the left mirror. Similarly, a driver typically uses eye pupil movements for the windshield rear-view mirror, but uses head movements for left and right mirrors. Furthermore, driver's eyes may not be visible due to sun glasses, or one of the eyes can be occluded.

Figure 20:
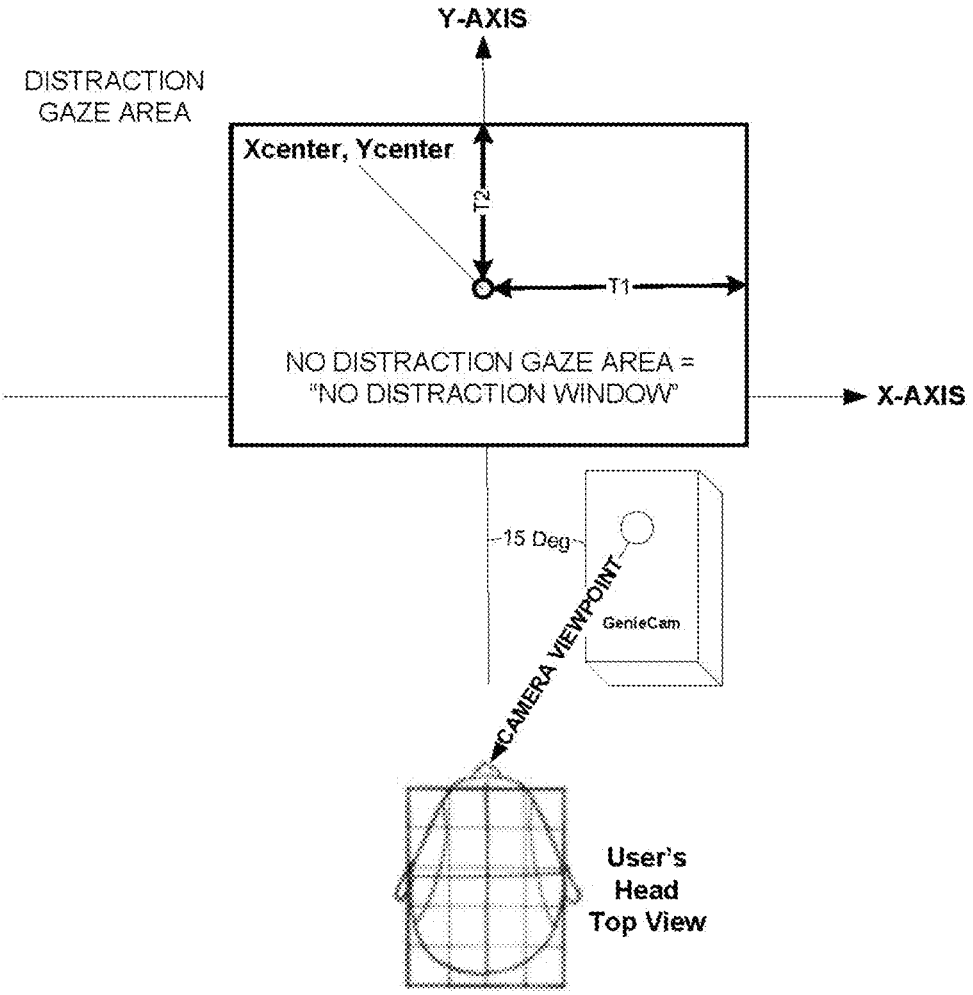
FIG. 20 shows the area of no-distraction gaze area where the driver camera is angled at 15 degree view angle.
Figure 21:
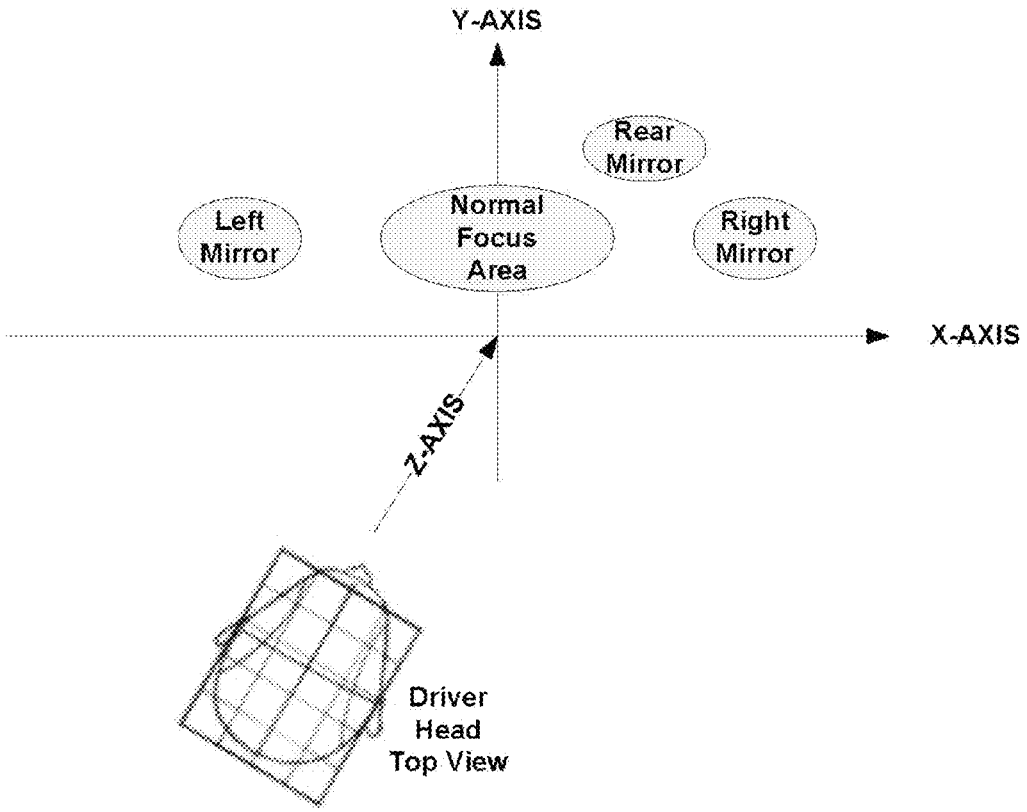
FIG. 21 shows the areas of gaze direction of areas as a function of speed and frequency of gaze occurrence.

FIG. 21 shows the areas where driver looks at, and as mentioned above rear-view mirror on windshield uses eye pupil movement and does not typically change face gaze direction. Face gaze direction, also referred to as head pose, is a strong indicator of a driver's field-of-view and current focus of attention. A driver's face gaze is typically directed at the center point, also referred to as the vanishing point or far field, and other times to left and right view mirrors. FIG. 20 shows the area of driver's focus that constitutes no-distraction area. This area has 2*T2 height and 2*T1 width, and has {Xcenter, Ycenter} as the center point of driver's gaze direction, also referred to as the vanishing point herein. It is important to note that the value pairs of {X, Y} and {Yaw, Pitch} are used interchangeably in the rest of the present invention. These value pairs define the facial gaze direction and are used to determine if the gaze direction is within the non-distraction window of the driver. The non-distraction window can be defined as spatial coordinates or as yaw and pitch angles.

A driver distraction condition is defined as a driver's gaze outside the no-distraction area longer than a time period defined as a function of parameters comprising speed and the maximum allowed distraction-travel distance. When such a distraction condition is detected, a driver alert is issued by a beep tone referred to as chime, verbal voice warning, or some other type of user-selected alert-tone in order to alert to driver to refocus on the road ahead urgently.

Another factor that affects the driver's center point is cornering. Typically, drivers gaze along a curve as they negotiate it, but they also look at other parts of the road, the dashboard, traffic signs and oncoming vehicles. A new study finds that when drivers fix their gaze on specific targets placed strategically along a curve; their steering is smoother and more stable than it is in normal conditions. This modifies the center point of driver's gaze direction for driving around curved roads. The present invention will use the gyro sensor, and will adjust the center point of no-distraction window in accordance with cornering forces measured by the gyro sensor.

Land and Lee (1994) provided a significant contribution in a driving task. They were among the first to record gaze behavior during curve driving on a road clearly delineated by edge-lines. They reported frequent gaze fixations toward the inner edge-line of the road, near a point they called the tangent point (TP) shown in FIG. 23. This point is the geometrical intersection between the inner edge of the road and the tangent to it, passing through the subject's position. This behavior was subsequently confirmed by several other studies with more precise gaze recording systems.

All of these studies suggest that the tangent point area contains useful information for vehicular control. Indeed, the TP features specific properties in the visual scene. First, in geometrical terms, the TP is a singular and salient point from the subject's point of view, where the inside edge-line optically changes direction. Secondly, the location of the TP in the dynamic visual scene constantly moves, because its angular position in the visual field depends on both the geometry of the road and the cars trajectory. Thus, this point is a source of information at the interface between the observer and the environment: an 'external anchor point', depending on the subject's self-motion with respect to the road geometry. Lee (1978) coined this as 'ex-proprioceptive' information, meaning that it comes from the external world and provides the subject with cues about his/her own movement. These characteristics (saliency and ex-proprioceptive status) indicate that the TP is a good candidate for the control of self-motion. Furthermore, the angle between the tangent point and the cars instantaneous heading is proportional to the steering angle: this can be used for curve negotiation. Moreover, steering control can also integrate other information, such as a point in a region located near the edge-line.

Figure 23:
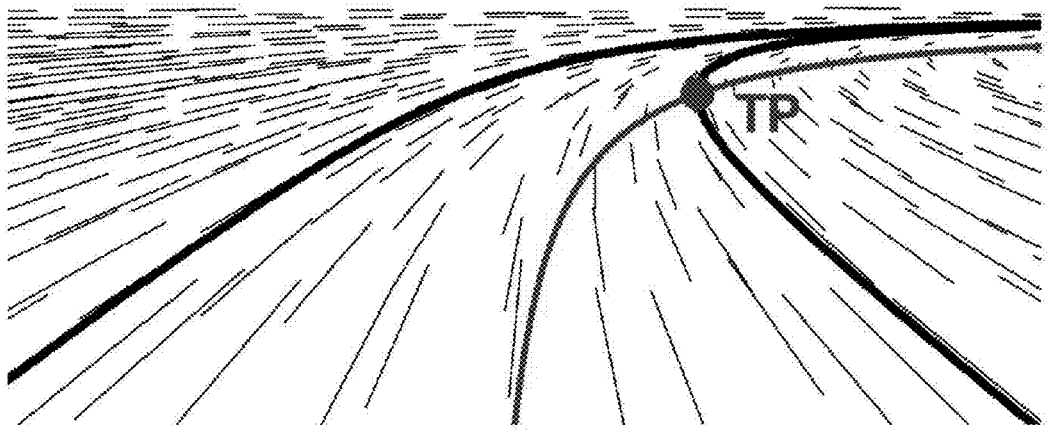
FIG. 23 shows the focus on Tangent Point (TP) during a cornering.

The tangent point method for negotiating bends relies on the simple geometrical fact that the bend radius (and hence the required steering angle) relates in a simple fashion to the visible angle between the momentary heading direction of the car and the tangent point (Land & Lee, 1994). The tangent point is the point of the inner lane marking (or the boundary between the asphalted road and the adjacent green) bearing the highest curvature, or in other terms, the innermost point of this boundary, as shown in FIG. 23.

For 61% of cases, the time point of the first eye movement to the tangent point could be identified. For these cases, the average temporal advance to the start of the steering maneuver was 1.74±0.22 seconds, corresponding to 37 m of way.

Figure 25:
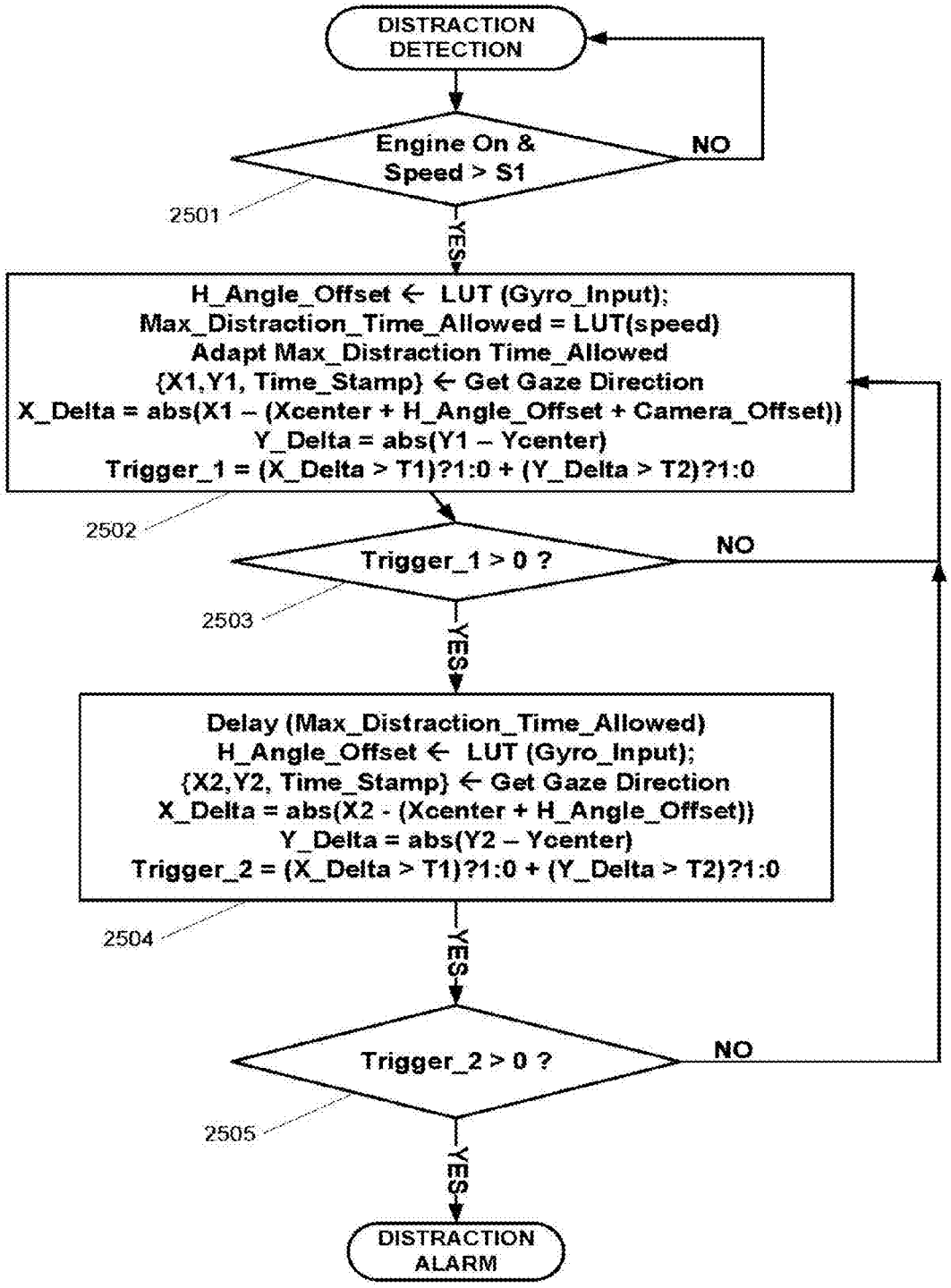
FIG. 25 shows an embodiment of distraction detection.

FIG. 25 shows an embodiment of driver monitoring and distraction detection for accident avoidance. The distraction detection is only performed when engine is on and vehicle speed exceeds a constant, otherwise no distraction detection is performed as shown by 2501. The speed threshold could be set to 15 or 20 mph, below which distraction detection is not performed.

The speed of the vehicle is obtained from the built-in GPS unit which also calculates rate of location change, as a secondary input calculated from the accelerometer sensor output, and also optionally from the vehicle itself via OBD-2 interface.

As the next step 2502, first horizontal angle offset is calculated as a function of cornering that is measured by the gyro unit and a look-up table (LUT) is used to determine the driver's face horizontal offset angle. In a different embodiment horizontal offset can be calculated using mathematical formulas at run time as opposed to using a pre-calculated and stored first LUT table.

Next, maximum allowed distraction time is calculated as a function of speed, using a second LUT, the contents of which are exemplified in FIG. 26. In pre-calculating and loading the second LUT, first maximum allowed travel distance for a distraction is defined and entered. Each entry of the second LUT is calculated as a function of speed where LUT (x) is given by:

(Distraction_Travel_Distance/1.46667)/Speed

We assume we can define the Distraction_Travel_Distance as 150 feet, but other values could be chosen to make it more or less strict.

Figure 37:
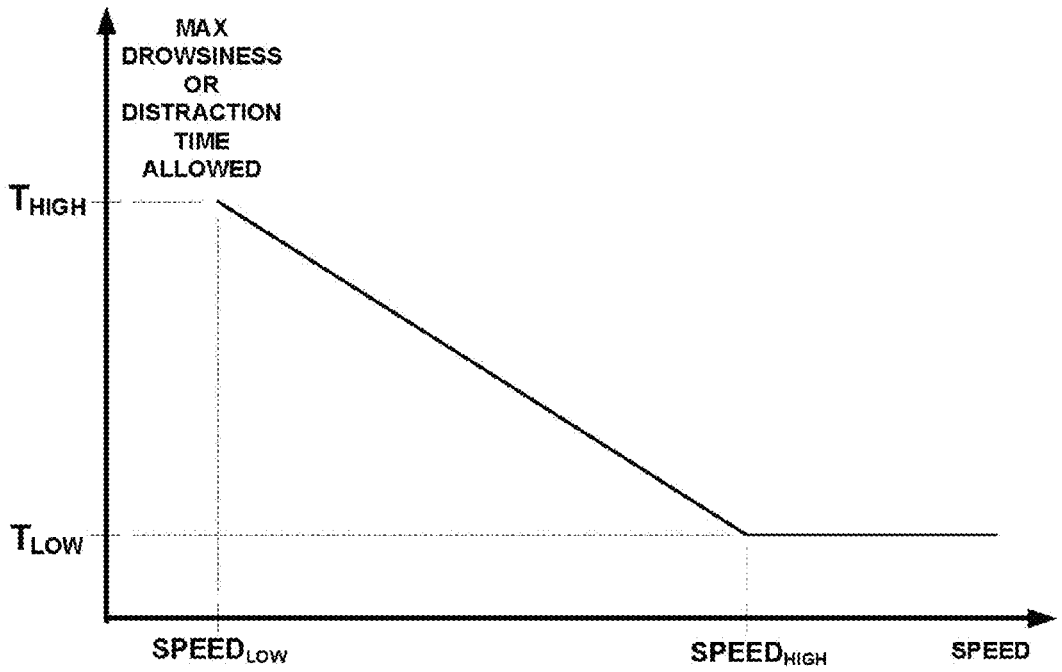
FIG. 37 shows a non-linear graph of maximum drowsiness or distraction time allowed versus speed of vehicle.

For example, a vehicle travelling at 65 miles per hour travels 95.3 feet per second. This means it would take 1.57 seconds to travel 150 feet, or LUT (65) entry is 1.57. Similarly, the second LUT shows at 20 miles per hour, the maximum distraction time allowed is 5.11 seconds, and at 40 miles per hour the maximum distraction time allowed is 2.55 seconds, but this time is reduced to 1.2 seconds at 85 miles per hour. The setting of Distraction_Travel_Distance could be set and the second LUT contents can be calculated and stored accordingly as part of set up, for example as MORE STRICT, NORMAL, and LESS STRICT, where as an example the numbers could be 150, 200, and 250, respectively. The second LUT contents for 250 feet distraction travel distance is given in FIG. 29, where for example, at 65 miles per hour the maximum distraction allowed time is 2.62 seconds, in this case. In a different embodiment maximum allowed distraction time can be calculated using mathematical formulas at run time as opposed to using a pre-calculated and stored second LUT table. In a different embodiment, the distraction time is a non-linear function of speed of vehicle as shown in FIG. 37. If the speed of the vehicle is less than $Speed_{Low}$, then no drowsiness calculation is performed and drowsiness alarm is disabled. When speed of the vehicle is $Speed_{Low}$, then $T_{High}$ value is used as the maximum allowed drowsiness value, and then linearly decreases to $T_{Low}$ until speed of the vehicle reaches $Speed_{High}$, after which the drowsiness window is no longer decreased as a function of speed.

Next, driver's face gaze direction is measured as part of facial processing, and X1, Y1 for horizontal and vertical values of gaze direction as well as the time stamp of the measurement is captured. Then, the measured gaze direction's offset to the center point is calculated as a function of cornering forces, which is done using the first LUT. The horizontal offset is calculated as an absolute value ("abs" is absolute value function) of difference between X1 and (Xcenter+H_Angle_Offset+Camera_Offset). The camera offset signifies the offset of camera angle with respect to the driver's face, for example, 15 degrees. Similarly, Y_Delta is calculated. If the drivers gaze direction differs by more than T1 offset in the horizontal direction or by more than T2 in the vertical dimension, this causes a first trigger to be signaled. If no first trigger is signaled, then the above process is repeated and new measurement is taken again. Alternatively, yaw and pitch angles are used to determine when driver's gaze direction falls outside the non-distraction field of view.

The trigger condition is shown using a conditional expression in computer programming:

condition ? value_if_true:value_if_false

The condition is evaluated true or false as a Boolean expression. On the basis of the evaluation of the Boolean condition, the entire expression returns value_if_true if condition is true, but value_if_false otherwise. Usually the two sub-expressions value_if_true and value_if_false must have the same type, which determines the type of the whole expression.

If the first trigger condition is signaled, then next steps of processing shown in 2504 are taken. First, a delay of maximum distraction time allowed is elapsed. Then, a current horizontal angle offset is calculated by on the first LUT and gyro input, since the vehicle may have entered a curve affecting the center focus point of the driver. The center point is updated with the calculated horizontal offset. Next, driver's face gaze direction is determined and captured with the associated time stamp. If driver's gaze differs by more than a T1 in the horizontal direction or by more than T2 in the vertical direction as shown by 2505, or in other words driver's gaze direction persists outside the no-distraction window of driver's view, a second trigger condition is signaled, which causes a distraction alarm to be issued to the driver. If there is no second trigger, then processing re-starts with 2502.

Figure 27:
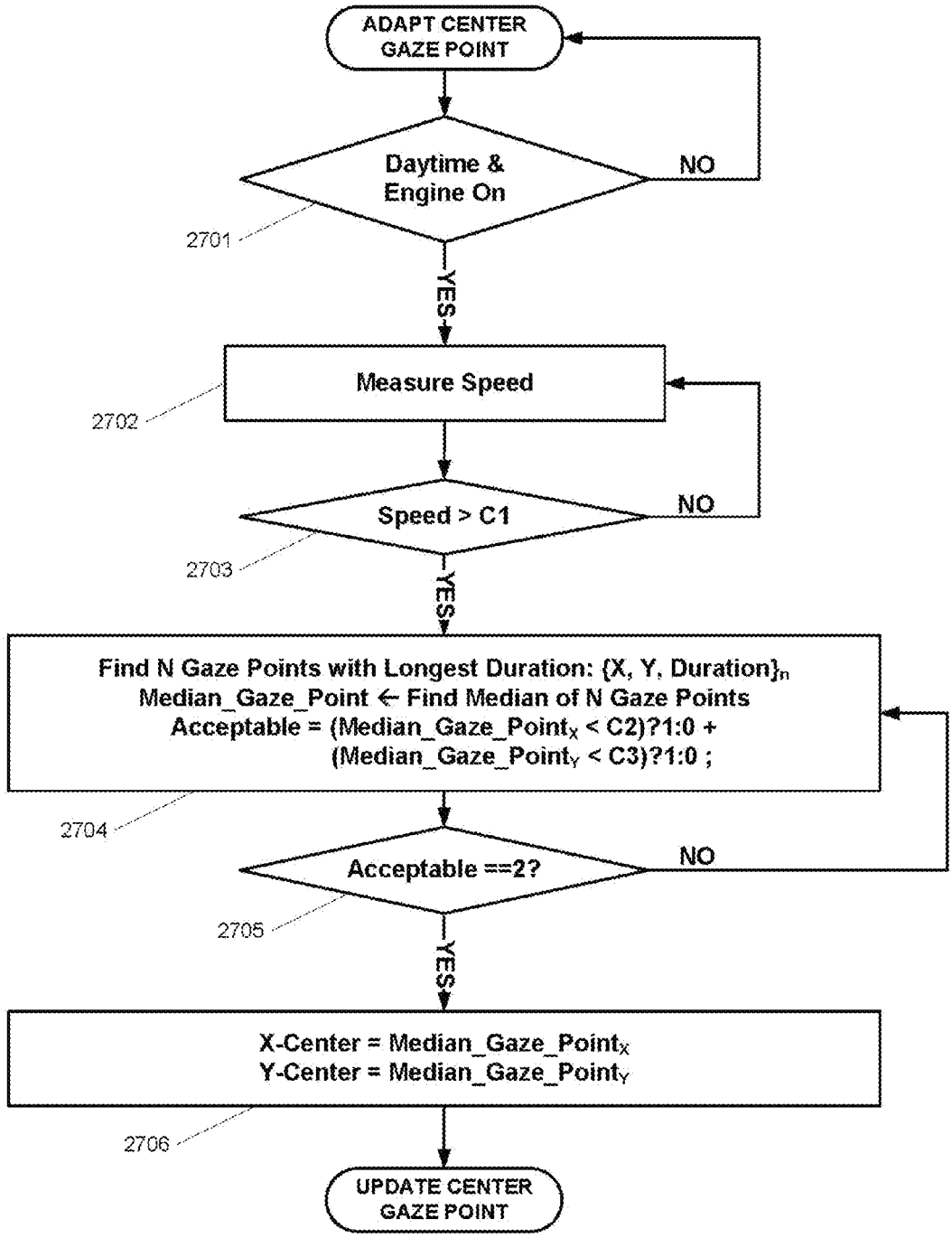
FIG. 27 shows an embodiment of the present invention that also uses adaptive adjustment of center gaze point automatically without any human involved calibration.
Figure 34:
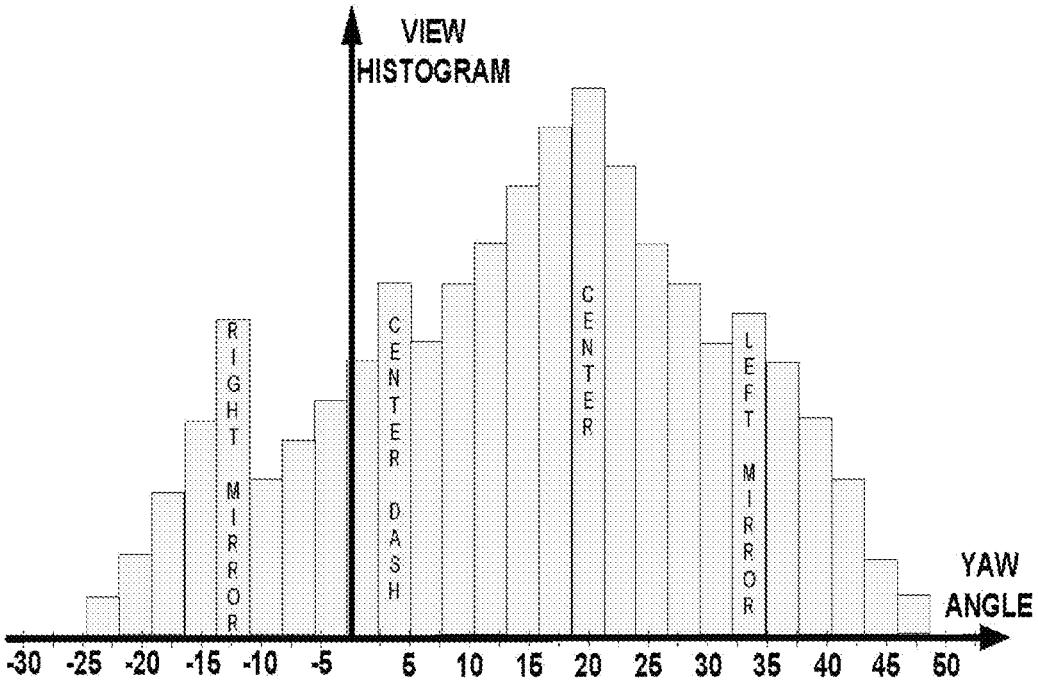
FIG. 34 shows the view of histogram of yaw angle of driver's face gaze direction.

Another embodiment of the present invention adapts the center point for a driver, as shown in FIG. 27. First, adaptation of center gaze point is only performed when engine is on and during daytime as shown by 2701. The daytime restriction is placed so that any adaptation is done with high accuracy, and not degrades the performance of the distraction detection. Next, speed is measured in 2702 and adaptation is only performed over a certain speed point. As mentioned above, the driver's gaze point narrow with speed as shown in FIG. 22. This allows more accurate measurement of center gaze point. For example, center gaze point is done when speed is greater than 55 miles per hour (C1=55) in 2703. If speed is larger than C1, then processing continues at 2704. First, histogram bins of different gaze points are checked to find N gaze points with longest duration, i.e., with longest time of stay for that gaze point. This is shown in FIG. 34. Driver spends most of the time looking ahead at the road, especially at high speeds. If the score is higher than a threshold, then every 10 video frames, the yaw angle of driver's face is captured and added to the histogram of previous histogram values. The driver looks also to mirrors and the center dash console as secondary items. This step will determine the center angle, and this compensates for any mounting angles of the camera viewing the driver's face. The peak value is used as the horizontal offset value and the driver's yaw angle is modified by this offset value H_Angle_Offset in determining the window of no-distraction gaze window shown in FIG. 20.

Next, median gaze point of N gaze points is selected, where each gaze point is signified by X and Y values or as yaw and pitch angles. X and Y of the selected gaze point is checked to be less than constants C2 and C3, respectively, to make sure that the found median gaze point is not too different from the center point, which may indicate a bogus measurement. Any such bogus values are thrown out and calculations are started so as not to degrade the performance of distraction center point adaptation for a driver. If the median X and Y points are within a tolerance of constants C2 and C3, then they are marked as X-Center and Y-Center in 2706, and used in any further distraction calculations of FIG. 25.

Figure 28:
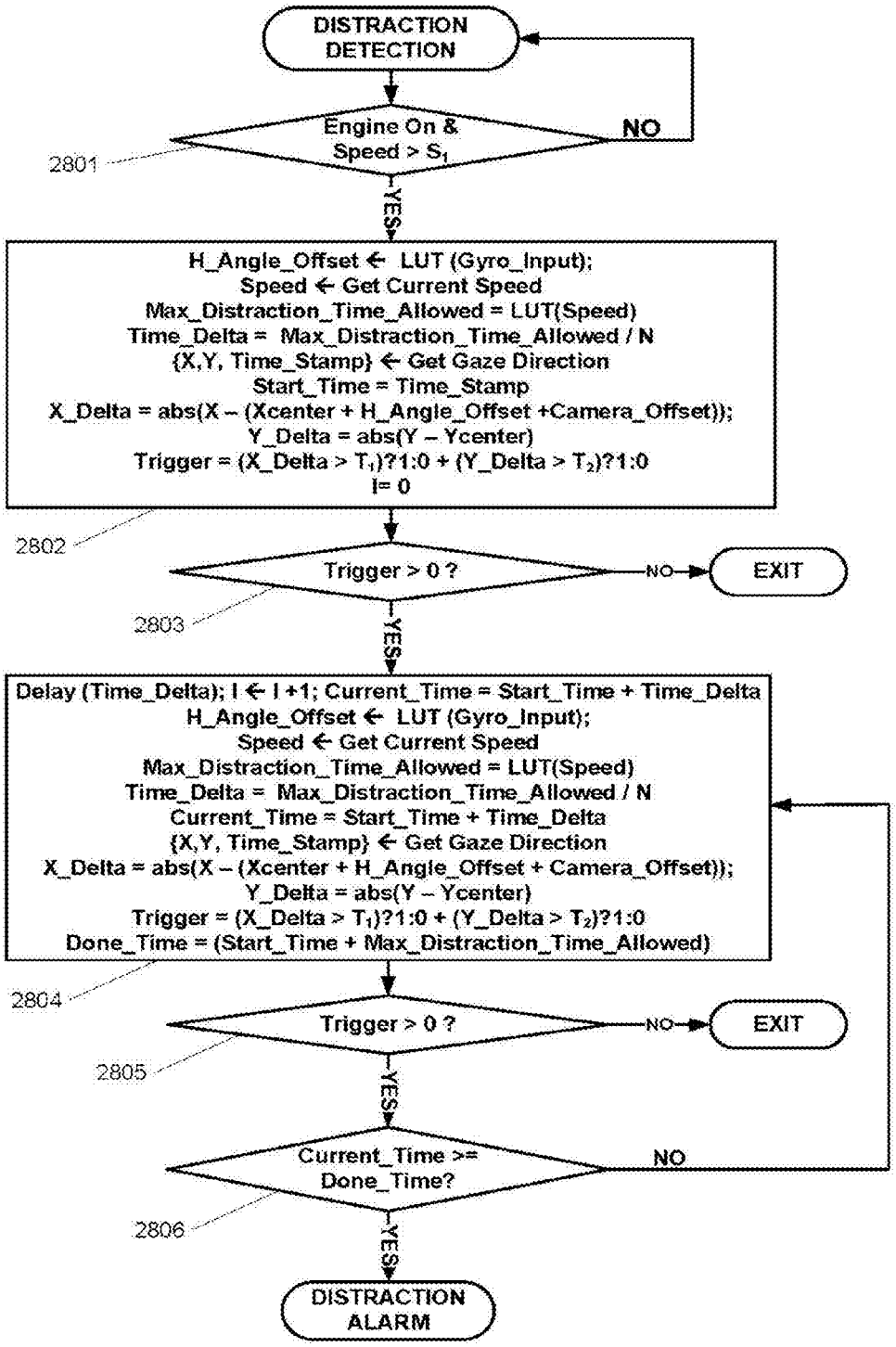
FIG. 28 shows another embodiment of distraction detection.

Another embodiment of driver monitoring for distractions is shown in FIG. 28. The embodiment of FIG. 25 assumes the speed of the vehicle does not change between the initial and final measurement of distraction. For example, at a speed of 40 miles per hour if we assume we set the allowed Distraction Travel Distance to 150 feet as shown in FIG. 26, then maximum distraction time allowed is 2.55 seconds. However, a vehicle can accelerate quite a bit during this period, whereby making the initial assumption of distraction travel distance not valid. Furthermore, the driver may have distraction, such as looking at the left side at the beginning and at the end but may look at the road ahead between the beginning and the end of 2.55 seconds.

FIG. 28 addresses these shortcomings of the FIG. 25 embodiment by dividing the maximum allowed distraction time period into N slots and making N measurements of distraction and also checking speed of the vehicle and updating the maximum allowed distraction travel distance accordingly.

The 2801 is the same as before. In 2802 step, maximum distraction time is divided into N time slots. 2803 is the same as in FIG. 25. The processing step of 2804 is repeated N times, where during each step maximum distraction time allowed is re-calculated, and divided into N slots. If trigger or distraction condition is not detected, then process exits in 2805. This corresponds to driver re-focusing on one of the sequential checks during N iterations. Also, in accordance with speed time delta could be smaller or larger. If the vehicle speeds up, then maximum allowed distraction time is shortened in accordance with the new current speed.

If current time exceeds or equals done time, as shown in 2806, then this means that the distraction condition continued during each of iterations of sub-intervals of the maximum allowed distraction time, and this causes a distraction alarm to be issued to the driver.

The embodiments of FIG. 25 and FIG. 28 assume the same driver uses the vehicle most of the time. If there are multiple frequent drivers, then each driver's face can be recognized and a different adapted center gaze point can automatically be used in the adaptation and the distraction algorithms in accordance with the driver recognized, and if driver is not recognized a new profile and a new adaptation is automatically started, as shown in FIG. 27.

Figure 24:
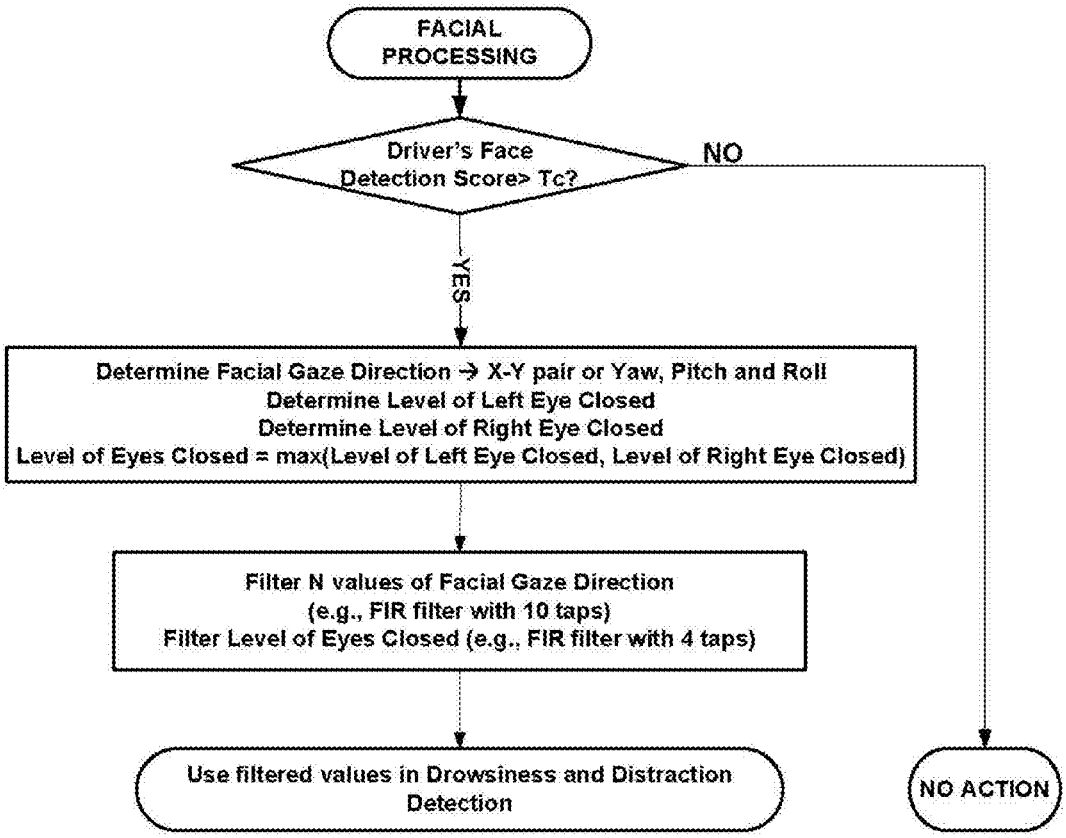
FIG. 24 shows the preprocessing of gaze direction inputs of yaw, pitch and roll.

As part of facial processing, first a confidence score value is determined validate the determined face gaze direction and level of eyes closed. If the confidence score is low due to difficult or varying illumination conditions, then distraction and drowsiness detection is voided since otherwise this may cause a false alarm condition. If the confidence score is more than a detection score threshold of Tc value, both face gaze direction and level of eyes closed are filtered as shown in FIG. 24. The level of eyes closed is calculated as the maximum of left eye closed and right eye closed, which works even if one eye is occluded. The filter used can be an Infinite Impulse Response (IIR) or Finite Impulse Response (FIR) filter, or a median filter such a 9 or 11-tap median filter. Example filter for face direction is shown as FIR filter with 9-tap convolution kernel shown in FIG. 41.

Figure 40:
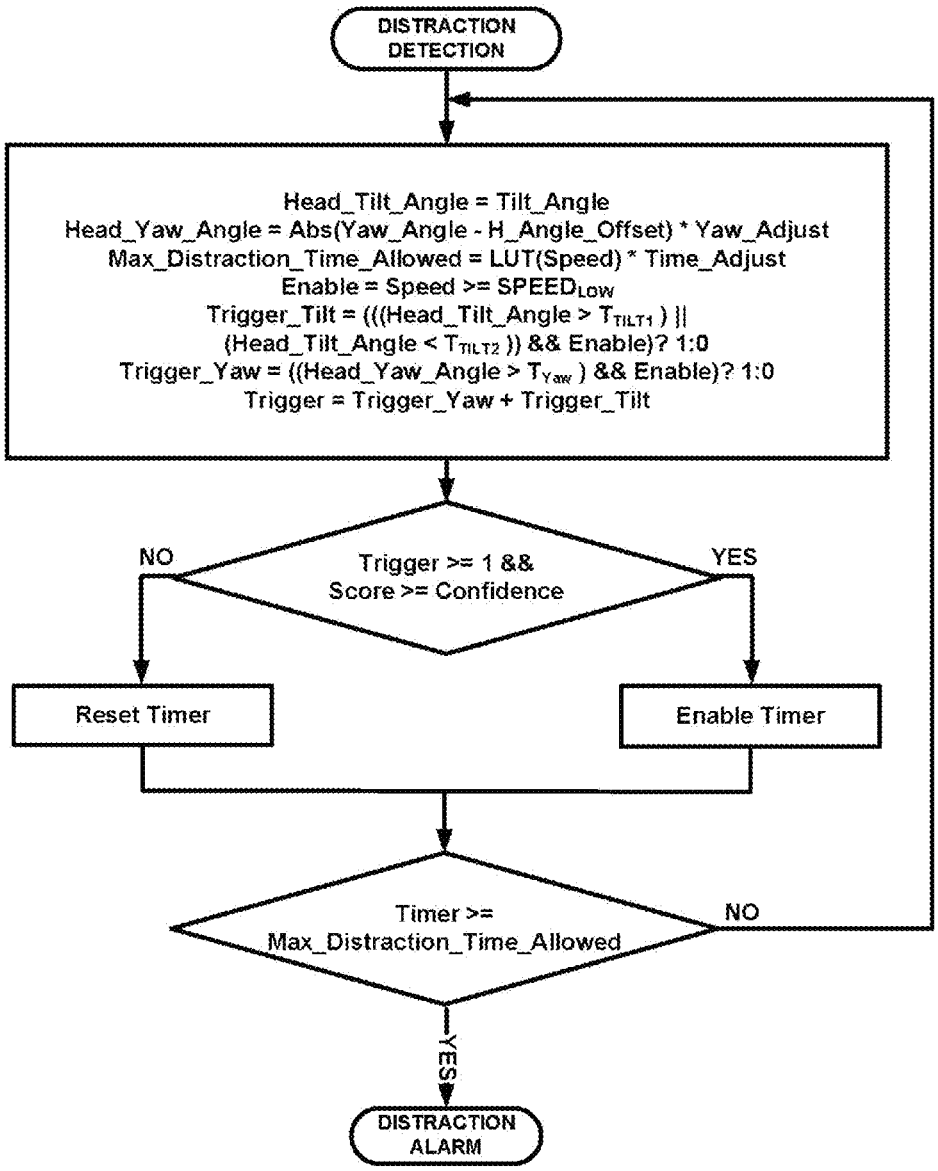
FIG. 40 shows another embodiment of driver distraction detection.

Another embodiment of driver distraction detection is shown in FIG. 40. In this case, the H_Angle_Offset includes the camera offset angle in addition to center point adaptation based on histogram of yaw angles at highway speeds. Also, the yaw angle is not filtered in this case, which allows reset of timer value when at least a singular value of no-distraction yaw value or low confidence score is detected.

Figure 30:
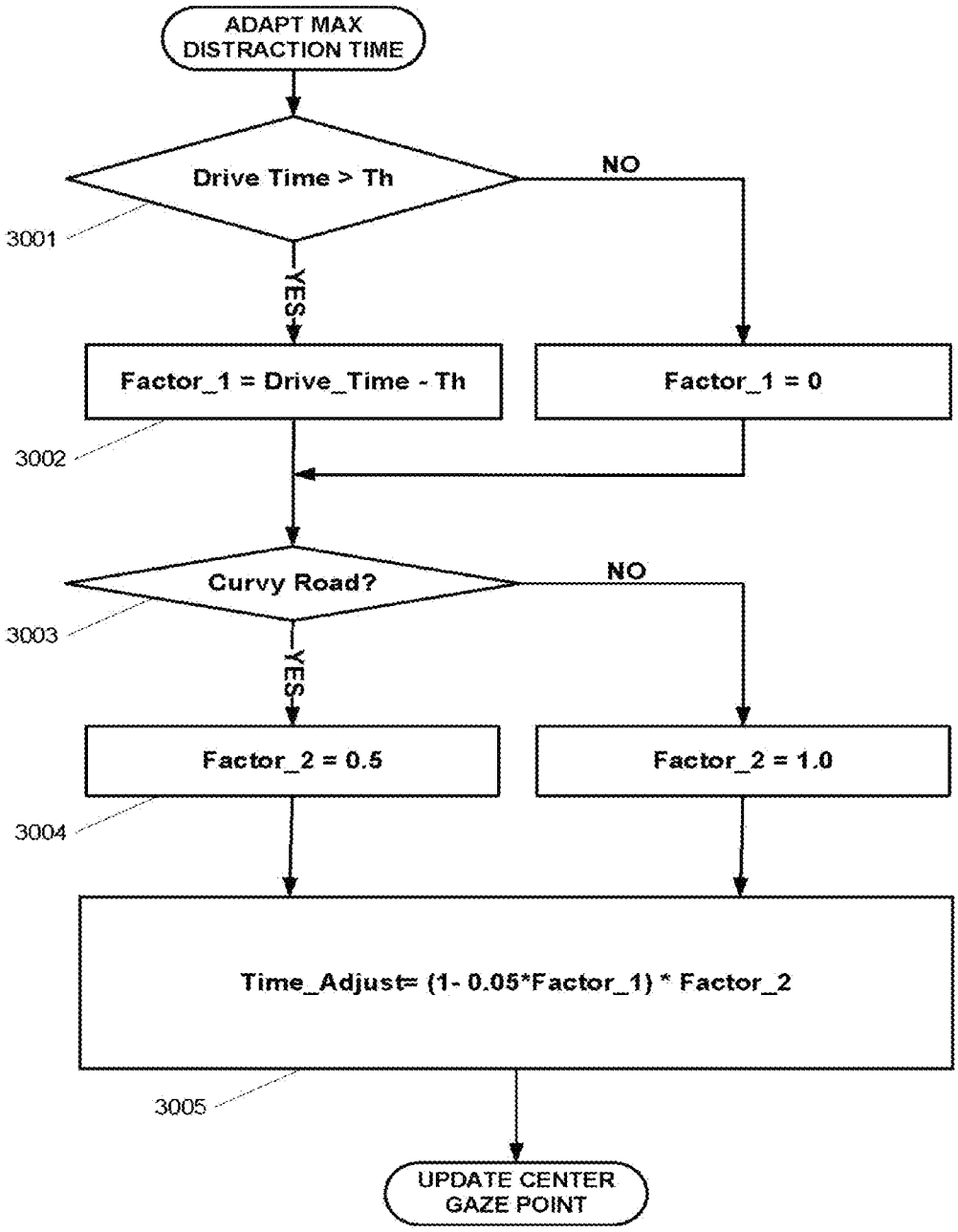
FIG. 30 shows changing total distraction time allowed in accordance with secondary considerations.

The yaw angles are adjusted based on some factors which may include but not limited to total driving time, weather conditions, etc. This is similar to FIG. 30, but is used to adjust the size of the no-distraction window as opposed to the maximum allowed distraction time. The time adjust by Time_Adjust is similar to what is shown in FIG. 30. If the driver looks at outside the no-distraction window longer than maximum allowed distraction time, then distraction alarm condition is triggered, which results in sound or chime warning to the driver, as well as noting the occurrence of such a condition in non-volatile memory, which can later be reported to insurance, fleet management, parents, etc.

Secondary Factors Affecting the Total Distraction Time Window

The calculated value of total distraction window time could be modified for different conditions including the following, as shown in FIG. 30:

For a curvy road that continually turns right and left, this condition is detected by the x-y-z gyro unit, and in this case depending upon the curviness of the road, the total distraction distance is reduced accordingly. When curvy road is detected 3003, the distraction time can be cut in half 3004.

Based on the total driving time after the last stop, the driver will be tired, and the total distraction condition can be reduced accordingly, for example, for every additional hour after 4 hours of non-stop driving, the total distraction distance can be reduced by 5 percent, as shown by 3002 and 3005.

Figure 42:
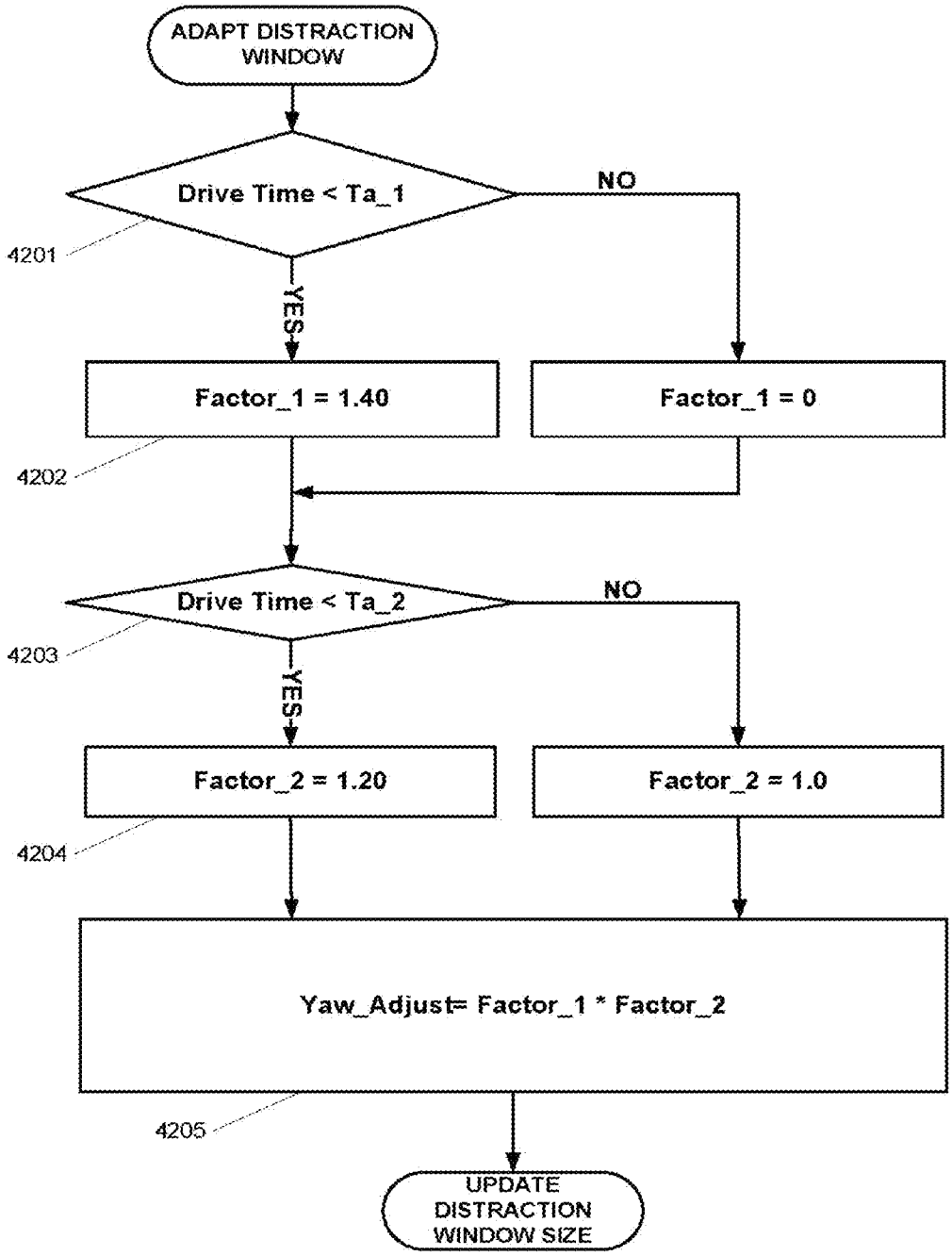
FIG. 42 shows a method of adapting distraction window.

The initial no-distraction window can be larger at the beginning of driving to allow time to adapt and to prevent false alarms, and can be reduced in stages, as shown in FIG. 42.

If drowsiness condition is detected based on level of eyes closed, then the distraction distance can also be reduced by a given percentage.

Determining Driver's Gaze Direction

Figure 19:
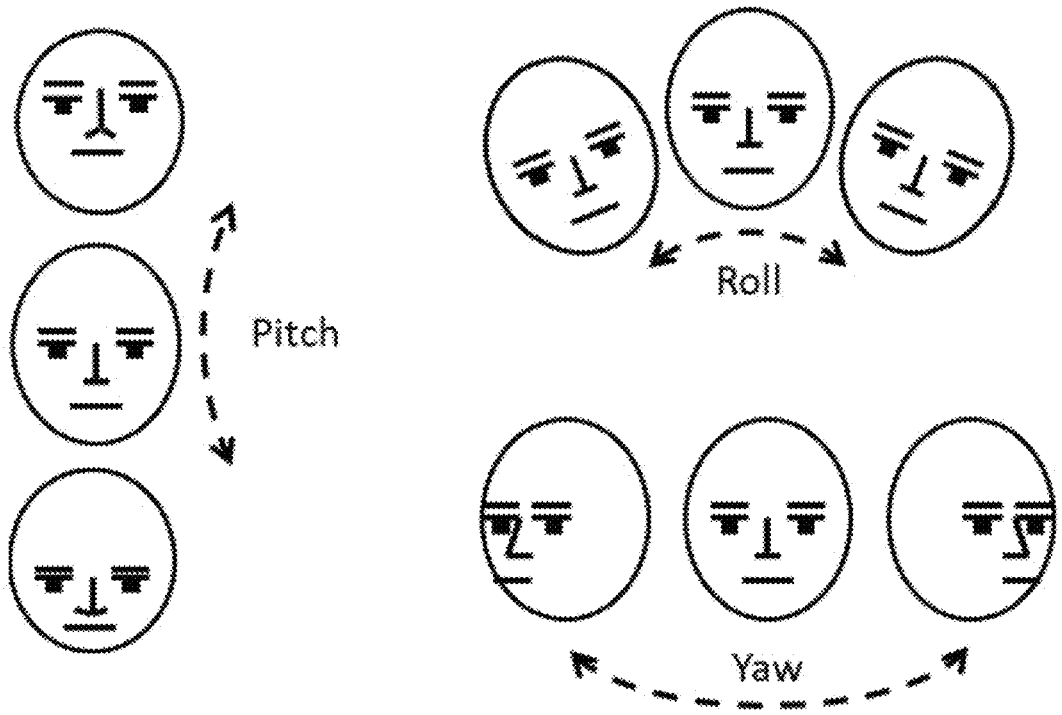
FIG. 19 shows the definition of terms yaw, roll and pitch.

The global head motion can be represented by a rigid motion, which can be parameterized by 6 parameters, three for 3D rotation as shown in FIG. 19, and three for 3D translation. The latter is very limited for a driver of a vehicle in motion, with the exception of bending down to retrieve something or turning around briefly to look at the back seat, etc. Herein the term of global motion tracking is defined to refer to tracking of global head movements, and not movement of eye pupils.

Face detection can be regarded as a specific case of object-class detection. In object-class detection, the task is to find the locations and sizes of all objects in an image that belong to a given class. Face detection can be regarded as a more general case of face localization. In face localization, the task is to find the locations and sizes of a known number of faces (usually one).

Early face-detection algorithms focused on the detection of frontal human faces, whereas newer algorithms attempt to solve the more general and difficult problem of multi-view face detection. That is, the detection of faces that is either rotated along the axis from the face to the observer (tilt), or rotated along the vertical (yaw) or left-right axis (pitch), or both. The newer algorithms take into account variations in the image or video by factors such as face appearance, lighting, and pose.

There are several algorithms available to determine the driver's gaze direction including the face detection. The Active Appearance Models (AAMs) provide the detailed descriptive parameters including face tracking for pose variations and level of eyes closed. The details of AAM algorithm is described in detail in cited references 1 and 2, which is incorporated by reference herein. When the head pose is deviated too much from the frontal view, the AAMs fail to fit the input face image correctly because most part of the face image becomes invisible. AAMs' range of yaw angles for pose coverage is about −34 to +34 degrees.

An improved algorithm by cited reference 3, incorporated herein by reference, combines the active appearance models and the Cylinder-Head Models (CHMs) where the global head motion parameters obtained from the CHMs are used as the cues of the AAM parameters for a good fitting and initialization, which is incorporated by reference herein. The combined AAM+CHM algorithm defined by cited reference 3 is used for improved face gaze angle determination across wider pose ranges (the same as wider yaw ranges).

Figure 46:
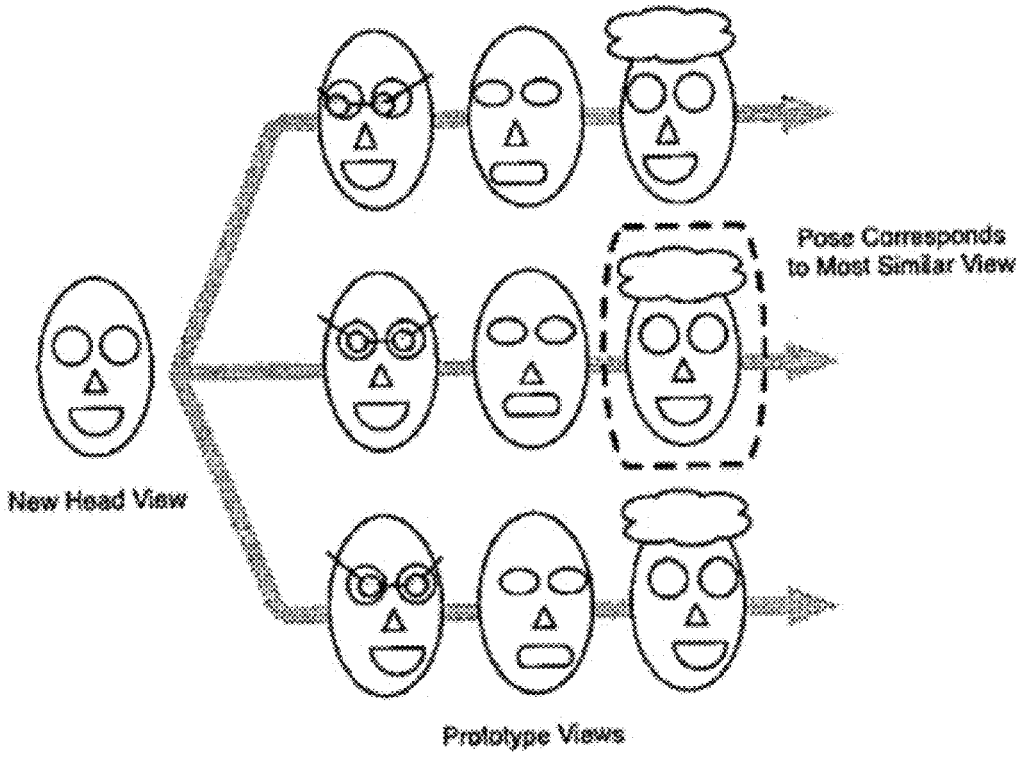
FIG. 46 depicts Appearance Template method for determining head pose.
Figure 47:
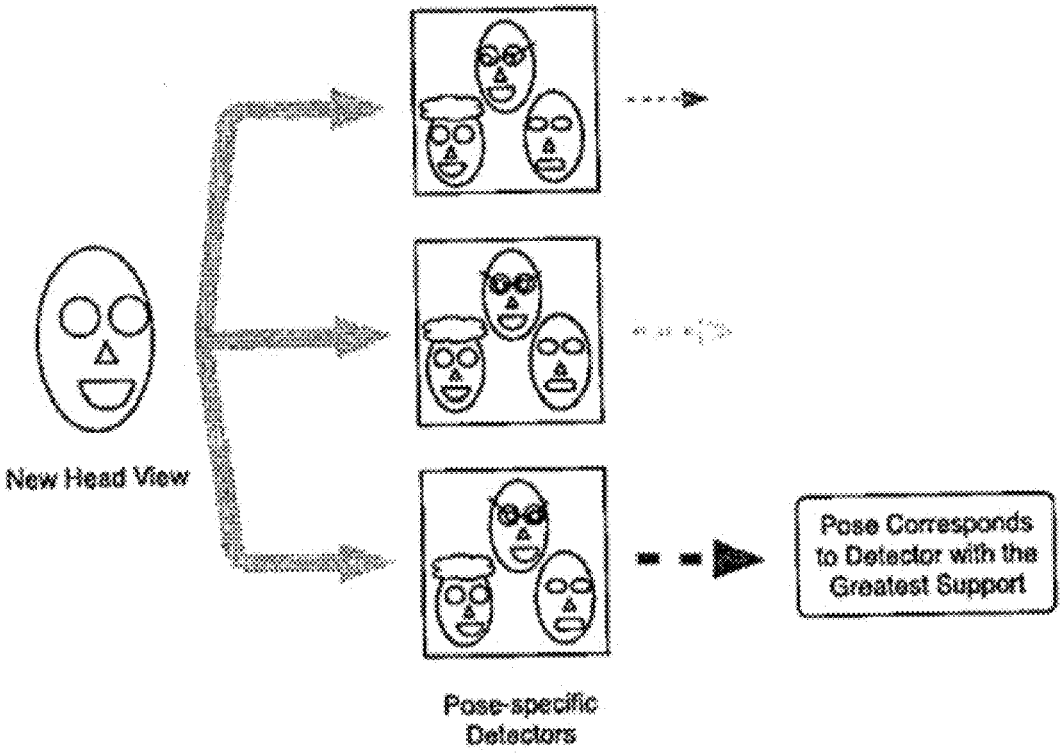
FIG. 47 depicts Detector Array method for determining head pose.

Other methods are also available for head pose estimation, as summarized in the cited reference 4. Appearance Template Methods, shown in FIG. 46, compare a new head view to a set of training examples that are each labelled with a discrete pose and find the most similar view. The Detector Array method shown in FIG. 47 comprise a series of head detectors, each attuned to a specific pose, and a discrete pose is assigned to the detector with the greatest support. An advantage of detector array methods is that a separate head detection and localization step is not required.

Figure 48:
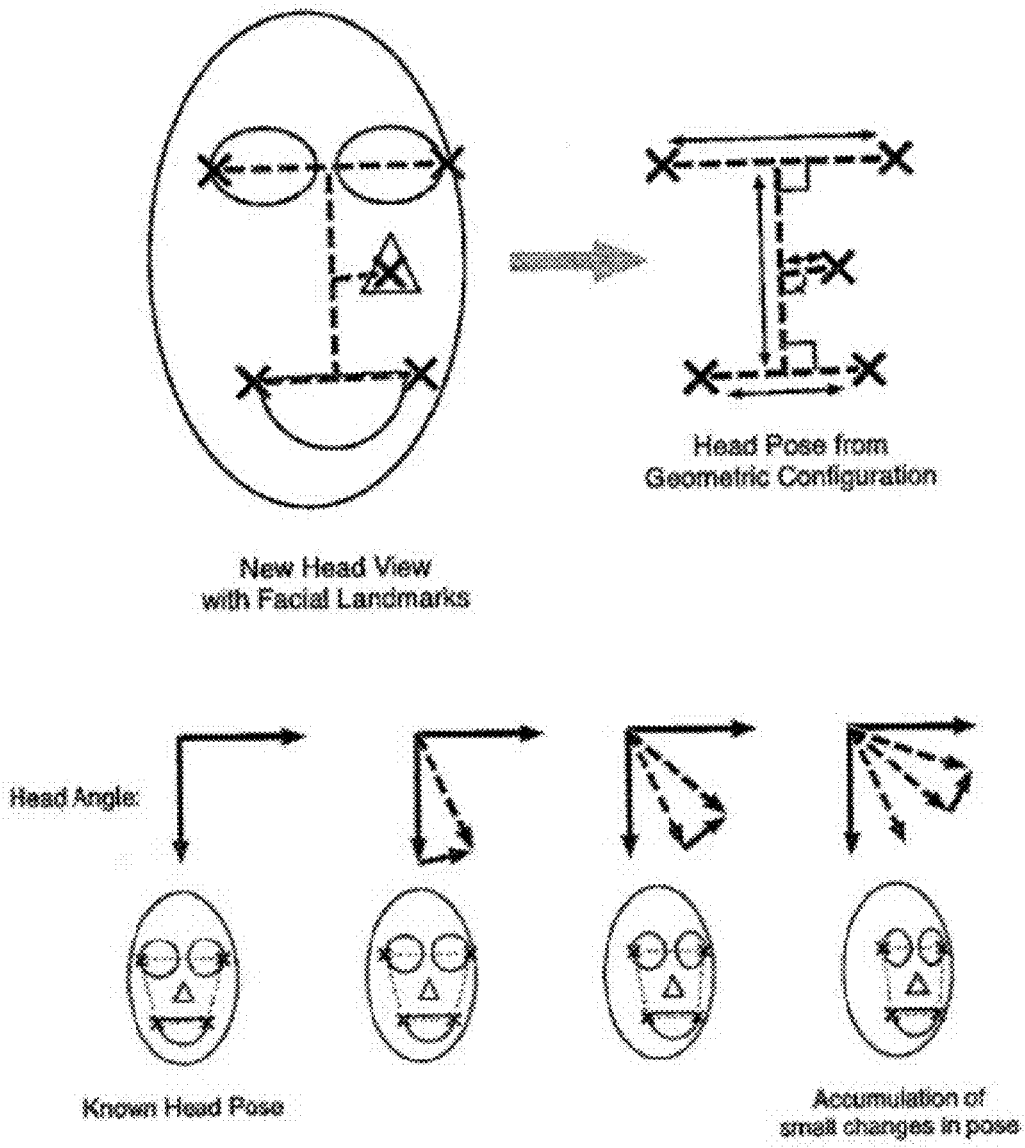
FIG. 48 depicts Geometric methods for determining head pose.

Geometric methods use head shape and the precise configuration of local features to estimate pose, as depicted in FIG. 48. Using five facial points (the outside corners of each eye, the outside corners of the mouth, and the tip of the nose) the facial symmetry is found by connecting a line between the mid-point of the eyes and the mid-point of the mouth. Assuming fixed ratio between these facial points and fixed length of the nose, the facial direction can be determined under weak-perspective geometry from the 3 dimensional angle of the nose. Alternatively, the same five points can be used to determine the head pose from the normal to the plane, which can be found from planar skew-symmetry and a coarse estimate of the nose position. The geometric methods are fast and simple. With only a few facial features, a decent estimate of head pose can be obtained. The obvious difficulty lies in detecting the features with high precision and accuracy, which can utilize a method such as AAM.

Other head pose tracking algorithms include flexible models that use a non-rigid model which is fit to the facial structure of each individual (see cited reference 4), and tracking methods which operate by following the relative movement of head between consecutive frames of a video sequence that demonstrate a high level of accuracy (see cited reference 4). The tracking methods include feature tracking, model tracking, affine transformation, and appearance-based particle filters.

Hybrid methods combine one or more approaches to estimate pose. For example, initialization and tracking can use two different methods, and reverts back to initialization if track is lost. Also, two different cameras with differing view angles can be used with the same or different algorithm for each camera input and combining the results.

The above algorithms provide the following outputs:

Confidence factor for detection of face: If confidence factor, also named score herein, is less than a defined constant, this means no face is detected, and until a face is detected, no other values will be used. For dual-camera embodiment, there will be two confidence factors. For example, if the driver's head is turned 40 degrees to a left as the yaw angle, then the right camera will have the eyes and left side of the face occluded, however, the left camera will have both facial features visible and will provide a higher confidence score.

Yaw value: This represents the rotation of driver's head;

Pitch Value: This represents the pitch value of driver's head (see FIG. 19), Roll Value: This represents the pitch value of driver's head (see FIG. 19).

Level of Left Eye Closed: On a scale of 100 shows the level of driver's left eye closed.

Level of Right Eye Closed: On a scale of 100 shows the level of driver's right eye closed.

The above values are filtered in certain embodiments, as shown in FIG. 24, before being used by the algorithm in FIGS. 25, 28 and 30.

Figure 49:
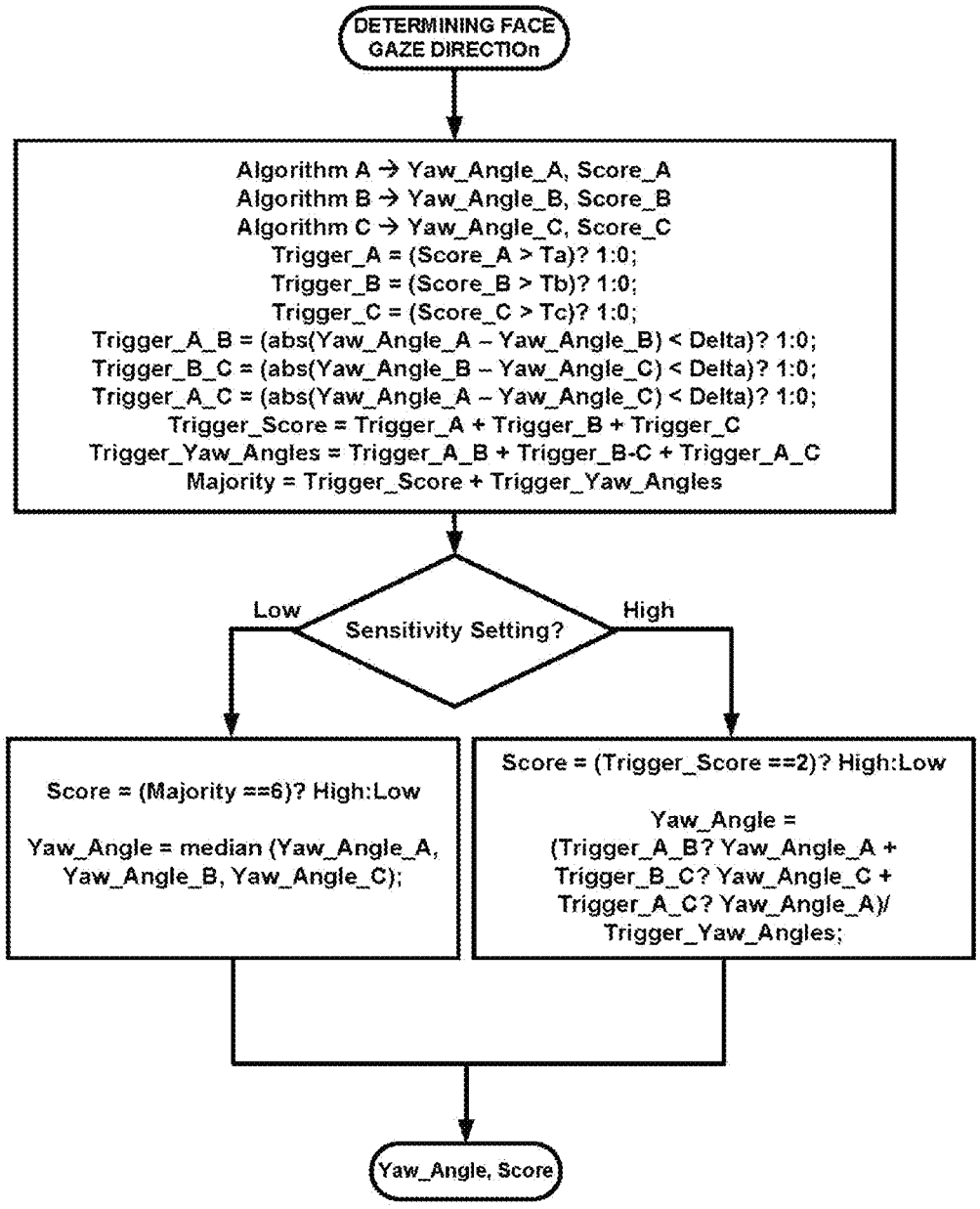
FIG. 49 depicts merging results of three concurrent head-pose algorithms for high and normal sensitivity settings.

In a different embodiment of driver distraction condition detection, multiple face tracking algorithms are used concurrently, as shown in FIG. 49, and the results of these multiple algorithms are merged and combined in order to reduce false alarm error rates. For example, Algorithm A uses a hybrid algorithm based on AAM plus CHM, Algorithm B uses geometric method with easy calculation, and Algorithm C uses face template matching. In this case, each algorithm provides a separate confidence score and also a yaw value. There are two ways to combine these three results. If a sensitivity setting from a user set up menu indicates low value, i.e., minimum error rate, than it is required that all three algorithms provide a high confidence score, and also all three yaw values provided are consistent with each other. In high sensitivity mode, two of the three results has to be acceptable, i.e., two of the three confidence scores has to be high and the respective yaw values has to be consistent with a specified delta range of each other. The resultant yaw and score values are fed to the rest of the algorithm in different embodiments of FIG. 25, FIG. 28 and FIG. 40. For the low sensitivity case, median filter of three yaw angles are used, and for the high sensitivity two or three yaw angled are averaged, when combined confidence score is high. These multiple algorithms can all use the same video source, or use the dual camera inputs shown in FIG. 43, where one or two algorithms can use the center camera, and the other algorithm can use the A-pillar camera input.

Cited Reference No. 1: Cootes, T., Edward, G., and Taylor, C. (2001). Active appearance models, IEEE Transactions on Pattern Recognition and Machine Intelligence, 23(6), 681-685.

Cited Reference No. 2: Matthews, I., and Baker S. (2004). Active appearance models revisited. International Journal of Computer Vision, 60(2), 135-164.

Cited Reference No. 3: Jawon Sung, Takeo Kanade, and Daijin Kim (published online: 23 Jan. 2008). Pose robust face tracking by combining active appearance models and cylinder head models. International Journal of Computer Vision 80, 260-274.

Cited Reference No. 4: Erik Murphy-Chutorian, Mohan Trivedi, Head pose estimation in computer vision: A survey, IEEE Transactions on Pattern Analysis and Machine Intelligence, June 2007, Digital Object Identifier 10.1109/TPAMI.2008.106.

Tamper Proof

Figure 15:
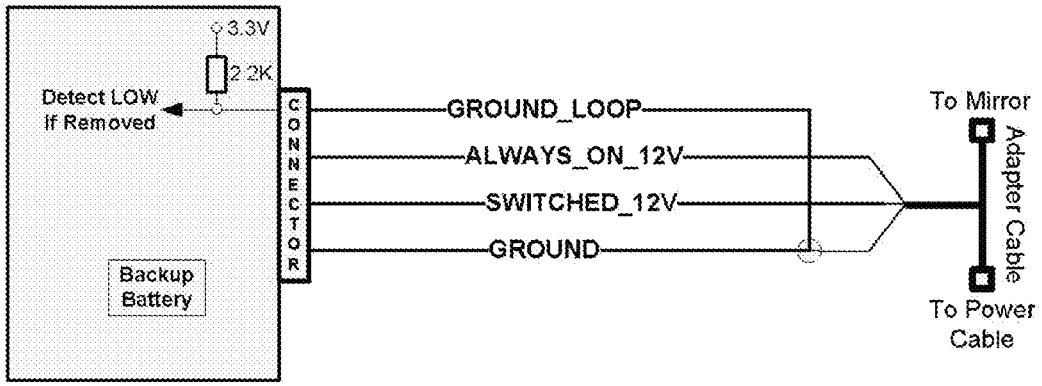
FIG. 15 shows the operation and connection of tamper proof connection to a vehicle.

It is important the device handling the driver distraction monitoring be tamper proof so that it cannot be simply turned off or its operation disabled. The first requirement is that there is no on/off button for the driver distraction detection, or even in general for the device outlined herein. It is also required that the used cannot simply disconnect the device to disable its operation. The present invention has several tamper-proof features. There is a loop and detection of connected to the vehicle, as shown in FIG. 15, wherein if the connection to the device is monitored, and if disconnected, the present invention uses the built-in battery and transmits information to a pre-defined destination, fleet management center, parents, taxi management center, etc., using an email to inform it is disconnected. The disconnection is detected when the ground loop connection is lost by either removing the power connection by disconnecting the cable or device, or breaking the power connection by force, when the respective general-purpose IO input of System-on-a Chip will go to logic high state, and this will cause an interrupt condition alerting the respective processor to take action for the tamper-detection. Furthermore, the device will upload video to the cloud showing t−5 seconds to t+2 seconds, where "t" is the time when it was disconnected. This will also clearly show who disconnected the device. The device also contains a free-fall detector, and when detected, it will send an email showing time of fall, GPS location of fall, and the associated video. The video will include three clips, one for each camera.

The circuit of FIG. 15 also provides information with regard to engine is running or not using the switched 12V input, which is only on when the engine is running. This information is important for various reasons in absence of OBD-2 connection to determine the engine status.

Accidence Avoidance for Driver Drowsiness

Figure 31:
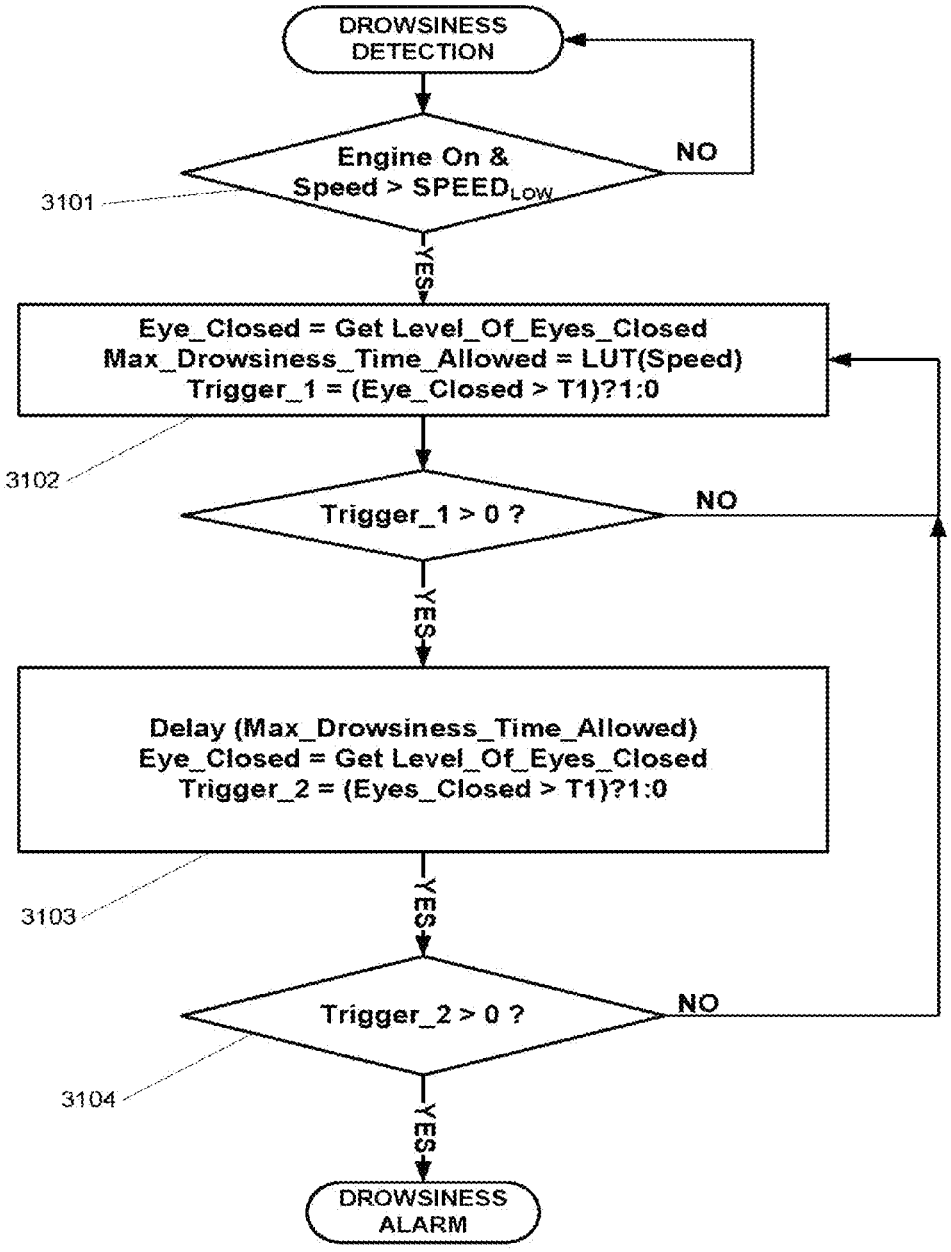
FIG. 31 shows detection of driver drowsiness condition.

FIG. 31 flowchart shows determining the driver drowsiness condition. Driver monitoring for drowsiness condition is only performed when the vehicle engine is on and the vehicle speed exceeds a given speed D1, as shown in 3101. First, the level of driver's eyes is determined using facial processing in 3102. Next, level of left and right eye closed are aggregated by selecting the maximum value of the two (referred to as "max" function, as shown in FIG. 24. The max function allows working monitoring even when one of the two eyes is occluded. Next, multiple measurements of level of eyes closed are filtered using a 4-tap FIR filter.

Next, maximum allowed drowsiness time is calculated as a function of speed using a third LUT. This LUT contents is similar to the second LUT for distraction detection, but may have lesser time window allowed for eyes closed in comparison to distraction time allowed. The first trigger condition is if eyes closed level exceeds a constant level T1.

If first trigger level is greater than zero, then first delay of maximum drowsiness allowed time is elapsed in 3103. Then, driver's eyes closed level is measured again. If driver's eye's close level exceeds a known constant again, then this causes a second trigger condition. The second trigger condition causes a drowsiness alert alarm to be issued to the driver.

Figure 39:
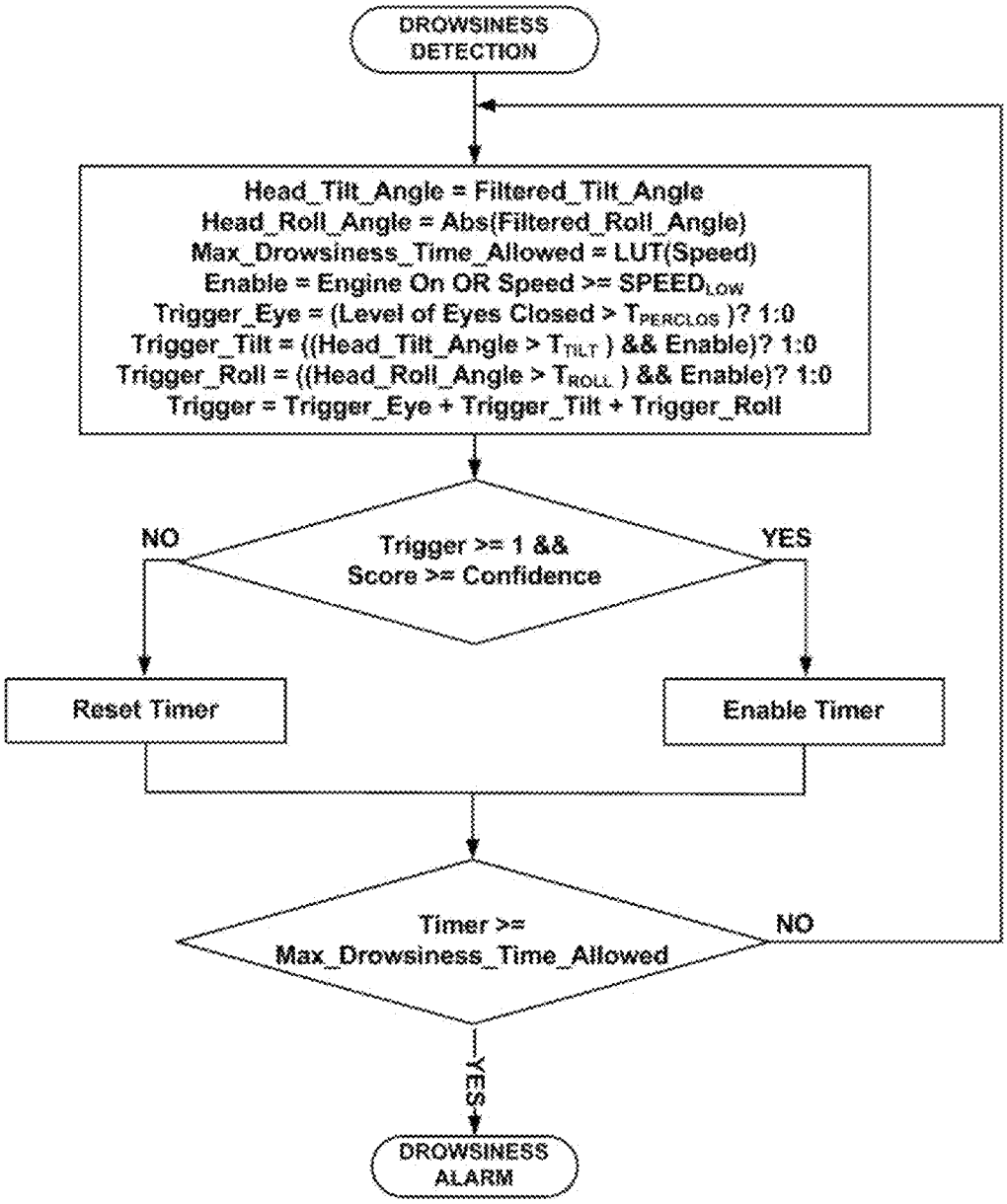
FIG. 39 shows another embodiment of driver drowsiness detection.

Another embodiment of drowsy driver accident avoidance is shown in FIG. 39. Sometime the driver's head tilted down when drowsy or sleeping as if he is looking down. In other instances, a driver may sleep with eyes open while driver's head is tilted up. Driver's head tilt or roll angle is also detected. Roll angle is a good indication of severe drowsiness condition. If the level of eyes closed or head tilt or roll angle exceed a constant respective threshold value and persist longer than maximum allowed drowsiness time that is a non-linear function of time, as exemplified in FIG. 37, then a driver drowsiness alarm is issued.

The drowsiness detection is enabled when the engine is on and speed of the vehicle higher than a low speed threshold that defined. The speed of the vehicle is determined and a LUT is used to determine the maximum allowed drowsiness time, or this is calculated in real time as a function of speed. The level of eyes closed is the filtered value from FIG. 24, where also the two percentage eye closure values are combined using maximum function which selects the maximum of two numbers. If Trigger is one, then there is either a head tilt or roll, and if Trigger is two than there is both head tilt and roll at the same time. If the confidence score is not larger than a pre-determined constant value, then no calculation is performed and the timer is reset. Similarly, if the trigger condition does not persist as long as the maximum drowsiness time allowed, then the timer is also reset. Here persist means all consecutive values of Trigger variable indicate a drowsiness condition, otherwise the timer is reset, and starts from zero again when the next Trigger condition is detected.

If the speed of the vehicle is less than $Speed_{Low}$, then no drowsiness calculation is performed and drowsiness alarm is disabled. When speed of the vehicle is $Speed_{Low}$, then $T_{High}$ value is used as the maximum allowed drowsiness value, and then linearly decreases to $T_{Low}$ until speed of the vehicle reaches $Speed_{High}$, after which the drowsiness window is no longer decreased as a function of speed.

Blue Light as a Countermeasure for Drowsiness

Researchers from the Université Bordeaux Segalen, France, and their Swedish colleagues demonstrated that constant exposure to blue light is as effective as coffee at improving night drivers' alertness. So, a simple blue light can be as effective as a large cup of coffee or a can of red bull behind the wheel.

Sleepiness is responsible for one third of fatalities on motorways as it reduces a drivers alertness, reflexes and visual perception. Blue light is known to increase alertness by stimulating retinal ganglion cells: specialized nerve cells present on the retina, a membrane located at the back of the eye. These cells are connected to the areas of the brain controlling alertness. Stimulating these cells with blue light stops the secretion of melatonin, the hormone that reduces alertness at night. The subjects exposed to blue light consistently rated themselves less sleepy, had quicker reaction times, and had fewer lapses of attention during performance tests compared to those who were exposed to green, red, or white light.

A narrowband blue light with 460 nm, approximately 1 lux, 2 microWatt/cm$^2$ dim illumination, herein referred to as dim illumination, of driver's face suppresses EEG slow wave delta (1.0-4.5 Hz) and theta (4.5-8 Hz) activity and reduced the incidence of slow eye movements. As such, nocturnal exposure to low intensity blue light promotes alertness, and act as a cup of coffee. The present invention uses 460 nm blue light to illuminate the driver's face, when drowsiness is detected. The narrowband blue light LEDs for either the right or the left side, depending on country, are turned on and remain on for a period of time such as one hour to perk up the driver.

Depending on the age of the driver, blue light sensitivity decreases. In one embodiment, the driver's age is used as a factor to select one of two levels of intensity of blue light, for example 1 lux or 2 lux. 460 nm is on the dark side of blue light, and hence 1 or 2 lux at a distance of about 24-25 inches will not be intrusive to the driver, this is defined as dim light herein.

Mitigation of Driver Drowsiness Condition

Figure 32:
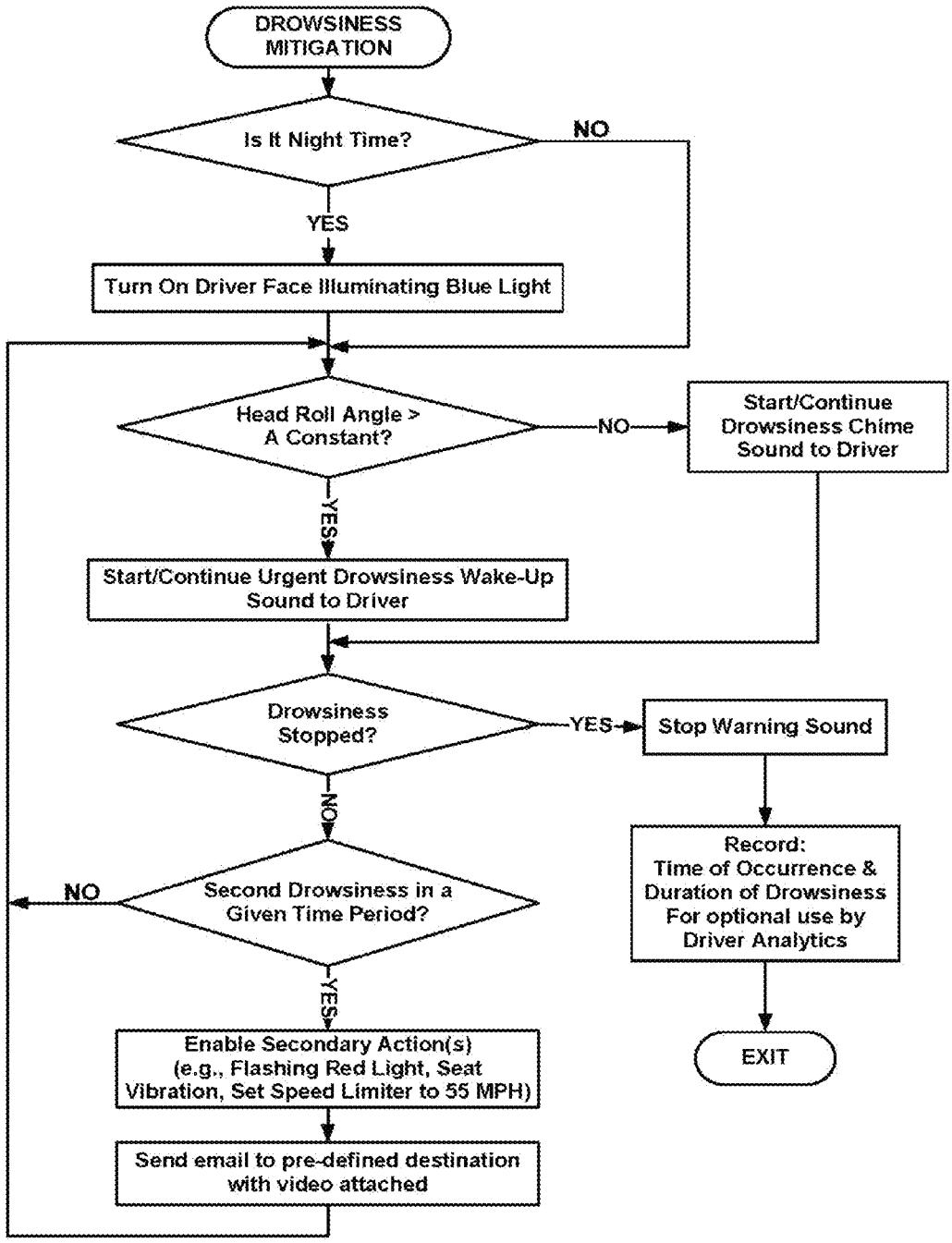
FIG. 32 shows the driver drowsiness mitigation.

The mitigation flowchart for driver drowsiness condition is shown in FIG. 32. In one embodiment 460 nm blue light or a narrowband blue light with wavelength centered in the +/− range of 460 nm+/−35 nm, which is defined as approximately 460 nm herein, hereafter referred to as the blue light, to illuminate the driver's face (by LEDs with reference 3 in FIG. 17) are turned on for a given period of time such as one hour. The lower value would be preferable because it is darker blue that is less unobtrusive to the driver. In another embodiment, the blue light is only turned on at night time when drowsiness condition is detected.

In a different embodiment, at least two levels of brightness of blue light is used. First, at the first detection of drowsiness, a low level blue light is used. In the repeated detection of driver drowsiness in a given time period, a higher brightness value of blue light is used. Also, the blue light can be used with repeating but not continuous vibration of the driver's seat.

In one embodiment, head roll angle is measured. Head roll typically occurs during drowsiness and shows deeper level of drowsiness compared to just eyes closed. If the head roll angle exceeds a threshold constant in the left or right direction, a more intrusive drowsiness warning sound is generated. If the head roll angle is with normal limits of daily use, then a lesser level and type of sound alert is issued.

If there were multiple occurrences of drowsiness with a given time period, such as one hour, then also secondary warning actions are also enabled. These secondary mitigation actions include but not limited to flashing red light to driver, driver seat or steering wheel vibration, setting vehicle speed limit to a low value such as 55 MPH.

Other drowsiness mitigation methods include turning on the vehicle's emergency flashers, driver's seat vibration, lowering the temperature of driver's side, lowering the top allowed speed to minimum allowed speed, and reporting the incidence to insurance company, fleet management, parents, etc. via internet.

In an embodiment, the driver's drowsiness condition is optionally reported to a pre-defined destination via internet connection as an email or Short Message Service (SMS) message. The driver's drowsiness is also recorded internally and can be used as part of driver analytics parameters, where the time, location, and number of occurrences of driver's drowsiness is recorded.

Nighttime Illumination of Inside Cabin and Driver's Face

Figure 35:
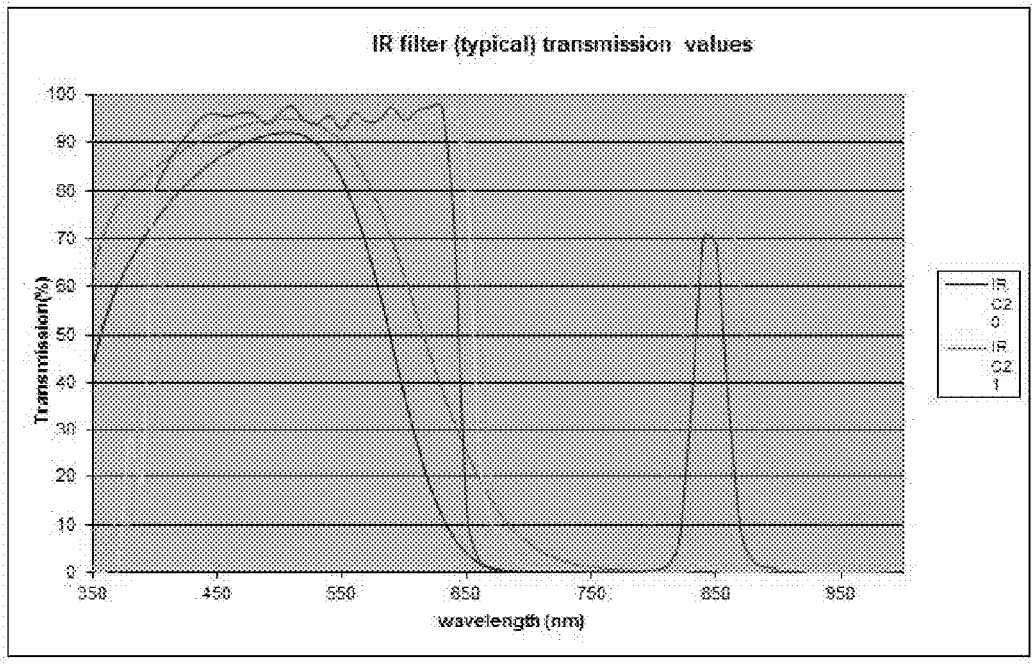
FIG. 35 shows driver-view Camera IR Bandpass for night time driver's face and inside cabin illumination.

One of the challenges is to detect the driver's face pose and level of eye's closed under significantly varying ambient light conditions, including night time driving. There can be other instances such as when driving through a tunnel also. Infrared (IR) light can be used to illuminate the driver's face, but this conflicts with the IR filter typically used in the lens stack to illuminate the IR during day time for improved focus, because the day time IR energy affects the camera operation negatively. Instead of completely removing the IR filter, the present method uses camera lens systems with a near infrared light bandpass filter, where only a narrow band of IR around 850 nm, which is not visible to a human, is passed and in conjunction with a 850 nm IR LED, as shown in FIG. 35, this allows illumination of driver's face and at the same time block most of the other IR energy during day time, so that camera's day time operation is not affected negatively in terms of auto-focus, etc. The IR light can be turned on only at night time or when ambient light is low, or IR light can be always turned on when the vehicle moving so that it is used to fill in shadows and starts working before the minimum speed activation, which also allows time for auto-exposure algorithm to start before being actually used. Alternatively, during day time, IR light can be toggled on and off, for example, every 0.5 seconds. This provides a different illumination condition to be evaluated before an alarm condition is triggered so as to minimize the false alarm conditions.

Auto-Exposure Control for Driver's Face

Figure 36:
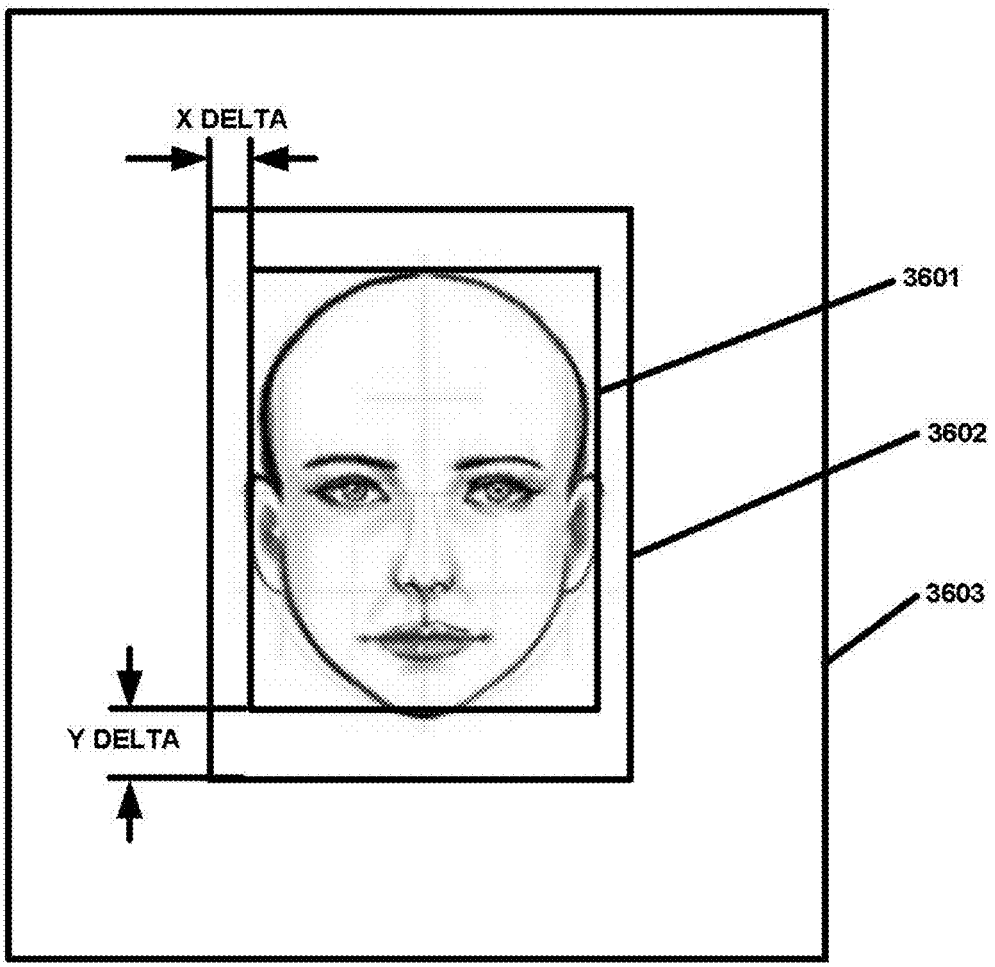
FIG. 36 shows area of auto-exposure calculation centered around face.

In a vehicle, ever-shifting lighting conditions cause heavy shadows and illumination changes and as a result, techniques that demonstrate high proficiency in stable lighting often will not work in this challenging environment. The present system and method uses High-Dynamic Range (HDR) camera sensor, which is coupled to an auto exposure metering system using a padded area around the detected face, as shown in FIG. 36 for auto exposure control. The detected face area 3601 coordinates and size is found in accordance with face detection. A padding area is applied so that auto exposure zone is defined as 3602 with X Delta and Y Delta padding around the detected face area 3601. This padding allows some background to be taken into account so that a white face does not overwhelm the auto exposure metering in the metering area of 3602. Such zone metering also does not give priority for other areas of the video frame 3603, which may include head lamps of vehicles or sun in the background, which would otherwise cause the face to be a dark area, and thereby negatively effects face detection, pose tracking, and level of eyes closed detection. The detected face area and its padding is recalculated and updated frequently and auto exposure zone area is updated accordingly.

Dual Driver's Face View Cameras Embodiment

The single camera embodiment with camera offset of about 15-20 degrees will have driver's left eye occluded from camera view when the driver turns his head to the left. Also, only the side profile of driver is available then. Some of the algorithms such as AAM do not work well when the yaw angle exceeds 35 degrees. Furthermore, the light conditions may be not favorable on one side of the car, for example, sun light coming from the left or the right side. The two camera embodiment shown in FIG. 43 has one camera sensor near the rear-view mirror, and a second camera sensor is located as part of the left A-pillar or mounted on the A-pillar. If the SoC to process video is located with the camera sensor near the rear-view mirror, then the left side camera sensor uses Mobile Industry Processor Interface bus (MIPI) Camera-Serial Interface standard CSI-2 or CSI-3 serial bus to connect to the SoC processor. The CSI-3 standard interface supports a fiber optic connection, which would make it easy to connect a second camera that is not close by and yet can reliably work in a noisy vehicle environment. In this case, both camera inputs are processed with the same facial processing to determine face gaze direction and level of eyes closed for each camera sensor, and the one with higher score of confidence factor is chosen as the face gaze direction and level of eyes closed. The left camera will have an advantage when driver's face is rotated to the left, and vice versa, also lighting condition will determine which camera produces better results. The chosen face gaze direction and level of eyes closed are used for the rest of the algorithm.

Smart Phone App

Figure 33:
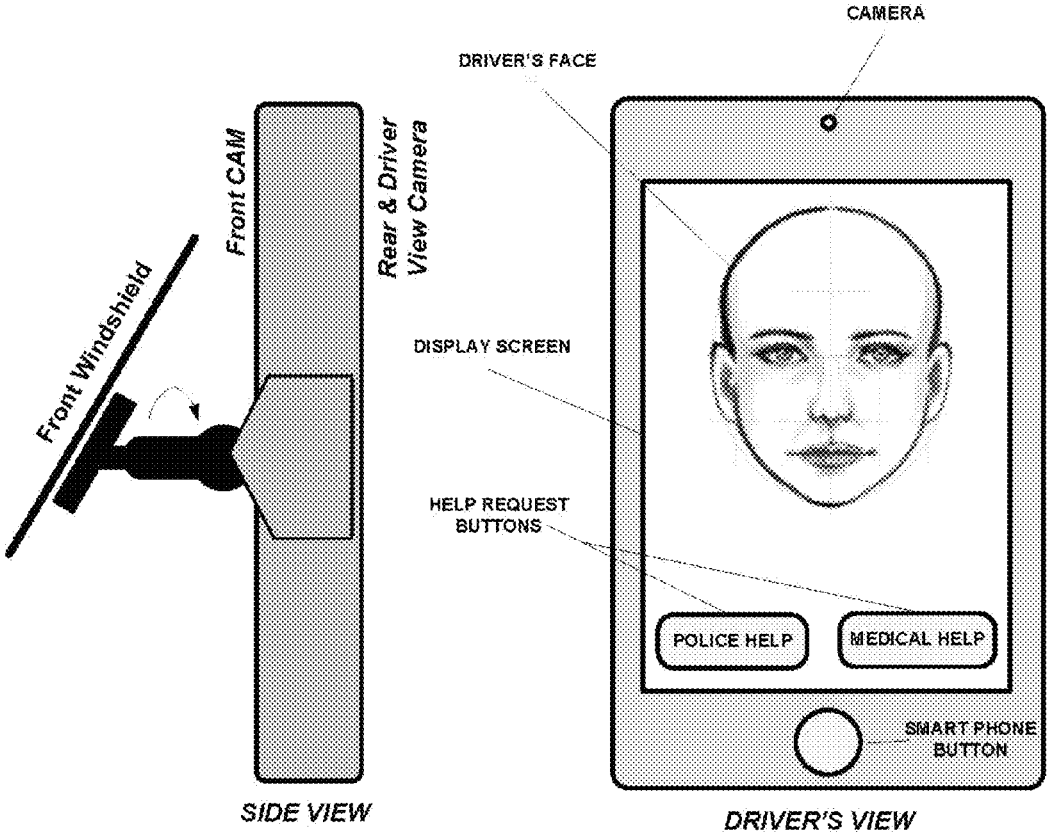
FIG. 33 shows the smartphone application for driver assistance and accident avoidance.

Some of the functionality can also be implemented as a Smart phone application, as shown in FIG. 33. This functionality includes recording front-view always when application is running, emergency help request, and distraction and drowsiness detection and mitigation. The smart phone is placed on a mount placed on the front windshield, and when application is running will show the self-view of the driver for a short time period when application is first invoked so as to align the roll and yaw angle of the camera to view the driver's face when first mounted. The driver's camera software will determine the driver's face yaw, tilt, and roll angles, collectively referred to as face pose tracking, and the level of eyes closed for each eye. The same algorithms used for determining the face pose tracking presented earlier is used here also. Also, some smart phone application Software Development Kit (SDK) already contains face pose tracking and level of eyes closed functions that can be used if the performance of these SDK is good under varying light conditions. For example, Qualcomm's Snapdragon SoC supports the following SDK method functions:

a) Int getFacePitch ()
b) Int getFaceYaw ()
c) Int getRollDegree ()
d) Int getLeftEyeClosedValue ()
e) Int getRightEyeClosedValue ()

Each eye's level of closed is determined separately and maximum of left and right eye closed is calculated by the use of max(level_of_left_eye_closed, level_of_right_eye_closed) function. This way, even if one eye is occluded or not visible, drowsiness is still detected.

Since a camera may be placed with varying angles by each driver, this is handled adaptively in software. For example, one driver may offset the yaw angle by 15 degrees, and another driver may have only 5 degrees offset in camera placement in viewing the driver. The present invention will examine the angle of yaw during highway speeds when driver is likely to be looking straight ahead, and the time distribution of yaw angle shown in FIG. 34 to determine center so as to account for the inherent yaw offset and to accordingly handle the left and right yaw angles in determining distraction condition, i.e., the boundaries of non-distraction window determination. The center angle where driver spends most of his/her time in terms of face gaze direction when driving on highways.

For night time driving a low level white light, dim visible light hereafter, is used to illuminate the driver's face. When the ambient light level is low, e.g., when driving in a long tunnel or at night time, the short term average value of ambient light level is used to turn-on or off the dim visible light. Since smart phone screens are typically at least have 4 inch size, the light is distributed over the large display screen area, and hence does not have to be bright due to large surface area of illumination which may otherwise interfere with driver's night time driving.

When drowsiness is detected using the same algorithm discussed earlier, the smart phone's dim visible light screen is changed to approximately 460 nm, which is defined as a narrowband light in the range of 460 nm+/−35 nm as dark blue light, to perk up the drivers by simulating the driver's ganglion cells. The driver can also invoke the blue light by closing one eye for a short period of time, i.e., by slow winking. The intensity of the blue light may be changed in accordance with continuing drowsiness, e.g., if continuing drowsiness is detected, then the level of blue light intensity can be increased, i.e., multiple levels of blue light can be used, and can also be adapted in accordance with a driver's age. Also, when drowsiness is detected blue light instead of white light is used for illuminating the driver's face during night time driving.

The smart phone will detect an severe accident based on processed accelerometer input as described in the earlier section, and will contact IP based emergency services, when an accident is detected. Also, there will be two buttons to seek police or medical help manually. In either automatic severe accident notification or manual police or medical help request, IP based emergency services will be sent location, vehicle information, smart phone number, and severity level in case of severe accident detection. Also, past several seconds of front-view video and several seconds of back view video will be uploaded to a cloud server, and link to this video will also be included in the message to IP based emergency services.

Error Rates and Confusion Matrix

A recent comprehensive survey (cited reference #5) on automotive collisions demonstrated a driver was 31% less likely to cause an injury related collision when a driver had one or more passengers who could alert him to unseen hazards. Consequently, there is great potential for driver assistance systems that act as virtual passengers, alerting the driver to potential dangers. To design such a system in a manner that is neither distracting nor bothersome due to frequent false alarms, these systems must act like real passengers, alerting the driver only in situations where the driver appears to be unaware of the possible hazard.

The vehicle lighting environment is very challenging due to varying illumination conditions. On the other hand, the position of driver face relative to camera is fixed with less than a feet of variation between cars, which makes it easy for facial detection due to near constant placement of driver's face. The present system have two cameras, one looking at the driver on the left side, and another one looking at the driver at the right side, so that both right-hand side and left-hand side drivers can be accommodated in different countries. The present system detects the location using GPS, and then determines the side the driver will use. This can be overridden by a user menu in set up menu. Also, the blue light is only turned on the driver side, but IR illumination is turned on both sides for inside cabin video recording that is required in taxis and police cars and other cases.

The present system calculates the face gaze direction and level of eyes closed at least 20 times per second, and later systems will increase this to real-time at 30 frames-per-second (fps). This means we have 30*3600, 108,000 estimates calculated per hour of driving. The most irritating is to have a false alarm frequently. FIG. 44 shows the confusion matrix, where the most important parameter is false alarms. A confusion matrix will summarize the results of testing the algorithm for further inspection. Each column of the matrix represents the instances in a predicted class, while each row represents the instances in an actual class. The name stems from the fact that it makes it easy to see if the system is confusing two classes (i.e. commonly mislabeling one as another).

The use of confidence score for disablement for cases where the class determination is not clear is very helpful to avoid false alarm conditions. It is better to have it disabled instead of risking a false alarm condition in challenging lighting conditions, for example, when sun is rising or falling on the driver's side and vehicle is travelling parallel to trees which causes quick and abrupt changes to the auto exposure.

For an error rate of one false alarm per week of 10 hour driving, and assuming the maximum allowed distraction or drowsiness time is 3 seconds in average for speed variations, this means we have 3*frame rate of consecutive errors to occur to have a false alarm condition. In the case of 30 fps frame rate having one false alarm in 10 hours of driving means having 90 consecutive error conditions to occur with confidence score higher than a threshold value in 1,080,000 tries.

Having a higher frame rate, for example 60 fps instead of 20 fps helps reduce the error rate because it is more difficult to have 3*60 versus 3*20 consecutive frames of errors for the false alarm condition to occur. If the probability of error of a given calculation for a given video frame is P, then the probability of this to occur N consecutive times is $P^N$. For 3 second duration with 30 fps calculations of head pose, the probability of error is $P^{90}$. For the case of three parallel algorithms, the probability of failure becomes $P^3N$. Even though each video frame is independently processed for determining the head pose, there is still a lot of similar video data, even though auto-exposure may be making inter-frame adjustments and IR light might be turned on and off between multiple frames.

Figure 43:
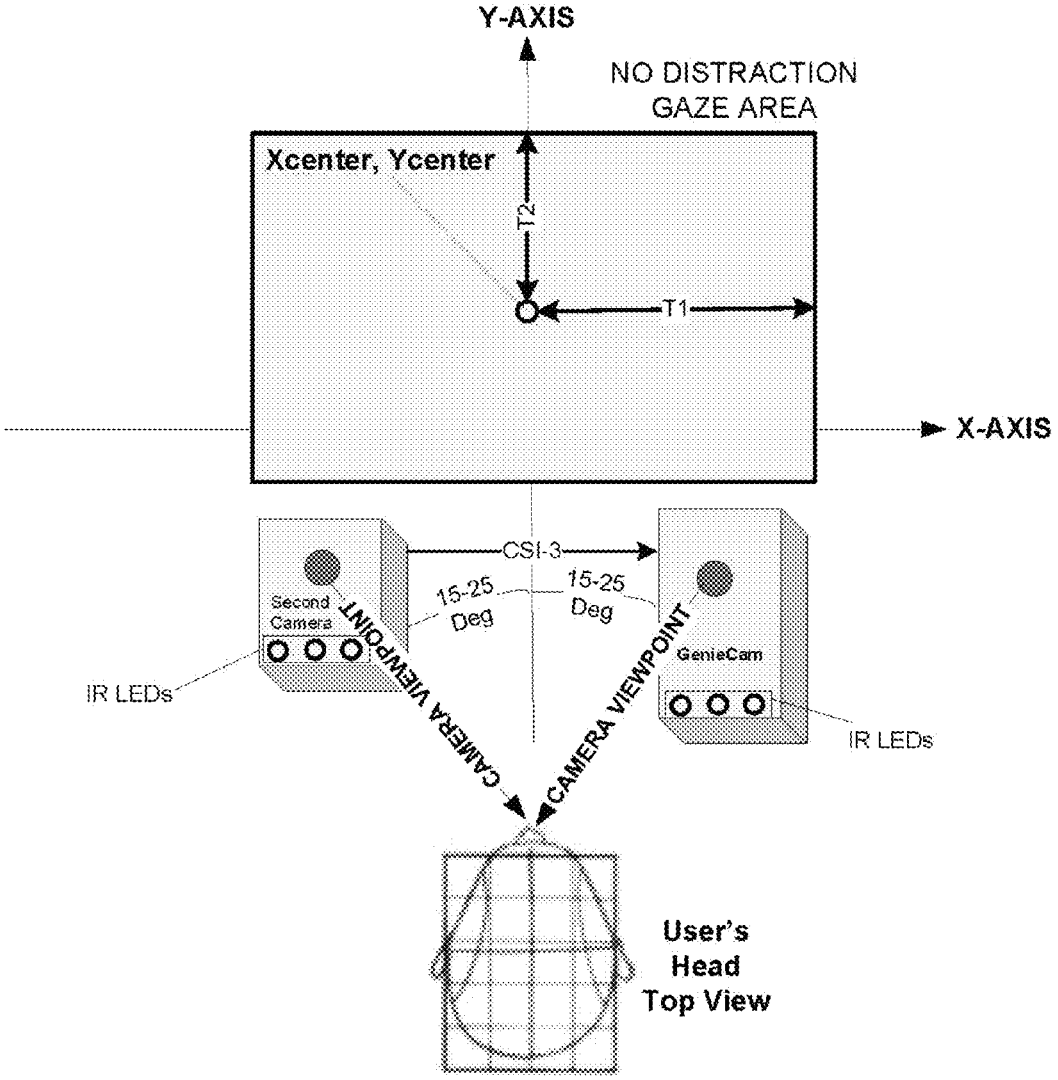
FIG. 43 camera placement and connections for dual-camera embodiment
Figure 45:
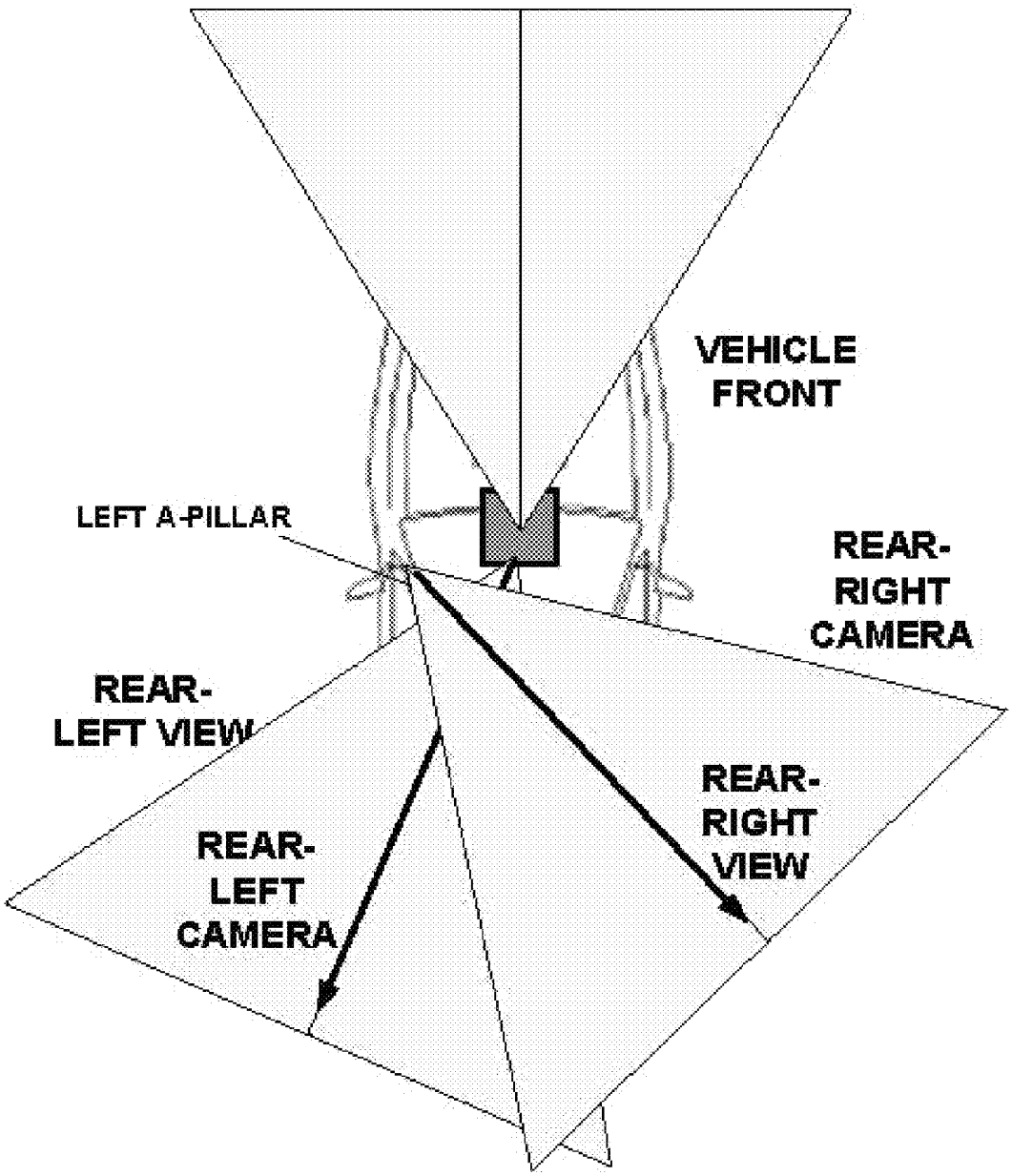
FIG. 45 shows the view angles of dual-camera embodiment embodiment for distraction and drowsiness detection.

Having dual camera embodiment of FIG. 43 also helps lower the error rate, since one of the cameras is likely to have a good lighting condition and also good view of the driver's face. The error rate also increases as the maximum allowed time for distraction or drowsiness is reduced, usually as a function of speed. Therefore, lowest allowed distraction or drowsiness time value is not always a linear function of time.

Cited reference #5: T. Rueda-Domingo, P. Lardelli-Claret, J. L. del Castillo, J. Jim'enez Mole'on, M. Garc'ia-Mart'in, and A. Bueno-Cavanillas, "The influence of passengers on the risk of the driver causing a car collision in spain," Accident Analysis & Prevention, vol. 36, no. 3, pp. 481-489, 2004.

I claim:

1. A method for a driver drowsiness warning and accident avoidance system for a vehicle, comprising the steps of:

a) determining speed of said vehicle;

b) calculating a maximum allowed drowsiness time in accordance with speed of said vehicle and allowed drowsiness travel distance;

wherein said maximum allowed drowsiness time is a non-linear function of said speed of said vehicle;

c) determining a score of confidence of detecting driver's face and facial features;

d) determining driver's level of the driver's left eye closed and the driver's right eye closed, if said score is larger than a first threshold value;

e) calculating level of eyes closed as maximum of said driver's left eye closed level and said driver's right eye closed level;

f) filtering said calculated level of eyes closed;

g) issuing a driver drowsiness alarm, if said filtered calculated level of eyes closed exceed a second threshold value persist longer than said maximum allowed drowsiness time; and h) illuminating the driver's face with approximately 460 nm dim blue light to increase alertness of driver when said driver drowsiness alarm is issued at night time.

2. The method claim of 1, further comprising the steps of:

a) determining the driver's face gaze direction;

b) if the driver's face gaze direction has a roll angle or a tilt angle that exceeds a third threshold value;

c) determining if condition of (b) persists more than a time duration of fourth threshold value, wherein the fourth threshold value can be the same as said maximum allowed drowsiness time or a different value; and d) issuing said driver drowsiness alarm if condition of (c) is true even if level of eyes closed cannot be determined due to occlusion.

3. The method claim of 1, wherein driver's face gaze direction is determined using one of method including but not limited to active appearance model, cylinder-head model, appearance template method, flexible models with active appearance models, geometric methods for facial features, tracking methods for feature tracking using affine transformation and appearance-based particle filters, and hybrid methods that includes one and more methods combined from a list of geometric method and tracking, appearance template and tracking, active appearance models, and cylinder-head models.

4. The method claim of 1, further comprising the steps of:

illuminating the driver's face by one of methods including but not limited to dim visible light and infrared light that is not visible to a human when ambient light level is low, wherein a camera lens system supports a near infrared light bandpass when infrared light is used for illumination in accordance with ambient light conditions.

5. The method claim of 1, further comprising the steps of:

a) detecting the area of facial coordinates of the driver;

b) adding a padding area around the said area of facial coordinates of the driver;

c) performing auto-exposure algorithm weighted inside said padding area; and d) updating said detected area continuously in accordance with the video stream of frames of the driver's face.

6. The method claim of 1, further comprising the step of:

using other mitigation methods when drowsiness is detected further including but not limited to vibrating driver's seat, multiple levels of said blue light for perking up the driver, turning on the vehicle's emergency flashers, automatically calling a friend, and lowering the temperature of inside said vehicle.

7. The method claim of 1, further comprising the steps of:

connecting to internet when said driver drowsiness warning is issued; and communicating drowsiness condition to a pre-determined destination which includes but not limited to one or more of fleet management for driver analytics, parent(s), highway patrol, insurance company for driver analytics, and family and friends.

8. A method for a driver distraction warning system for a vehicle for accident avoidance and driver analytics, comprising the steps of:

a) capturing images of the driver's face region using a high-dynamic range(HDR) image sensor under varying illumination conditions;

b) removing noise components using MATF and MASF filtering from said captured images;

c) determining a current speed of the vehicle, and using a past average speed value if said current speed cannot be determined;

d) calculating a maximum allowed distraction time in accordance with a maximum allowed distracted travel distance, wherein the maximum allowed distraction time is a non-linear function of said maximum allowed distracted travel distance;

e) determining a score of confidence of detecting the driver's face and facial features from said filtered captured images;

f) determining the driver's face gaze direction, if said score is larger than a predetermined score threshold;

g) filtering said driver's face gaze direction values over multiple frames of said filtered captured images;

h) determining if the driver's filtered face gaze direction is outside a non-distraction window of view;

i) calculating a time duration when the driver's filtered face gaze direction stays outside the non-distraction window: and j) issuing an at least one alert warning to the driver when the time duration of filtered face gaze direction exceeds a time threshold value if the current speed of the vehicle is larger than a low speed threshold value.

9. The method claim of 8, wherein said at least one alert warning includes but not limited to one of methods of sound or chime warning, turning on emergency flashers, limiting the speed of the vehicle to minimum allowed speed, and the driver's seat vibration.

10. The method claim of 8, further comprising the steps of:

a) capturing images of the driver's face region using a second high-dynamic range(HDR) image sensor;

b) determining a second face gaze direction value and a second confidence score using said second HDR image sensor input; and c) merging multiple face gaze direction and confidence score values.

11. The method claim of 8, further comprising the step of:

a) determining the x-y-z gyro sensor inputs in accordance with curvature of road condition to tangent point;

b) modifying a center vanishing point gaze direction based on the x-y-z sensor inputs; and c) Updating the non-distraction window coordinates in accordance with the modified center vanishing gaze point.

12. The method claim of 8, further comprising the step of:

modifying the maximum allowed distraction time in accordance to one or more of following factors including but not limited to total driving time since last stop, curviness of road, and weather conditions.

13. The method claim of 8, wherein a center vanishing point gaze direction is adapted to the driver, further comprising the steps of:

a) finding N face gaze directions with longest duration when the vehicle speed exceeds a certain threshold;

b) finding median of said N face directions; and c) updating the non-distraction window coordinates in accordance with said median of said N face gaze directions of the driver, wherein camera offset angle with respect to driver's face angle is also taken into account.

14. The method claim of 8, further comprising the steps of:

connecting to internet using a wireless connection when said at least one warning is issued; and communicating distraction condition to a pre-determined destination which includes one or more of fleet management, parent, highway patrol, insurance for profile management, and family and friends.

15. The method claim of 8, further comprising the step of:

illuminating the driver's face by one of methods including dim visible light and infrared light that is not visible to a human when ambient light level is low.

16. The method claim of 8, further comprising the steps of:

a) detecting the area of facial coordinates of the driver;

b) adding a padding area around the said area of facial coordinates of the driver;

c) performing auto-exposure algorithm weighted inside said padding area; and d) updating said detected area continuously in accordance with the video stream of frames of the driver's face.

17. The method claim of 8, wherein driver's face gaze direction is determined using one of method including but not limited to active appearance model, cylinder-head model, appearance Template method, flexible models with active appearance models, geometric methods for facial features, tracking methods for feature tracking using affine transformation and appearance-based particle filters, and hybrid methods that includes one and more methods combined from a list of geometric method and tracking, appearance template and tracking, active appearance models, and cylinder-head models.

18. A method for a driver assistance apparatus for accident avoidance, comprising the steps of:

a) determining a speed of a vehicle;

b) performing the following steps only when said vehicle speed exceeds a predetermined speed threshold;

c) selecting a maximum allowed distracted driving distance;

d) determining said driver's face gaze direction;

e) filtering said driver's face gaze direction over multiple captured video frames;

f) calculating a maximum allowed distraction time in accordance with the speed of said vehicle and said selected maximum allowed distracted driving distance;

g) determining if the driver's filtered face gaze direction is outside the non-distraction window of driver's normal view of road ahead, wherein taking into account of camera angle offset with respect to said driver's face;

h) calculating a time duration during which said driver's filtered face gaze direction is outside the non-distraction window; and i) Issuing an alert warning to said driver when the time duration of said filtered face gaze direction exceeds said maximum allowed distraction time.

19. The method claim of 18, wherein a center vanishing point gaze direction is adapted to the driver, further comprising the steps of:

a) finding N face gaze points with longest duration when the speed of said vehicle exceeds a certain threshold value;

b) finding median of said N face points; and c) adapting center gaze point of the driver in accordance with said median of said N gaze points.

20. The method claim of 18, further comprising the steps of:

a) connecting to internet using a wireless modem; and b) communicating distraction condition to a pre-determined destination which includes one or more of fleet management, parent, highway patrol, insurance for profile management, and family and friends, wherein internet protocol messaging including but not limited to short message service (SMS), email, Real Time Streaming Protocol (RTSP), hypertext transfer protocol, or file transfer protocol is used, wherein wireless modem internet connectivity is used including but not limited to third generation (3G), fourth generation (4G) or later mobile communication technology.

* * * * *